US005223379A

United States Patent [19]

Okada et al.

[11] Patent Number: 5,223,379

[45] Date of Patent: Jun. 29, 1993

[54] PROCESSING COMPOSITIONS FOR SILVER HALIDE COLOR PHOTOGRAPHIC MATERIALS AND METHOD FOR PROCESSING THE SAME MATERIALS

[75] Inventors: Hisashi Okada; Tadashi Inaba; Toshihiko Maekawa; Tsukasa Yamada; Hiroyuki Seki, all of Kanagawa, Japan

[73] Assignee: Fuji Photo Film Co., Ltd., Kanagawa, Japan

[21] Appl. No.: 701,238

[22] Filed: May 16, 1991

[30] Foreign Application Priority Data

May 17, 1990 [JP] Japan ..... 2-127479
Nov. 30, 1990 [JP] Japan ..... 2-336444

[51] Int. Cl.[5] ..... G03C 7/42

[52] U.S. Cl. ..... 430/393; 430/430; 430/460; 430/461

[58] Field of Search ..... 430/393, 430, 455, 460, 430/461

[56] References Cited

U.S. PATENT DOCUMENTS 4,563,405 1/1986 Ishikawa et al. ..... 430/460
4,910,125 3/1990 Haruuchi et al. ..... 430/393

FOREIGN PATENT DOCUMENTS 3423100 1/1985 Fed. Rep. of Germany .

*Primary Examiner*—Hoa Van Le
*Attorney, Agent, or Firm*—Sughrue, Mion, Zinn, Macpeak & Seas

[57] ABSTRACT

A processing composition having a bleaching ability which is used for processing silver halide color photographic materials, and containing a metal chelate compound formed from the salt of a metal selected from the group consisting of Fe(III), Mn(III), Co(III), Rh(II), Rh(III), Au(II), Au(III) and Ce(IV), and at least one of a compound represented by formula (I) and a compound represented by formula (II):

(I)

wherein $L_1$ and $L_2$ each represents $X_1$ and $X_2$ each represents an oxygen atom or a sulfur atom, R, $R_1$, $R_2$ and $R_3$ each represents a hydrogen atom or an aryl or alkyl group which may be substituted, $R_4$ represents an aryl or alkyl group which may be substituted, or —$OR_7$, $R_5$ and $R_6$ each has the same meaning as $R_1$, $R_7$ represents an aryl or alkyl group which may be substituted, $Y_1$ and $Y_2$ each represents an arylene or alkylene group which may be substituted. R, $L_1$ and $L_2$ may be joined together to form rings;

(II)

wherein $L_3$ represents or where $X_1$, $X_2$, $Y_1$, $Y_2$, $R_1$, $R_2$, $R_3$ and $R_4$ have the same meaning as in formula (I), $R_a$, $R_b$ and $R_c$ each represents a hydrogen atom or an aryl or alkyl group which may be substituted, $R_a$, $R_b$, $R_c$ and $L_3$ may be joined together to form rings, and W represents a divalent linking group; or a processing composition having a bleaching ability which is used for processing silver halide color photographic materials, and containing a compound which has a standard electron migration rate constant $k_s$ in a gelatin film of at least $8\times10^{-4}$ cm/s; and a method for processing silver halide color photographic materials after development with the above processing composition.

17 Claims, No Drawings

PROCESSING COMPOSITIONS FOR SILVER HALIDE COLOR PHOTOGRAPHIC MATERIALS AND METHOD FOR PROCESSING THE SAME MATERIALS

FIELD OF THE INVENTION

The present invention concerns processing compositions for silver halide color photographic materials. More particularly, the present invention concerns processing compositions which have a bleaching ability and which contain a bleaching agent for the bleaching process after color development, and a method of processing with these compositions.

BACKGROUND OF THE INVENTION

Silver halide color photographic materials (referred to hereinafter as color photosensitive materials) are processed after exposure by color development, desilvering and additional processing operations (i.e., additional processing steps) such as water washing and stabilization, for example.

In the color development process, the exposed silver halide grains are reduced by the color developing agent to form silver, and the oxidant of the developing agent which is formed reacts with couplers to form the image dyes.

In the subsequent desilvering process, the developed silver which has been formed in the development process is oxidized (bleached) to a silver salt by use of a bleaching agent which has an oxidizing action, and this silver salt is removed (fixed), together with the unused silver halide, with a fixing agent which forms soluble silver. Bleaching and fixing can be carried out independently as a bleaching process and a fixing process, or they can be carried out at the same time in a single process (a bleach-fixing process). Details of these processing operations have been described by James in *The Theory of the Photographic Process*, fourth Edition, 1977.

Various supplementary processes, such as water washing processes, stabilization processes, film hardening processes and stop processes, can be carried out in addition to the above mentioned color development and desilvering processes, if desired, in order to maintain the photographic and physical quality of the dye image, or in order to maintain processing stability.

The above mentioned processing operations are generally carried out using an automatic processor. In recent years, in particular, small scale automatic processors known as mini-labs have been installed in stores, and the availability of rapid processing services for the customer has become widespread.

Against this sort of background, strong demands have arisen in particular in recent years for more rapid processing, and a great increase in the speed of the bleaching process has become desirable.

However, the ethylenediaminetetraacetic acid ferric complex salts which have been used conventionally have a fundamental weakness in that they have a low oxidizing power, and although the use of, for example, bleaching accelerators (for example, the addition of the mercapto compounds disclosed in U.S. Pat. 1,138,842) provides some improvement, the target of rapid bleaching has not been attained.

Ferricyanide (red prussiate of potash), ferric chloride and bromates, for example, are known as bleaching agents with which rapid bleaching can be achieved, but environmental problems are associated with ferricyanide, handling problems such as metal corrosion occur with ferric chloride, and problems with the instability of the solution occur with bromates, so these materials are not widely used.

Hence, a bleaching agent which provides rapid bleaching, which has good handling properties, and which does not have problems with disposal of the waste liquids is desirable.

The 1,3-diaminopropanetetraacetic acid ferric complex salt bleaching agent has been disclosed recently as a bleaching agent which fulfills these requirements. Furthermore, carbamoyl-type chelating agent bleaching agents have been disclosed in JP-A-1-93740 (the term "JP-A" as used herein refers to a "published unexamined Japanese patent application")

However, these bleaching agents have problems in terms of performance, in that bleach fogging occurs during bleaching. The addition of buffers to the bleach has been disclosed as a means of reducing the extent of bleach fogging (see, for example, JP-A-1-213657), but the level of improvement achieved is unsatisfactory, and in the case of rapid processing where the color development is carried out in 3 minutes or less, in particular, the occurrence of pronounced bleach fogging arises because of the highly active developers which are used.

Moreover, there is a problem with increased staining on storage after processing when a processing solution which has a bleaching ability comprising 1,3-diaminopropanetetraacetic acid ferric complex salt is used.

Further, there is a problem with increased change of gradation due to increase in a magenta coloration at the color image portion on storage after processing when a processing solution which has a bleaching ability comprising 1,3-diaminopropanetetraacetic acid ferric complex salt is used.

Also, there is a problem with a failure of color restoration due to a leuco dye which is formed by a cyan dye of the color image portion when the bleaching time is further shortened even if a processing solution which has a bleaching ability comprising 1,3-diaminopropanetetraacetic acid ferric complex salt is used.

To replace these compositions and methods, improved processing compositions which have a bleaching ability and processing methods are desired.

SUMMARY OF THE INVENTION

Hence, one object of the present invention is to provide a processing composition which has good handling properties and which has no environmental problems with waste liquids, and a method of processing photosensitive materials with this composition.

A second object of the present invention is to provide a processing composition which has a bleaching ability which has excellent desilvering properties, and a method of processing photosensitive materials with this composition.

A third object of the present invention is to provide a processing composition which has a bleaching ability with which little bleach fogging occurs, and a method of processing photosensitive materials with this composition.

A fourth object of the present invention is to provide a processing composition which has a bleaching ability which gives rise to little staining with the passage of time, and a method of processing photosensitive materials with this composition.

A fifth object of the present invention is to provide a processing composition which has a bleaching ability having an excellent rapid bleaching property, an improved failure of color restoration and less changing gradation with the passage of time, and a method for processing photosensitive materials by use of the same processing composition.

The above mentioned objects have been realized as described below.

(1) The present invention provides a processing composition having a bleaching ability which is used for processing silver halide color photographic materials, and containing a metal chelate compound formed from the salt of a metal selected from the group consisting of Fe(III), Co(III), Mn(III), Rh(II), Rh(III), Au(II), Au(III) and Ce(IV), and at least one of a compound represented by formula (I) indicated below and a compound represented by formula (II) indicated below:

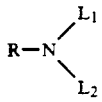

(I)

wherein $L_1$ and $L_2$ each represents

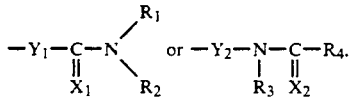

$X_1$ and $X_2$ each represents an oxygen atom or a sulfur atom, R, $R_1$, $R_2$ and $R_3$ each represents a hydrogen atom or an aryl or alkyl group which may be substituted, $R_4$ represents an aryl or alkyl group which may be substituted,

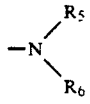

or $—OR_7$, $R_5$ and $R_6$ each has the same meaning as $R_1$, $R_7$ represents an aryl or alkyl group which may be substituted, $Y_1$ and $Y_2$ each represents an arylene or alkylene group which may be substituted, and R, $L_1$ and $L_2$ may be joined together to form rings;

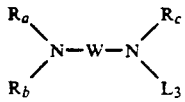

(II)

wherein $L_3$ represents

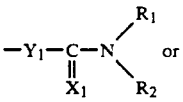

or

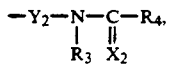

where $X_1$, $X_2$, $Y_1$, $Y_2$, $R_1$, $R_2$, $R_3$ and $R_4$ have the same meaning as in formula (I), $R_a$, $R_b$ and $R_c$ each represents a hydrogen atom or an aryl or alkyl group which may be substituted, $R_a$, $R_b$, $R_c$ and $L_3$ may be joined together to form rings, and W represents a divalent linking group. Also, the present invention provides a method of processing in which this composition is used.

(2) The present invention also provides a processing composition having a bleaching ability which is used for processing silver halide color photographic materials, and containing a compound which has a standard electron migration rate constant $k_s$ in a gelatin film of at least $8\times10^{-4}$ cm/s, and a method of processing in which this composition is used.

According to the present invention, a silver halide color photographic material is subjected to image-wise exposure and then color developed, after which the material is processed at least with a processing solution (called a bleaching solution or bleach-fixing solution) which has a bleaching ability and which contains a compound of the present invention, wherein the bleaching of the developed silver is carried out very rapidly and, moreover, with none of the pronounced bleach fogging which is observed with the bleaching agents with which rapid bleaching has been carried out conventionally. The effect is especially pronounced when processing with a solution which has a bleaching ability following rapid color development with a processing time of 3 minutes or less. Furthermore, the image storage properties after processing are also good, and the system is also desirable in regard to handling properties.

DETAILED DESCRIPTION OF THE INVENTION

The compounds represented by formula (I) and formula (II) are described in detail below.

In formula (I) or formula (II), R, $R_a$, $R_b$ and $R_c$ each independently represents a hydrogen atom, an aryl or alkyl group which may be substituted. The alkyl groups represented by R, $R_a$, $R_b$ and $R_c$ may be linear chain, branched or cyclic alkyl groups, and they preferably have from 1 to 10 carbon atoms. The methyl and ethyl groups are particularly preferred for alkyl groups. The aryl groups represented by R, $R_a$, $R_b$ and $R_c$ preferably have from 6 to 10 carbon atoms, and the phenyl group is most desirable.

$L_1$, $L_2$ and $L_3$ each represents

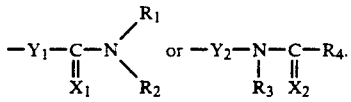

$X_1$ and $X_2$ represents an oxygen atom or a sulfur atom. $R_1$, $R_2$ and $R_3$ each represents a hydrogen atom or an aryl or alkyl group which may be substituted. The alkyl groups represented by $R_1$, $R_2$ and $R_3$ may be linear chain, branched or cyclic alkyl groups, and those which have from 1 to 10 carbon atoms are preferred. The aryl groups represented by $R_1$, $R_2$ and $R_3$ preferably have from 6 to 10 carbon atoms, and the phenyl group is most desirable. Furthermore, $R_1$ and $R_2$ may be joined together to form a ring. Rings which may be formed by joining $R_1$ and $R_2$ together include, for example, the morpholine ring, the piperidine ring, the pyrrolidine ring and the pyrazine ring. $R_4$ represents an alkyl or aryl group which may be substituted,

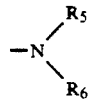

or —$OR_7$. $R_5$ and $R_6$ each has the same meaning as $R_1$. $R_7$ represents an aryl or alkyl group which may be substituted. The alkyl groups and aryl groups represented by $R_7$ are the same as those represented by $R_1$. The most desirable groups for $R_1$, $R_2$ and $R_3$ are hydrogen atoms, alkyl groups which may be substituted and which have from 1 to 4 carbon atoms, and phenyl groups which may be substituted.

$Y_1$ and $Y_2$ preferably represent arylene groups which have from 6 to 12 carbon atoms or alkylene groups which have from 1 to 4 carbon atoms, which may be substituted. They are more desirably methylene groups or ethylene groups, and they are most desirably methylene groups.

Substituent groups for the alkyl and aryl groups represented by R, $R_a$, $R_b$, $R_c$, $R_1$, $R_2$, $R_3$, $R_4$, $R_5$, $R_6$, $R_7$, $Y_1$ and $Y_2$ include, for example, alkyl groups, aralkyl groups, alkenyl groups, alkynyl groups, alkoxy groups, aryl groups, substituted amino groups, acylamino groups, sulfonylamino groups, ureido groups, urethane groups, aryloxy groups, sulfamoyl groups, carbamoyl groups, alkylthio groups, arylthio groups, sulfonyl groups, sulfinyl groups, hydroxy groups, halogen atoms, cyano groups, sulfo groups, carboxyl groups, phosphono groups, aryloxycarbonyl groups, acyl groups, alkoxycarbonyl groups, acyloxy groups, carboxamido groups, sulfonamido groups and nitro groups. Among these, substituent groups for the alkyl and aryl groups represented by R are preferably alkyl groups, hydroxy groups, sulfo groups, carboxyl groups and phosphono groups; substituent groups for the alkyl and aryl groups represented by $R_a$, $R_b$ and $R_c$ are preferably acylamino groups, carbamoyl groups, alkyl groups, hydroxy groups, sulfo groups, carboxyl groups and phosphono groups; substituent groups for the alkyl and aryl groups represented by $R_1$, $R_2$, $R_3$, $R_4$, $R_5$, $R_6$ and $R_7$ are preferably alkyl groups, aryl groups, hydroxy groups, sulfo groups, carboxyl groups, phosphono groups, amino groups, alkylthio groups and arylthio groups; and substituent groups for the alkyl and aryl groups represented by $Y_1$ and $Y_2$ are preferably alkyl groups.

Moreover, R and at least one of $R_a$, $R_b$ and $R_c$ preferably represent alkyl or aryl groups which have —OH, —$COOM^1$, —$PO_3M^2M^3$ or —$SO_3M^4$ (where $M^1$, $M^2$, $M^3$ and $M^4$ each represents a hydrogen atom or a cation, the cations being, for example, alkali metals (for example, lithium, sodium, potassium), ammonium or pyridinium) as substituent groups, and they are most desirably aryl groups or alkyl groups which have —$COOM^1$ as substituent groups.

R, $L_1$ and $L_2$, and $R_a$, $R_b$, $R_c$ and $L_3$ may be joined together to form rings where possible.

W in formula (II) represents a divalent linking group. And an organic divalent linking group is preferred as the divalent linking group. Further, alkylene groups which have from 2 to 8 carbon atoms, arylene groups which have from 6 to 10 carbon atoms, the cyclohexane group, the 5- to 7-membered divalent hetero ring, —$(W^1—O)_m—W^2$—, —$(W^1—S)_m—W^2$— (where $W^1$ and $W^2$ represent alkylene or arylene groups and m represents an integer of from 1 to 3), and

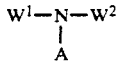

(where A represents a hydrogen atom, hydrocarbon, —$L_A$—$COOM^5$, —$L_A$—$PO_3M^6M^7$, —$L_A$—OH or —$L_ASO_3M^8$ (where $L_A$ represents an alkylene group which has from 1 to 8 carbon atoms or an arylene group which has from 6 to 10 carbon atoms, and $M^5$ to $M^8$ represent hydrogen atoms or cations (for example, an alkali metal, ammonium))) are particularly preferred as the divalent linking group, and the divalent linking group may be comprised of combinations of these groups. These divalent linking groups may have substituent groups, and the substituent groups described for the alkyl and aryl groups represented by R can also be cited as examples of substituent groups for the divalent linking groups. The nitrogen-containing hetero rings such as

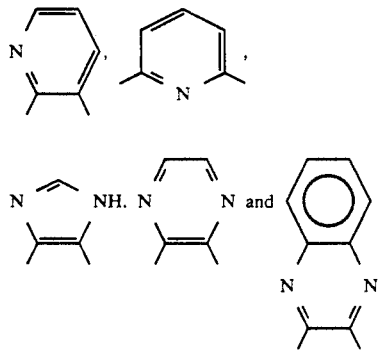

are preferred as the divalent hetero ring.

The groups preferred as W are alkylene groups or cyclohexane groups.

Representative examples of W are indicated below.

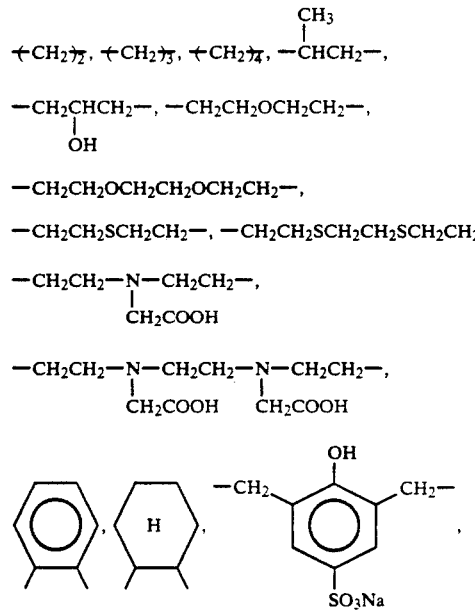

-continued

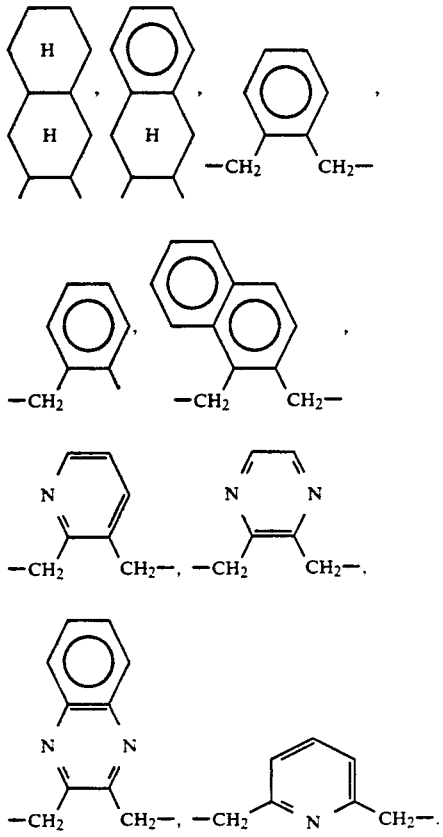

Among these, preferred, more preferred and most preferred examples of W are indicated below.

Preferred Examples $-(CH_2)_2-$, $-(CH_2)_3-$, $-(CH_2)_4-$, $-CH(CH_3)CH_2-$, $-CH_2CH(OH)CH_2-$, $-CH_2CH_2OCH_2CH_2-$, $-CH_2CH_2OCH_2CH_2OCH_2CH_2-$, $-CH_2CH_2SCH_2CH_2-$, $-CH_2CH_2SCH_2CH_2SCH_2CH_2-$, $-CH_2CH_2-N(CH_2COOH)-CH_2CH_2-$, $-CH_2CH_2-N(CH_2COOH)-CH_2CH_2-N(CH_2COOH)-CH_2CH_2-$,

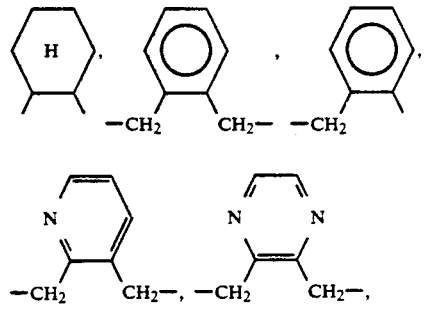

-continued

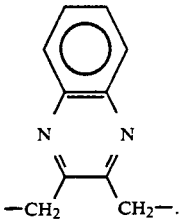

More Preferred Examples $-(CH_2)_2-$, $-(CH_2)_3-$, $-CH(CH_3)CH_2-$, $-CH_2CH(OH)CH_2-$, $-CH_2CH_2OCH_2CH_2-$, $-CH_2CH_2OCH_2CH_2OCH_2CH_2-$, $-CH_2CH_2SCH_2CH_2-$, $-CH_2CH_2SCH_2CH_2SCH_2CH_2-$, $-CH_2CH_2N(CH_2COOH)CH_2CH_2-$, $-CH_2CH_2-N(CH_2COOH)-CH_2CH_2-N(CH_2COOH)-CH_2CH_2-$, Most Preferred Examples $-(CH_2)_2-$, The compounds represented by formula (I) or (II) which can be represented by formula (III) or (IV) indicated below are preferred, and those which can be represented by formula (IV) are especially desirable.

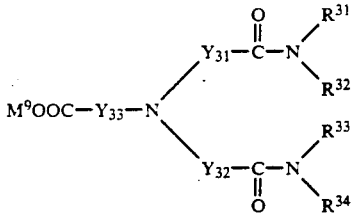

(III)

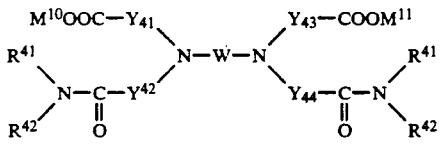

(IV)

wherein $Y_{31}$, $Y_{32}$ and $Y_{33}$, and $Y_{41}$, $Y_{42}$, $Y_{43}$ and $Y_{44}$ each represents an alkylene group or an arylene group, and alkylene groups which have from 1 to 4 carbon atoms and which may be substituted are preferred. Moreover, the methylene group and the ethylene group are more preferred, and the methylene group is especially preferred. $M^9$, $M^{10}$ and $M^{11}$ each represents a hydrogen atom or a cation (for example, an alkali metal, ammonium). $R^{31}$, $R^{32}$, $R^{33}$, $R^{34}$, $R^{41}$ and $R^{42}$ have the same meaning as $R_1$ and $R_2$ in formula (I) or (II). W has the same meaning as W in formula (II). The total carbon atoms of compounds represented by formula (I) or (II) of the present invention are preferably 40 or less and more preferably 30 or less.

Representative examples of compounds which can be represented by at least one of formula (I) and formula (II) are indicated below, but the compounds of the formulae are not limited by these examples.

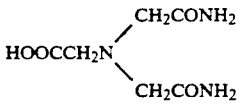

B-1

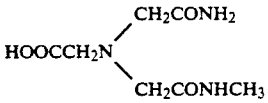

B-2

$N(CH_2CONH_2)_3$

B-3

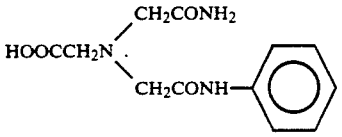

B-4

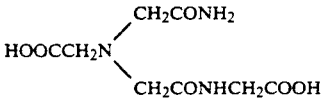

B-5

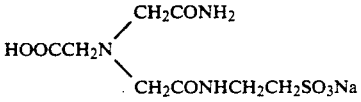

B-6

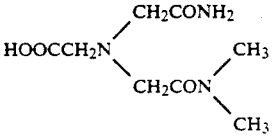

B-7

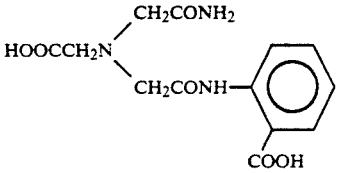

B-8

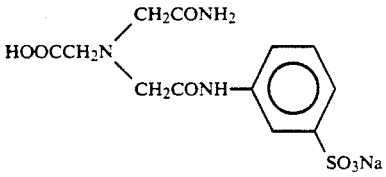

B-9

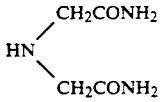

B-10

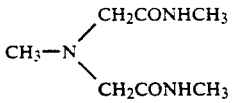

B-11

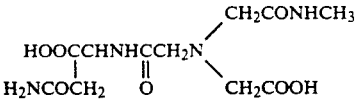

B-12

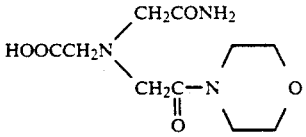

B-13

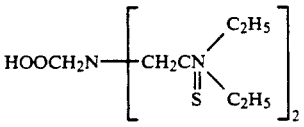

B-14

$HOOCCH_2N(CH_2NHCCH_3)_2$ (O)

B-15

$HOOCCH_2N(CH_2NHCNHCH_3)_2$ (O)

B-16

$HOOCCH_2N(CH_2NHCOCH_3)_2$ (O)

B-17

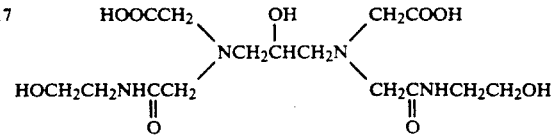

B-18

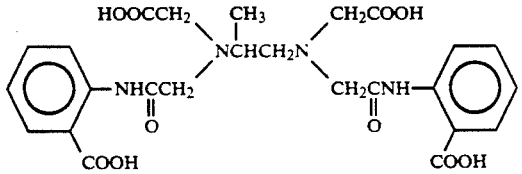

B-19

-continued
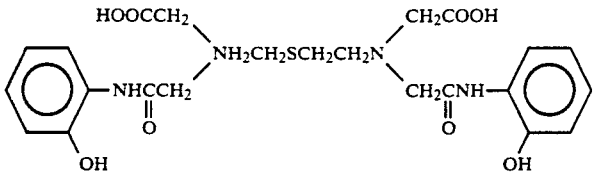
B-20
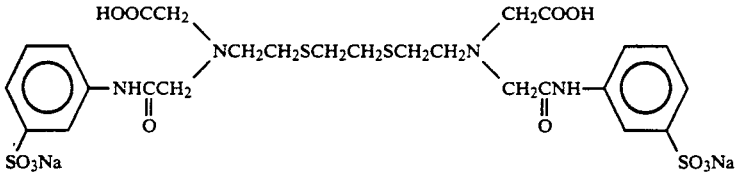
B-21
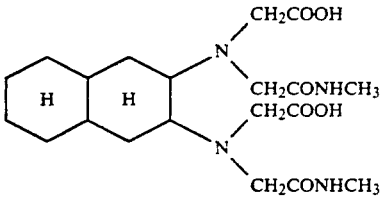
B-22
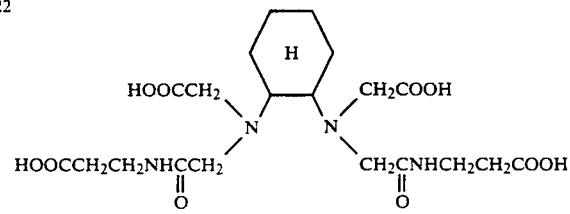
B-23
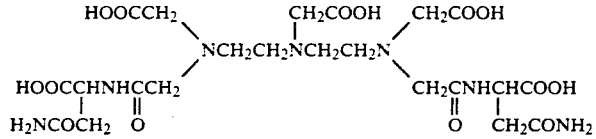
B-24
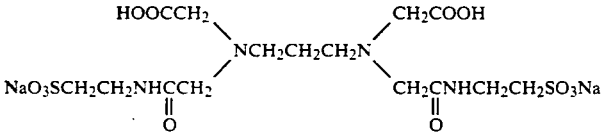
B-25
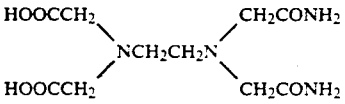
B-26
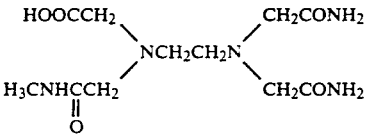
B-27
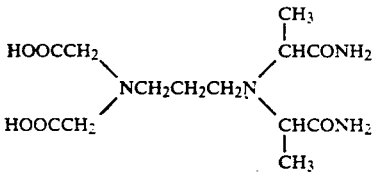
B-28
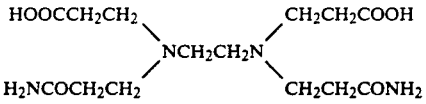
B-29
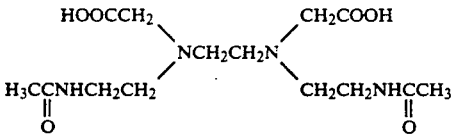
B-30
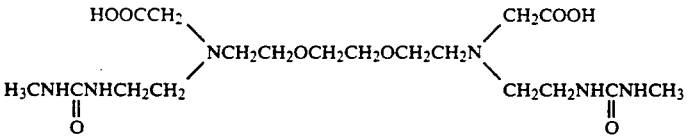
B-31

-continued
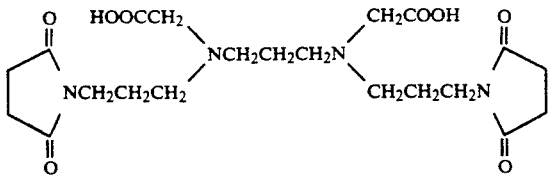
B-32
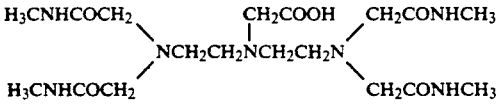
B-33
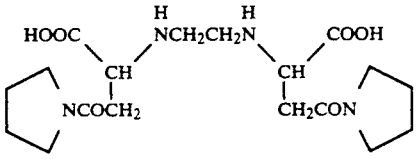
B-34
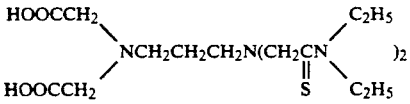
B-35
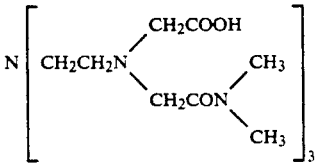
B-36
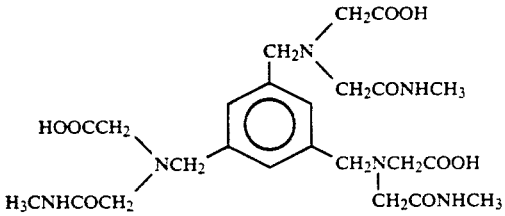
B-37
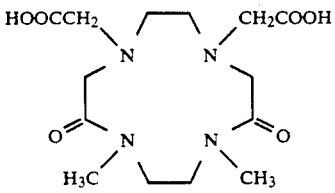
B-38
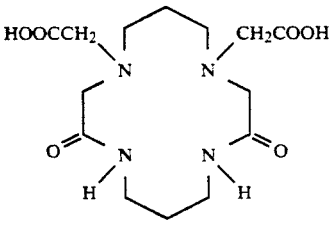
B-39
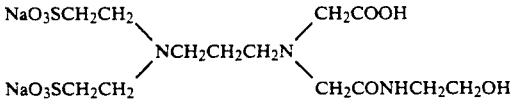
B-40
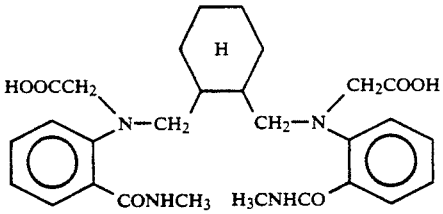
B-41
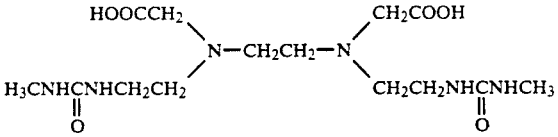
B-42
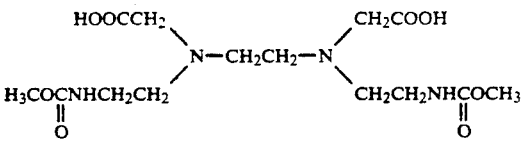
B-43
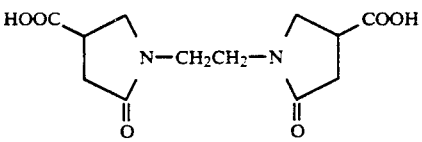
B-44
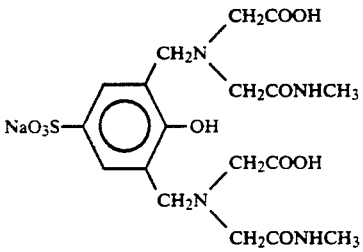
B-45
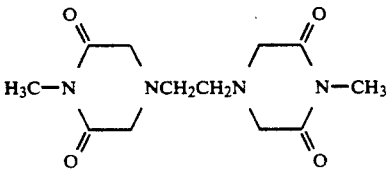
B-46

-continued
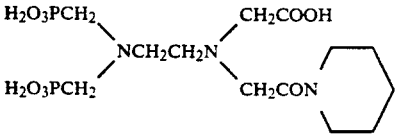
B-47
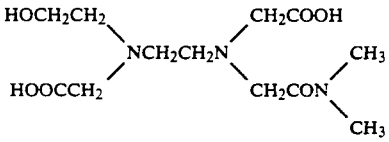
B-48
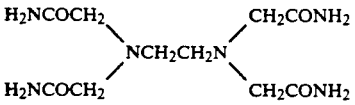
B-49
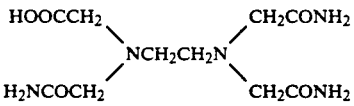
B-50
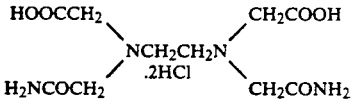
B-51
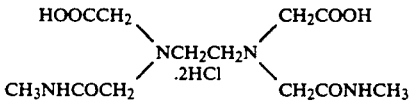
B-52
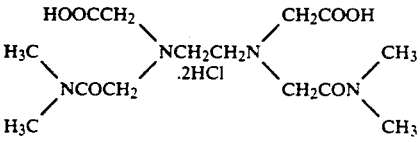
B-53
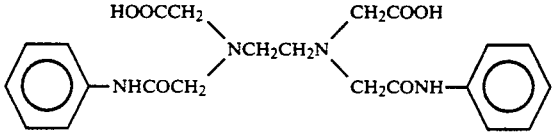
B-54
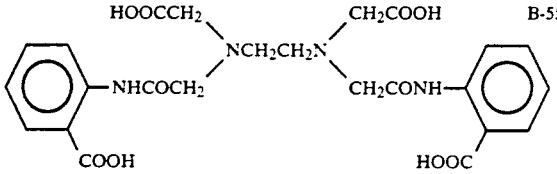
B-55
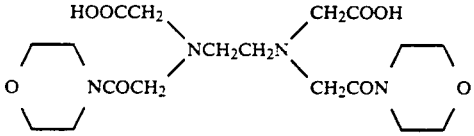
B-56
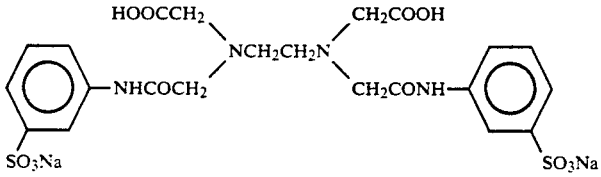
B-57
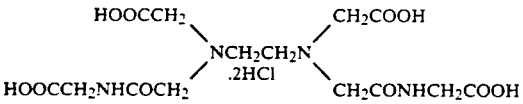
B-58
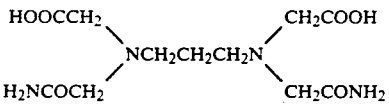
B-59
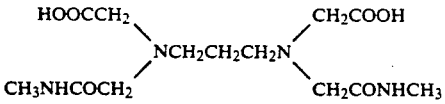
B-60
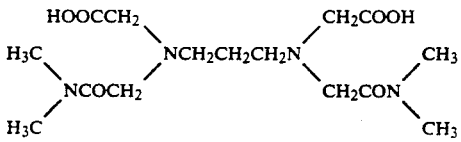
B-61
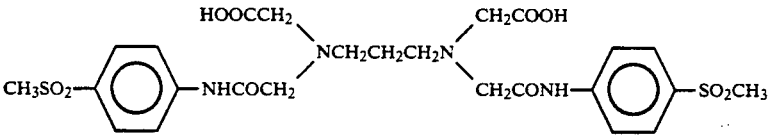
B-62
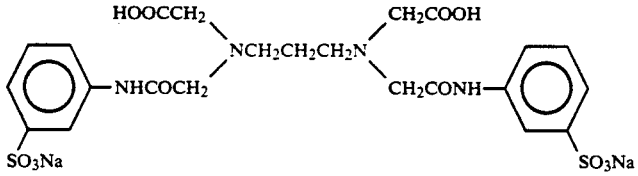
B-63

-continued
B-64
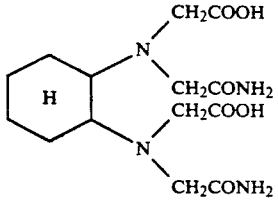
B-65
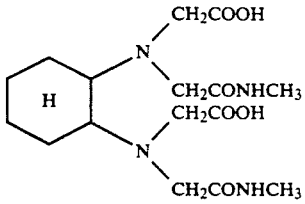
B-66
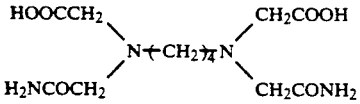
B-67
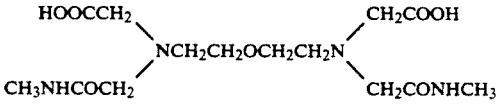
B-68
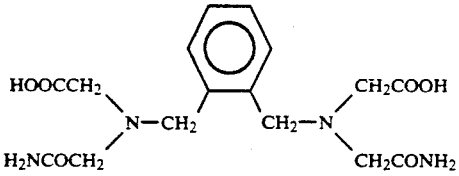
B-69
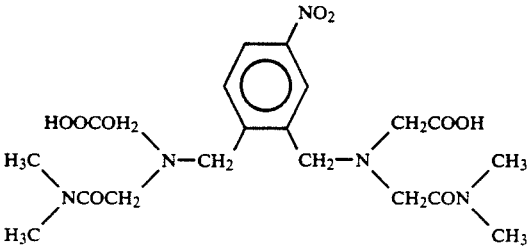
B-70
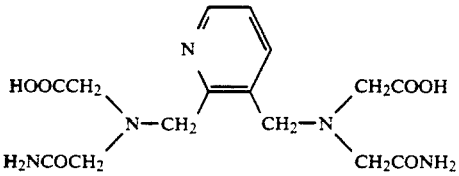
B-71
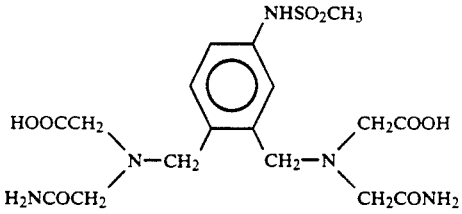
B-72
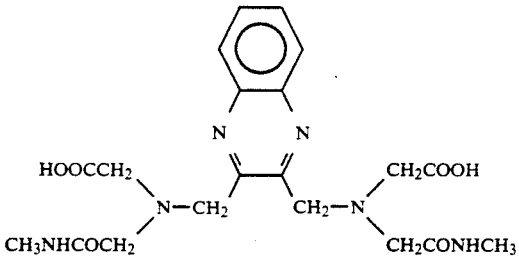
B-73
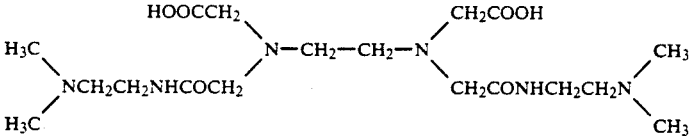
B-74
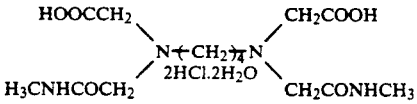
B-75
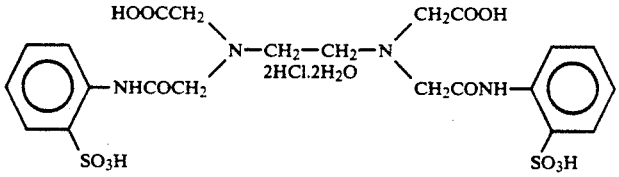
B-76
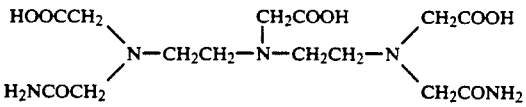

-continued

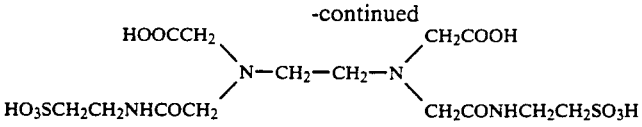

B-77

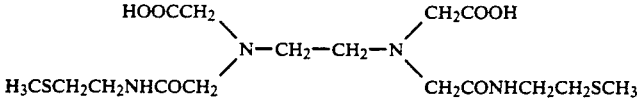

B-78

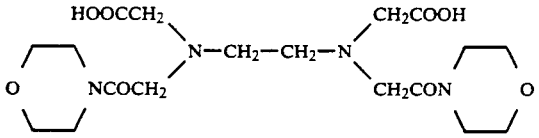

B-79

Examples of the preparation of these compounds according to the present invention are described below.

SYNTHESIS EXAMPLE 1

Preparation of Compound B-51

100 g (0.390 mol) of acid anhydride of ethylenediaminetetraacetic acid (see French Patent 1,548,888 for a method of preparation) was suspended, with ice cooling, in 200 ml of water, and 98.0 g of a 29 wt % aqueous ammonia (0.811 mol) was added slowly in such a way as to maintain the internal temperature within the range of from 5° C. to 10° C. The mixture was then agitated for 1.5 hours while continuing the ice cooling, and then 86.0 g of 36 wt % hydrochloric acid (0.848 mol) was added to the mixture, after which 1 liter of ethanol was added. The solid which precipitated out was recovered by filtration and recrystallized from water/ethanol, whereupon 78.0 g (0.215 mol) of the target Compound B-51 was obtained. Yield: 55%, Melting Point: 145°-147° C. (with decomposition)

SYNTHESIS EXAMPLE 2

Preparation of Compound B-52

100 g (0.390 mol) of acid anhydride of ethylenediaminetetraacetic acid was suspended, with ice cooling, in 200 ml of water, and 163.0 g of a 40 wt % aqueous methylamine solution (0.811 mol) was added slowly in such a way as to maintain an internal temperature within the range of from 5° C. to 10° C. The mixture was subsequently agitated for 1.5 hours while continuing the ice cooling, and then 86.0 g (0.848 mol) of 36 wt % hydrochloric acid was added to the mixture, after which the mixture was concentrated under reduced pressure to provide an internal volume of about 200 ml. 1 liter of methanol was added to the concentrate, and the solid which precipitated out was recovered by filtration and recrystallized from water/methanol, whereupon 93.0 g (0.238 mol) of the target Compound B-52 was obtained. Yield: 61%, Melting Point: 200°-202° C. (with decomposition).

SYNTHESIS EXAMPLE 3

Preparation of Compound B-53

5.12 g (20.0 mmol) of acid anhydride of ethylenediaminetetraacetic acid was suspended, with ice cooling, in 20 ml of water, and 3.61 g of a 50 wt % aqueous solution of dimethylamine (40.0 mmol) was added slowly in such a way that the internal temperature was maintained within the range of from 5° C. to 10° C. The mixture was then agitated for 30 minutes while continuing the ice cooling, after which it was agitated for 2 hours at room temperature. After adding 4.06 g (40.0 mmol) of 36 wt % hydrochloric acid, methanol and then acetone were added. The solid which precipitated out was recovered by filtration and then recrystallized twice from water/acetone, 3.86 g (9.21 mmol) of the target Compound B-53 was obtained. Yield: 46%, Melting Point: 191°-192° C. (with decomposition).

SYNTHESIS EXAMPLE 4

Preparation of Compound B-54

12.8 g (50.0 mmol) of acid anhydride of ethylenediaminetetraacetic acid was suspended, with ice cooling, in 40 ml of water, and 10.2 g (110 mmol) of aniline was added slowly in such a way that the internal temperature was maintained within the range of from 5° C. to 10° C. The mixture was agitated for 30 minutes while continuing the ice cooling, and then it was agitated for a further period of 1 hour at room temperature. The solid which precipitated out was recovered by filtration and recrystallized from methanol, whereupon 15.9 g (36.0 mmol) of the target Compound B-54 was obtained. Yield: 72%, Melting Point: 159°-161° C.

SYNTHESIS EXAMPLE 5

Preparation of Compound B-58

5.12 g (20.0 mmol) of acid anhydride of ethylenediaminetetraacetic acid and 6.2 g (82.6 mmol) of glycine were suspended, with ice cooling, in 20 ml of water, and after agitating the mixture for 6 hours, 8.37 g (82.6 mmol) of 36 wt % hydrochloric acid was added to the mixture. The reaction mixture was then concentrated under reduced pressure to about 20 ml, after which 40 ml of acetone was added. The solid which precipitated out was recovered by filtration and recrystallized from water/acetone, whereupon 3.40 g (7.10 mmol) of the target Compound B-58 was obtained. Yield: 36%, Melting Point: 204°-206° C. (with decomposition).

SYNTHESIS EXAMPLE 6

Preparation of Compound B-73

3.77 g (42.8 mmol) of N,N-dimethylethylenediamine was dissolved in 100 ml of acetonitrile with ice cooling, and then 5.27 g (2.06 mmol) of acid anhydride of ethylenediaminetetraacetic acid was added thereto in such a way that the internal temperature was maintained within the range of from 5° to 10° C. After the mixture was agitated for a further period of 30 minutes at room temperature, the crystal which precipitated out was recovered by filtration, whereupon 7.04 g (16.3 mmol)

of the target Compound B-73 was obtained. Yield: 79%, Melting Point: 170°-173° C. (with decomposition).

SYNTHESIS EXAMPLE 7

Preparation of Compound B-74

6.34 g (22.3 mmol) of acid anhydride of 1,4-butanediaminetetraacetic acid (see French Patent 1,548,888 for a method of preparation) was added to 24.7 g (318 mmol) of a 40 wt % aqueous methylamine solution in such a way that the internal temperature was maintained within the range of from −8° to +1° C. with ice cooling, and then agitated for 2 hours. After the methylamine of solvent was removed by reflux under reduced pressure, 4.46 ml of a 5 N sodium hydroxide solution was added to the mixture and then the solvent was further removed. The pH of the mixture was adjusted to 7 using a concentrated hydrochloric acid, and then the solvent was perfectly removed by reflux. Next, after 20 ml of a concentrated hydrochloric acid was added to the mixture, the formed salt was removed by filtration. On the other hand, acetonitrile was added to the filtrate and then agitated. The crystal which precipitated out was recovered by filtration, whereupon 7.62 g (16.7 mmol) of the target Compound B-74 was obtained. Yield: 75%, Melting Point: 117°-120° C. (with decomposition).

SYNTHESIS EXAMPLE 8

Preparation of Compound B-75

14.77 g (85.3 mmol) of o-anilinesulfonic acid was dissolved in 80 ml of water and further 4.51 g (85.3 mmol) of sodium carbonate was added to the mixture. Further, 9.93 g (38.8 mmol) of acid anhydride of ethylenediaminetetraacetic acid was added to the mixture in such a way that the internal temperature was maintained within the range of from −5° to +4° C. with ice cooling, and then agitated for 4 hours at room temperature. After the obtained mixture was concentrated, the concentrated hydrochloric acid was gradually added to the concentrated mixture until a white suspension occurred while agitating. After the suspension was agitated for a further period of 30 minutes, the crystal which precipitated out was recovered by filtration, whereupon 19.75 g (31.8 mmol) of the target Compound B-75 was obtained. Yield: 82%, Melting Point: 215°-220° C. (with decomposition).

SYNTHESIS EXAMPLES 9

Preparation of Compound B-76

36.8 g (0.103 mol) of acid anhydride of N''-carboxymethyldiethylenetriamine-N,N,N',N'-tetracarboxylic acid (see French Patent 1,548,888 for a method of preparation) was slowly added, with ice cooling, to 134 g (2.28 mol) of 29 wt % aqueous ammonia in such a way as to maintain the internal temperature within the range of from 5° to 7° C. The mixture was agitated for 1 hour while continuing the ice cooling. The obtained reaction mixture was displaced to the eggplant type flask and after ammonia was removed by reflux under reduced pressure, at 35° C., the reaction mixture was cooled to room temperature and the pH of the mixture was adjusted to 2 by using 36% hydrochloric acid. Further, the adjusted reaction mixture was concentrated under reduced pressure to obtain about 50 ml of the concentrated reaction mixture. After 100 ml of ethanol was added to the concentrated reaction mixture, the precipitate having a glass state was recovered by filtration and then agitated in 200 ml of acetone. The formed solid was recovered by filtration and dried under reduced pressure, whereupon 16.3 g of the target Compound B-76 was obtained. Yield: 40%.

SYNTHESIS EXAMPLE 10

Preparation of Compound B-77

6.38 g (51.0 mmol) of 2-aminoethanesulfonic acid was dissolved in 50 ml of water and further 5.45 g (51.0 mmol) of sodium carbonate was added to the mixture. Further, 5.93 g (23.1 mmol) of acid anhydride of ethylenediaminetetraacetic acid was added thereto and then agitated for 4 hours. After the obtained mixture was concentrated, the concentrated hydrochloric acid was added to the concentrated mixture. The formed salt was removed by filtration. On the other hand, methanol was added to the filtrate, and the crystal which precipitated out was recovered by filtration and then recrystallized from water/methanol, whereupon 4.90 g (7.86 mmol) of the target Compound B-77 was obtained. Yield: 34%, Melting Point: 235°-238° C. (with decomposition).

SYNTHESIS EXAMPLE 11

Preparation of Compound B-78

7.13 g (78.2 mmol) of 2-methylthioethylamine was dissolved in 300 ml of acetonitrile at room temperature, and then 9.1 g (35.5 mmol) of acid anhydride of ethylenediaminetetraacetic acid was added thereto. The mixture was agitated for 1 hour. After the mixture was allowed to stand overnight, the crystal which precipitated out was recovered by filtration, whereupon 12.1 g (27.6 mmol) of the target Compound B-78 was obtained. Yield: 78%, Melting Point: 147°-150° C. (with decomposition).

SYNTHESIS EXAMPLE 12

Preparation of Compound B-64

4.65 g (15.0 mmol) of acid anhydride of (±)trans-1,2-diaminocyclohexanetetraacetic acid (see French Patent 1,548,888 for a method of preparation) was added to 10.0 g (170 mmol) of 29 wt % ammonia water and 20 ml of water in such a way that the internal temperature was maintained within the range of from −5° to +2° C. with ice cooling, and then agitated for 1 hour. After the obtained mixture was concentrated, 10 ml of the concentrated hydrochloric acid was added to the concentrated mixture. The crystal which precipitated out was recovered by filtration, whereupon 3.67 g (8.10 mmol) of the target Compound B-75 was obtained. Yield: 54% (as a dihydrochloric acid salt and a dihydrate thereof), Melting Point: 147°-150° C. (with decomposition).

SYNTHESIS EXAMPLE 13

Preparation of Compound B-56

11.5 g (44.9 mmol) of acid anhydride of ethylenediaminetetraacetic acid was suspended to 100 ml of acetonitrile in such a way that the internal temperature was maintained within the range of from 0 to 10° C. with ice cooling, and further 8.6 g (98.7 mmol) of morpholine and 20 ml of acetonitrile was added dropwise to the obtained mixture. After being agitated for 2 hours, the crystal which precipitated out was recovered by filtration and then recrystallized from methanol, whereupon 8.16 g (19.0 mmol) of the target Compound B-56 was obtained. Yield: 42%, Melting Point: 200°-202° C. (with decomposition).

SYNTHESIS EXAMPLE 14

Preparation of Compound B-59

16.63 g (61.5 mmol) of acid anhydride of 1,3-propanediaminetetraacetic acid (see French Patent 1,548,888 for a method of preparation) was added to 7.61 g of 29 wt % ammonia water and 20 ml of water in such a way that the internal temperature was maintained within the range of from −10° to +5° C. with ice cooling, and then agitated for 1 hour. After the obtained mixture was concentrated under reduced pressure, 25 g of the concentrated hydrochloric acid was added to the concentrated mixture. The crystal which precipitated out was recovered by filtration, whereupon 17.7 g (42.9 mmol) of the target Compound B-59 was obtained. Yield: 70% (as a dihydrochloric acid salt and a dihydrate thereof), Melting Point: 144°-147° C. (with decomposition).

SYNTHESIS EXAMPLE 15

Preparation of Compound B-60

8.29 g (30.6 mmol) of acid anhydride of 1,3-propanediaminetetraacetic acid was added to 9.67 g (125 mmol) of 40 wt % methylamine and 10 ml of water in such a way that the internal temperature was maintained within the range of from −1° to +5° C. with ice cooling, and then agitated for 1.5 hours. 11.12 ml (50.6 mmol) of a 5N sodium hydroxide solution was added to the mixture, and then ammonia was removed by reflux under reduced pressure. The pH of the obtained mixture was adjusted to 2 by the concentrated hydrochloric acid. After being concentrated under reduced pressure, the formed salt was removed by filtration. On the other hand, the concentrated hydrochloric acid was added to the filtrate and the crystal which precipitated out was recovered by filtration. 5.88 g (17.7 mmol) of the target Compound B-60 was obtained. Yield: 58% (as a dihydrochloric acid salt), Melting Point: 90°-92° C.

SYNTHESIS EXAMPLE 16

Preparation of Compound B-66

8.53 g (30.0 mmol) of acid anhydride of 1,4-butanediaminetetraacetic acid was added to 22.98 g (391 mmol) of 29 wt % ammonia water in such a way that the internal temperature was maintained within the range of from −10° C. to 0° C. with ice cooling, and then agitated for 1 hour. After ammonia was removed by reflux under reduced pressure, the pH of the obtained mixture was adjusted to 6 by the concentrated hydrochloric acid and then the mixture was agitated. The crystal which precipitated out was recovered by filtration. 30 g (8.47 mmol) of the target Compound B-66 was obtained. Yield: 28% (as a dibasic acid salt and a hydrate thereof), Melting Point: 158°-159° C.

The other compounds of the present invention can be prepared with the above synthesis methods.

The metal salts from which the metal chelate compounds of the present invention are constituted are selected from those of Fe(III), Mn(III), Co(III), Rh(II), Rh(III), Au(II), Au(III) and Ce(IV). Among these, Fe(III), Mn(III) and Ce(IV) are preferred, and Fe(III) is especially preferred.

The metal chelate compounds of the present invention which can be isolated as metal chelate compounds may be used.

Representative examples of the compounds are shown below, but it should be understood that the present invention is not limited by these examples. It is preferred that compounds represented by formula (I) and/or formula (II) and complex of the metal salt coexist.

B-51C

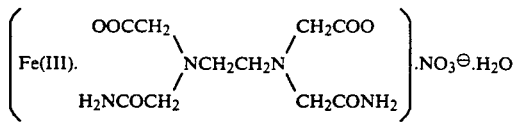

B-52C

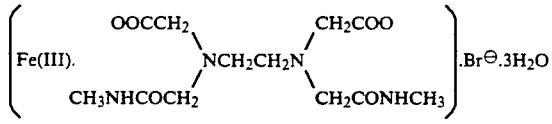

Examples of the preparation of metal chelate compound salts of the present invention are described below.

SYNTHESIS EXAMPLE 17

Preparation of Compound B-51C 300 ml of water was added to 36.3 g (100 mmol) of Compound B-51 in a beaker and then agitated. The obtained solution was filtered off and displaced to the beaker. The pH of the solution (i.e., the filtrate) was adjusted to 3.6 to 4.0 by adding 29% aqueous ammonia. The formed precipitate was recovered by filtration and then dried under reduced pressure. 3 ml of water and 6.9 ml (34.4 mmol) of 5N sodium hydroxide solution were added to 5.0 g (17.2 mmol) of the recovered precipitate in the beaker, and then agitated.

Separately, 6.95 g (17.2 mmol) of iron(III) nitrate/9 hydrate was dissolved in 5 ml of water. The obtained iron(III) nitrate solution was added to the previously prepared solution of the recovered precipitate and then agitated for 15 minutes. The mixed solution was filtered off and the obtained filtrate was allowed to stand for 1 week on a petri dish. The formed crystal was recovered by filtration and further recrystallized twice from water to obtain the target Compound B-51C.

| | Elemental Analysis: | | |
|---|---|---|---|
| | H | C | N |
| Calcd. | 4.29 | 28.39 | 16.55 |
| Found | 4.10 | 28.22 | 16.53 |

Melting Point: 203-205° C. (with decomposition)

SYNTHESIS EXAMPLE 18

Preparation of Compound B-52C 5 ml of water, 0.33 g (4 mmol) of sodium acetate and 1.57 g (16 mmol) of ammoniumbromide were added to 5.0 g (12.8 mmol) of Compound B-52 in a beaker and then agitated. Separately, 5.16 g (12.8 mmol) of iron(III) nitrate/9 hydrate was dissolved in 5 ml of water and then agitated. The obtained iron(III) nitrate solution was added to the previously prepared solution of Compound B-52 and then agitated for 15 minutes. The pH of the mixed solution was adjusted to 3.4 by using 29 wt % aqueous ammonia. The adjusted solution was filtered off and the obtained filtrate was allowed to stand for 1 week on a petri dish. The formed crystal was recovered by filtration and further recrystallized twice from water to obtain the target Compound B-52C.

| | Elemental Analysis: | | | |
|---|---|---|---|---|
| | H | C | N | Br |
| Calcd. | 5.38 | 27.50 | 10.69 | 15.25 |
| Found | 5.21 | 27.56 | 10.49 | 14.98 |

Melting Point: 195°-198° C. (with decomposition)

Compounds represented by at least one of formulae (I) and (II) and the aforementioned metal salts (for example, ferric sulfate, ferric chloride, ferric nitrate, ferric ammonium sulfate or ferric phosphate) may be reacted in solution for use. The compounds represented by at least one of formulae (I) and (II) are generally used in the mol ratio of at least 1.0 with respect to the metal ion. A larger value for the mol ratio is preferred in cases where the stability of the metal chelate compound is low, and the compounds are used in general in such a way that the value of the mol ratio is from 1 to 30 (preferably from 1 to 10 and more preferably from 1 to 3).

The metal chelate compounds of the present invention are effective as bleaching agents in bleaching or bleach-fixing solutions when contained in amounts of from 0.05 to 1 mol per liter of the processing solution. Furthermore, a small amount may be contained in the fixer or in an intermediate bath between the color development and desilvering processes.

The metal chelate compounds of the present invention are effective when contained in a processing solution which has a bleaching ability in amounts of from 0.05 to 1 mol per liter of the processing solution, particularly the amount of from 0.1 to 0.5 mol per liter of the processing solution is preferred.

Other bleaching agents may be used conjointly in a processing solution which has a bleaching ability in the present invention within the range such that the effect of the present invention can be realized. Such bleaching agents include, for example, the Fe(III), Co(III) or Mn(III) chelate-based bleaching agents indicated below, peroxydisulfate, hydrogen peroxide and bromate.

Compounds with which the above mentioned chelate-based bleaching agents are formed include, but are not limited to for example, ethylenediaminetetraacetic acid, ethylenediaminetetraacetic acid disodium salt, ethylenediaminetetraacetic acid diammonium salt, ethylenediaminetetraacetic acid tetra(trimethylammonium) salt, ethylenediaminetetraacetic acid tetrapotassium salt, ethylenediaminetetraacetic acid tetrasodium salt, ethylenediaminetetraacetic acid trisodium salt, diethylenetriaminepentaacetic acid, diethylenetriaminepentaacetic acid pentasodium salt, ethylenediamine-N-(β-oxyethyl)-N,N',N'-triacetic acid, ethylenediamine-N-(βoxyethyl)-N,N',N'-triacetic acid trisodium salt, ethylenediamine-N-(β-oxyethyl)-N,N',N'-triacetic acid triammonium salt, 1,2-diaminopropanetetraacetic acid, 1,2-diaminopropanetetraacetic acid disodium salt, 1,3-diaminopropanetetraacetic acid, 1,3-diaminopropanetetraacetic acid diammonium salt, nitrilotriacetic acid, nitrilotriacetic acid trisodium salt, cyclohexanediaminetetraacetic acid, cyclohexanediaminetetraacetic acid disodium salt, iminodiacetic acid, dihydroxyethylglycine, ethyl ether diaminetetraacetic acid, glycol ether diaminetetraacetic acid, ethylenediaminetetrapropionic acid, phenylenediaminetetraacetic acid, 1,3-diaminopropanol-N,N,N',N'-tetramethylenephosphonic acid, ethylenediamine-N,N,N',N'-tetramethylenephosphonic acid and 1,3-propylenediamine-N,N,N',N'-tetramethylenephosphonic acid.

The standard electron migration rate constant $k_s$ is described in detail below.

The standard electron migration rate constant $k_s$ indicates the rate when a compound which generally undergoes a redox reaction exchanges an electron with an electrode which has been established at the standard redox potential of the compound. In the present invention, it has been discovered that rapid processing with little bleach fogging, little staining after processing and excellent desilvering characteristics can be achieved when a compound of which the electron migration rate constant $k_s$ measured in a gelatin film is at least $8\times10^{-4}$ cm/s, preferably from $1\times10^{-3}$ cm/s to $5\times10^{-2}$ cm/s, is used. The compound having a standard electron migration rate constant $k_s$ in a gelatin film of at least $8\times10^{-4}$ can be used in amounts of preferably from 0.05 to 1 mol and particularly preferably from 0.1 to 0.5 mol, per liter of processing solution as the same as the metal chelate compounds of the present invention. The method of obtaining $k_s$ is described below.

The standard electron migration rate constant $k_s$ is obtained using the normal pulse voltametry (referred to hereinafter as NPV) method, which is widely used in general. NPV is a method of electrochemical measurement in which a pulse potential is applied to an electrode which is immersed in a solution which contains the compound which is being monitored, and the change with time in the current value obtained is observed. The method of obtaining the standard electron migration rate constant $k_s$ from the current value obtained has been outlined in *New Edition Electrochemical Measurement Methods*, page 40 (Electrochemical Society, 1988).

In the present invention, the important point when measuring $k_s$ is that the measurement is made in gelatin. The electrode which is used for making the measurements must therefore have its surface pre-covered with a gelatin film. The actual measuring conditions are set as indicated below.

| | |
|---|---|
| Sample Concentration | 100 mmol/liter |
| Measuring solution | 1M $KNO_3$ |
| | 0.2M Acetic acid buffer |
| PH | 5.0 |
| Temperature | 25° C. |
| Electrode | Gelatin-covered glassy carbon |

Here, the conditioning of the gelatin-covered glassy carbon electrode is carried out by dissolving 24.4 g of gelatin, 30 mg of Compound 1 and 10 mg of Compound 2 in 1 liter of water, introducing 10 μl of the resulting solution with a microsyringe onto a commercial glassy carbon electrode (diameter: 6 mm, manufactured by Nichiatsu Keisoku K.K.) and drying for 24 hours.

$CH_2{=}CHSO_2CH_2CONHCH_2CH_2NHCOCH_2SO_2CH{=}CH_2$ Compound 1

$CH_2{=}CHSO_2CH_2CONHCH_2CH_2CH_2NHCOCH_2SO_2CH{=}CH_2$ Compound 2

Of the compounds which are satisfactory in regard to $k_s$ as mentioned above, the metal chelate compounds formed from aminopolycarboxylic acids and metal salts of metals selected from the group consisting of Fe(III), Co(III), Mn(III),.Rh(II), Rh(III), Au(III), Au(II) and Ce(IV) are preferred, and the metal chelate compounds formed from compounds which can be represented by at least one of the aforementioned formula (I) and the aforementioned formula (II) and the salts of metals selected from Fe(III), Co(III), Mn(III), Rh(II), Rh(III), Au(III), Au(II) and Ce(IV) are most preferred.

Furthermore, from the viewpoint of preventing bleach fogging, the redox potential is preferably from 0 mV to +500 mV (with respect to a normal hydrogen electrode (NHE)), and it is more preferably from 0 mV to 400 mV (with respect to a NHE).

Illustrative compounds of the present invention and the standard electron migration rate constants in a gelatin film of the ferric complex salts are indicated below.

Illustrative compounds of the present invention and their $k_s$ values are indicated below. (Now, compounds represented by "B-" corresponds to compounds represented by formulae (I) and (II).)

| Compound | $k_s$ (cm/sec) |
|---|---|
| B-22 | $3.9 \times 10^{-3}$ |
| B-23 | $1.8 \times 10^{-3}$ |
| B-25 | $9.5 \times 10^{-4}$ |
| B-26 | $1.9 \times 10^{-3}$ |
| B-27 | $1.2 \times 10^{-3}$ |
| B-28 | $1.7 \times 10^{-3}$ |
| B-29 | $1.7 \times 10^{-3}$ |
| B-30 | $1.9 \times 10^{-3}$ |
| B-32 | $2.9 \times 10^{-3}$ |
| B-41 | $2.1 \times 10^{-3}$ |
| B-42 | $1.2 \times 10^{-3}$ |
| B-43 | $1.8 \times 10^{-3}$ |
| B-49 | $9.2 \times 10^{-4}$ |
| B-50 | $1.5 \times 10^{-3}$ |
| B-51 | $1.9 \times 10^{-3}$ |
| B-52 | $1.4 \times 10^{-3}$ |
| B-53 | $1.0 \times 10^{-3}$ |
| B-56 | $3.9 \times 10^{-3}$ |
| B-59 | $2.0 \times 10^{-3}$ |
| B-60 | $1.6 \times 10^{-3}$ |
| B-61 | $1.2 \times 10^{-3}$ |
| B-62 | $1.5 \times 10^{-3}$ |
| B-63 | $1.3 \times 10^{-3}$ |
| B-64 | $9.7 \times 10^{-4}$ |
| B-65 | $8.3 \times 10^{-4}$ |

The processing solution which has a bleaching ability according to the present invention further can preferably contain an organic acid in addition to the compounds as described above.

Examples of the organic acid which can be used in the present invention include formic acid, acetic acid, propionic acid, glycolic acid, monochloroacetic acid, monobromoacetic acid, monochloropropionic acid, lactic acid, pyruvic acid, allylic acid, butyric acid, isobutyric acid, pivalic acid, aminobutyric acid, valeric acid, isovaleric acid, benzoic acid, chloro or hydroxy mono-substituted benzoic acid, monobasic acid of nicotinic acid, amino acid compounds such as asparagine, aspartic acid, alanine, arginine, ethionine, glycine, glutamine, cystine, serine, methionine and leucine; dibasic acids such as oxalic acid, malonic acid, succinic acid, glutaric acid, tartaric acid, malic acid, oxaloacetic acid, phthalic acid, isophthalic acid and terephthalic acid; tribasic acids such as citric acid; sulfonic acids, sulfinic acids, imides, and aromatic sulfonamide, but the organic acid is not limited by these examples.

In the present invention, among the above organic acids, the organic acids having a pKa of preferably from 1.5 to 6.5 and more preferably from 2.0 to 5.5 are preferably used. Among the above organic acids having the above pKa, monobasic acid is preferably used and acetic acid and/or glycolic acid are particularly preferably used.

In the present invention, the amount of the organic acid used is preferably 0.05 mol or more, more preferably from 0.1 to 3.0 mol, and most preferably from 0.3 to 2.0 mol, per liter of the processing solution having a bleaching ability and the replenisher thereof.

Also, in the present invention, two kinds or more of the above organic acids may be used in combination. Further, the salt of the above organic acids and an inorganic acid may be simultaneously used in place of the above organic acids.

The processing solutions which have a bleaching ability in accordance with the present invention preferably contain, in addition to the bleaching agents, halides such as chloride, bromide or iodide as rehalogenating agents for accelerating the oxidation of the silver. The amount of rehalogenating agent is from 0.1 to 2 mol/liter, and preferably from 0.3 to 1.5 mol/ liter. Furthermore, organic ligands which form sparingly soluble silver salts may be added instead of halides. The halide can be added, for example, in the form of alkali metal salts or ammonium salts, or in the form of salts of guanidine and amines. In practical terms, sodium bromide, ammonium bromide, potassium chloride and guanidine hydrochloride can be used, and the use of ammonium bromide is preferred.

Bleach-fixing solutions in accordance with the present invention contain a fixing agent as described hereinafter in addition to the bleaching agents, and they can also contain the aforementioned rehalogenating agents. The amount of bleaching agent in a bleach-fixing solution is the same as that in the case of a bleaching solution. Furthermore, the amount of rehalogenating agent is from 0 to 2.0 mol/liter, and preferably from 0.01 to 1.0 mol/liter.

The bleaching solution and the bleach-fixing solution may further contain bleaching accelerators, corrosion inhibitors for preventing corrosion of processing vessels, buffer for maintaining a pH of processing solutions, brightening agents and defoaming agents, if desired.

The compounds which have a mercapto group or a disulfide group disclosed in U.S. Pat. No. 3,893,858, German Patent 1,290,812, U.S. Pat. No. 1,138,842, JP-A-53-95630 and *Research Disclosure*, No. 17129 (1978); the thiazolidine derivatives disclosed in JP-A-50-140129; the thiourea derivatives disclosed in U.S. Pat. No. 3,706,561; the polyethylene oxides disclosed in German Patent 2,748,430; the polyamine compounds disclosed is JP-B-45-8836 and the imidazole compounds disclosed in JP-A-49-40493, for example, can be used as bleaching accelerators (the term "JP-B" as used herein refers to an "examined Japanese patent publication"). Among these compounds, the mercapto compounds disclosed in U.S. Pat. No. 1,138,842 are preferred.

The use of nitrates as corrosion inhibitors is desirable. For example, ammonium nitrate and potassium nitrate can be used. The amount added is generally from 0.05 to 0.5 mol/liter, preferably from 0.01 to 2.0 mol/liter, and more preferably from 0.05 to 0.5 mol/liter.

The pH of the bleaching or bleach-fixing solution in the present invention is generally from 2 to 8, and preferably from 3 to 7.5. The use of a bleaching or bleach-fixing solution of pH not more than 6, and preferably not more than 5.5, is preferred in cases where bleaching or bleach fixing is carried out immediately after color development, with a view to preventing the occurrence of bleach fogging. Furthermore, the metal chelates of the present invention become unstable at pH values of less than 2, so a pH of from 2 to 5.5 is preferred.

Organic acids and alkali chemicals (for example, aqueous ammonia, KOH, NaOH, imidazole, monoethanolamine, diethanolamine) can be used conjointly to adjust the pH of the processing solution which has a bleaching ability within the aforementioned range.

During processing, it is desirable for the processing solution which has a bleaching ability to be aerated with an oxidation product of the iron(II) complex salt which is formed. The bleaching agent is regenerated in this way, and photographic performance can be maintained in a very stable manner.

The bleaching or bleach-fixing process is carried out at a temperature of generally from 30° C. to 50° C., and preferably at a temperature of from 35° C. to 45° C. The bleaching process time used is within the range of generally from 10 seconds to 5 minutes with a photosensitive material for photography, but it is preferably within the range of from 10 seconds to 60 seconds and particularly from 10 seconds to 30 seconds, while with a print type photosensitive material, the bleaching process time is generally from 5 seconds to 70 seconds, and preferably from 5 seconds to 30 seconds. Rapid processing without increased staining has been achieved under these preferred conditions.

Known fixing agents can be used in the fixer (fixing solution) or bleach-fixer (bleach-fixing solution). These fixing agents include, for example, thiosulfates, thiocyanates, thioethers, amines, mercapto compounds, thiones, thioureas and iodides, and representative examples include ammonium thiosulfate, sodium thiosulfate, potassium thiosulfate, guanidine thiosulfate, potassium thiocyanate, dihydroxyethyl thioether, 3,6-dithia-1,8-octanediol and imidazole. Among these, thiosulfates, and especially ammonium thiosulfate, are preferred from the viewpoint of rapid fixing. Moreover, two or more types of fixing agent can be used conjointly, and even more rapid fixing can be achieved in this way. For example, the conjoint use of, for example, the aforementioned ammonium thiocyanate, imidazole, thiourea or thioether with ammonium thiosulfate is desirable, and in this case the second fixing agent is preferably added in an amount of from 0.01 to 100 mol% with respect to the ammonium thiosulfate.

The amount of fixer used is generally from 0.1 to 3 mol, and preferably from 0.5 to 2 mol, per liter of fixer or bleach-fixer. The pH of the fixer depends on the type of fixing agent, but, in general, it is from 3 to 9. When thiosulfate is used in particular, a stable fixing performance is obtained in the pH range of from 6.5 to 8, and this is preferred.

Preservatives can be added to the fixer and/or bleach-fixer, and it is possible to increase the storage stability of the liquid in this way. In the case of fixers and bleach-fixers which contain thiosulfate, sulfite and/or hydroxylamine, hydrazine and bisulfite addition compounds of aldehydes (for example, the bisulfite addition compounds of acetaldehyde, and especially the bisulfite addition compounds of aromatic aldehydes disclosed in JP-A-1-298935) are effective as preservatives. Furthermore, use of the sulfinic acid compounds disclosed in JP-A-60-283881 is desirable.

Furthermore, the addition of buffers to the fixers and/or bleach-fixers is desirable for maintaining the pH of the liquid at a constant value. Examples of buffers include phosphates, imidazoles such as imidazole, 1-methylimidazole, 2-methylimidazole and 1-ethylimidazole; triethanolamine, N-allylmorpholine and N-benzoylpiperazine. Moreover, the iron ions which are carried over from the bleaching bath can be sequestered and the stability of the solution can be improved by adding various chelating agents to a fixer. Examples of preferred chelating agents of this type are indicated below.

(1) 1-Hydroxyethylidene-1,1-diphosphonic acid
(2) Ethylenediamine-N,N,N',N'-tetramethylenephosphonic acid
(3) Nitrilotrimethylenephosphonic acid
(4) Ethylenediaminetetraacetic acid
(5) Diethylenetriaminepentaacetic acid
(6) Cyclohexanediaminetetraacetic acid
(7) 1,2-Propanediaminetetraacetic acid The fixing process is carried out at a temperature within the range of from 30° C. to 50° C., but it is preferably carried out in the range of from 35° C. to 45° C. The fixing process time is, for a sensitive material for photography, generally from 35 seconds to 2 minutes, and preferably from 40 seconds to 100 seconds, and with a print type sensitive material, it is generally from 10 seconds to 70 seconds and preferably from 10 seconds to 30 seconds.

A desilvering process in the present invention can be carried out with a bleaching process and/or a bleach-fixing process, and typical examples are indicated below.

(1) Bleaching—Fixing
(2) Bleaching—Bleach-Fixing
(3) Bleaching—Water Washing - Fixing
(4) Bleach—Fixing
(5) Fixing - Bleach-Fixing Known primary aromatic amine color developing agents are contained in the color developers used in the color development process in the present invention. The p-phenylenediamine derivatives are preferred, and typical examples of these are indicated below, but it should be understood that the developing agent is not limited by these examples.

| | |
|---|---|
| N,N-Diethyl-p-phenylenediamine | D-1 |
| 2-Amino-5-diethylaminotoluene | D-2 |
| 2-Amino-5-(N-ethyl-N-laurylamino)toluene | D-3 |
| 4-[N-Ethyl-N-(β-hydroxyethyl)amino]aniline | D-4 |
| 2-Methyl-4-[N-ethyl-N-(β-hydroxyethyl)amino]aniline | D-5 |
| 4-Amino-3-methyl-N-ethyl-N-[β-(methanesulfonamido)ethyl]aniline | D-6 |
| N-(2-Amino-5-diethylaminophenylethyl)methanesulfonamide | D-7 |
| N,N-Dimethyl-p-phenylenediamine | D-8 |
| 4-Amino-3-methyl-N-ethyl-N-methoxyethylaniline | D-9 |
| 4-Amino-3-methyl-N-ethyl-N-β-ethoxyethylaniline | D-10 |
| 4-Amino-3-methyl-N-ethyl-N-β-butoxyethylaniline | D-11 |
| 2-Methoxy-4-[N-ethyl-N-(β-hydroxyethyl-)amino]aniline | D-12 |

The use of D-5, D-6 and D-12 among the p-phenylenediamine derivatives indicated above is preferred.

Furthermore, these p-phenylenediamine derivatives may take the form of salts, such as sulfates, hydrochlorides, sulfites or p-toluenesulfonates. Preferably, the amount of primary aromatic amine color developing agent used provides a concentration of preferably from 0.005 to 0.1 mol, and more preferably from about 0.01 to about 0.06 mol, per liter of color developer.

Furthermore, sulfites such as sodium sulfite, potassium sulfite, sodium bisulfite, potassium bisulfite, sodium metabisulfite and potassium metabisulfite, and carbonyl/sulfurous acid adducts, can be added, as required, to the color developer as preservatives.

Furthermore, the addition of various hydroxylamines (for example, the compounds disclosed in JP-A-63-5341 and JP-A-63-106655, among the compounds a sulfo group or a carboxyl group are preferred), the hydroxamic acids disclosed in JP-A-63-43138, the hydrazines and hydrazides disclosed in JP-A-63-146041, the phenols disclosed in JP-A-63-44657 and JP-A-63-58443, the α-hydroxyketones and α-aminoketones disclosed in JP-A-63-44656, and/or the various sugars disclosed in JP-A-63-36244 as compounds which preserve directly the afore-mentioned primary aromatic amine color developing agents is desirable. Furthermore, the conjoint use of the above mentioned compounds with the monoamines disclosed, for example, in JP-A-63-4235, JP-A-63-24254, JP-A-63-21647, JP-A-63-146040, JP-A-63-27814 and JP-A-63-25654, the diamines disclosed, for example, in JP-A-63-30845, JP-A-63-14640 and JP-A-63-43139, the polyamines disclosed, for example, in JP-A-63-21647, JP-A-63-26655 and JP-A-63-44655, the nitroxy radicals disclosed in JP-A-63-53551, the alcohols disclosed in JP-A-63-43140 and JP-A-63-53549, the oximes disclosed, for example, in JP-A-63-56654, and the tertiary amines disclosed in JP-A-63-239447 is desirable.

Other preservatives, such as the various metals disclosed in JP-A-57-44148 and JP-A-57-53749, the salicylic acids disclosed in JP-A-59-180588, the alkanolamines disclosed in JP-A-54-3582, the polyethyleneimines disclosed in JP-A-56-94349, and the aromatic polyhydroxy compounds disclosed in U.S. Pat. No. 3,746,544, can be included, if desired. The addition of aromatic hydroxy compounds is especially desirable.

These preservatives are added in amounts of generally from 0.005 to 0.2 mol, and preferably of from 0.01 to 0.05 mol, per liter of developer.

The color developers (color developing baths) used in the present invention are generally used at a pH in the range of from 9 to 12, and preferably in the range of from 9.5 to 11.5. Other compounds which are known developer components can also be included.

The use of various buffers for maintaining the above mentioned pH values is desirable.

Representative examples of such buffers include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate) and potassium 5-sulfo-2-hydroxybenzoate (potassium 5-sulfosalicylate). However, the present invention is not limited by these compounds.

The amount of buffer added to the color developer is preferably at least 0.1 mol/liter, and particularly preferably from 0.1 to 0.4 mol/liter.

Various chelating agents can also be used in the color developer for preventing the precipitation of calcium and magnesium, or for improving the stability of the color developer.

Organic compounds are preferred for the chelating agents and, for example, aminopolycarboxylic acids, organophosphonic acids and phosphonocarboxylic acids can be used for this purpose. Representative examples include nitrilotriacetic acid, diethylenetriaminepentaacetic acid, ethylenediaminetetraacetic acid, N,N,N-trimethylenephosphonic acid, ethylenediamine-N,N,N',N'-tetramethylenephosphonic acid, trans-cyclohexanediaminetetraacetic acid, 1,2-diaminopropanetetraacetic acid, hydroxyethyliminodiacetic acid, glycol ether diaminetetraacetic acid, ethylenediamine-o-hydroxyphenylacetic acid, 2-phosphonobutane-1,2,4-tricarboxylic acid, 1-hydroxyethylidene-1,1-diphosphonic acid, and N,N'-bis(2-hydroxybenzyl)ethylenediamine-N,N'-diacetic acid. However, the chelating agents are not limited by these examples.

Two or more of these chelating agents may be used conjointly, if desired.

The amount of chelating agent added should be sufficient to chelate the metal ions which are present in the color developer. For example, the chelating agent can be used in amounts of from 0.001 to 0.05 mol, and preferably from 0.003 to 0.02 mol, per liter.

Optional development accelerators can be added to the color developer, if desired.

For example, the thioether compounds disclosed, for example, in JP-B-37-16088, JP-B-37-5987, JP-B-38-826, JP-B-44-12380, JP-B-45-9019 and U.S. Pat. No. 3,813,247; the p-phenylenediamine-based compounds disclosed in JP-A-52-49829 and JP-A-50-15554; the quaternary ammonium salts disclosed, for example, in JP-A-50-137726, JP-B-44-30074, JP-A-56-156826 and JP-A-52-43429; the amine-based compounds disclosed, for example, in U.S. Pat. Nos. 2,494,903, 3,128,182, 4,230,796 and 3,253,919, JP-B-41-11431 and U.S. Pat. Nos. 2,482,546, 2,596,926 and 3,582,346; the polyalkylene oxides disclosed, for example, in JP-B-37-16088, JP-B-42-25201, U.S. Pat. No. 3,128,183, JP-B-41-11431, JP-B-42-23883 and U.S. Pat. No. 3,532,501; or imidazoles such as 2-methylimidazole and imidazole can be added as development accelerators.

Furthermore, the addition of 1-phenyl-3-pyrazolidones as auxiliary developing agents is desirable for achieving rapid development. Examples of such compounds are indicated below.

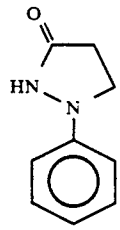

AD-1

-continued

AD-2

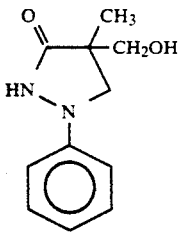

AD-3

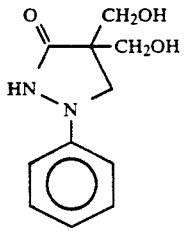

AD-4

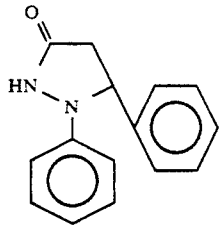

AD-5

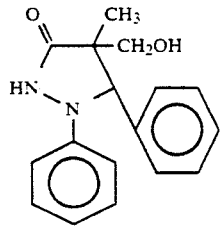

AD-6

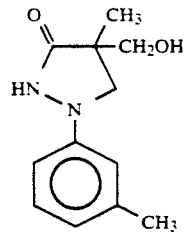

The amount of these auxiliary developing agents added is generally from 0.0005 to 0.03 mol, and preferably from 0.001 to 0.01 mol, per liter of color developer.

Antifoggants can be added optionally, if desired, in the present invention. Alkali metal halides, such as sodium chloride, potassium bromide and potassium iodide, and organic antifoggants can be used as antifoggants. Typical examples of organic antifoggants include nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, indazole, hydroxyazaindolizine and adenine.

Brightening agents may be included in the color developers which are used in the present invention. 4,4'-Diamino-2,2'-disulfostilbene-based compounds are preferred as brightening agents. The amount added is generally from 0 to 5 g/liter, and preferably from 0.1 to g/liter.

Furthermore, various surfactants, such as alkylsulfonic acids, arylsulfonic acids, aliphatic carboxylic acids and aromatic carboxylic acids, may be added, if desired.

The processing temperature in the color developer (color developing solution) in the present invention is generally from 20° C. to 50° C., and preferably from 30° C. to 55° C. The processing time is from 20 seconds to 5 minutes, and preferably from 30 seconds to 3 minutes. A processing time of from 1 minute to 2 minutes 30 seconds is especially preferred.

The method of processing of the present invention can also be used for color reversal processing. The developers known as black-and-white first developers which are generally used for the reversal processing of color photosensitive materials can be used for the black-and-white developer in such a process. The various well known additives which are used in the black-and-white developers used in the processing solutions for black-and-white silver halide photosensitive materials can be included in the black-and-white first developer for a color reversal sensitive material.

Typical additives include developing agents such as 1-phenyl-3-pyrazolidone, metol and hydroquinone; preservatives such as sulfite; accelerators comprising alkalis such as sodium hydroxide, sodium carbonate and potassium carbonate; inorganic or organic restrainers such as potassium bromide or 2-methylbenzimidazole and methylbenzothiazole; hard water softening agents such as polyphosphate; and development inhibitors comprising trace amounts of iodide or mercapto compounds.

The method for processing silver halide color photographic materials comprises fundamentally the aforementioned color development process and the subsequent desilvering process. Moreover, the use of subsequent water washing and/or stabilization processes is preferred.

Various surfactants can be included in the water washing water which is used in the water washing process to prevent water spots on the photosensitive material after drying. Examples of these surfactants include polyethylene glycol-type nonionic surfactants, polyhydric alcohol-type nonionic surfactants, alkylbenzenesulfonate-type anionic surfactants, higher alcohol sulfate ester salt-type anionic surfactants, alkylnaphthalenesulfonate-type anionic surfactants, quaternary ammonium salt-type cationic surfactants, amine salt-type cationic surfactants, amino acid-type amphoteric surfactants and betaine-type amphoteric surfactants, but the use of nonionic surfactants is preferred, since the ionic-type surfactants bond with the various ions which are introduced during processing and form insoluble substances, and the use of alkylphenol ether oxide adducts is especially desirable. Octyl-, nonyl-, dodecyl- and dinonyl-phenol are especially desirable for the alkylphenol, and the addition of from 8 to 14 mol of ethylene oxide is particularly preferred. Moreover, the use of silicon-based surfactants which have a high anti-foaming effect is also desirable.

Furthermore, various biocides and fungicides can be included in the water washing water for inhibiting the occurrence of fur and the formation of fungi in the photosensitive material after processing. These biocides and fungicides include thiazolylbenzimidazole-based compounds such as those disclosed in JP-A-57-157244 and JP-A-58-105145, isothiazolone compounds such as those disclosed in JP-A-54-27424 and JP-A-57-8542, chlorophenol-based compounds such as those typified by trichlorophenol, bromophenol-based compounds, organotin or organozinc compounds, thiocyanic acid or isothiocyanic acid-based compounds, acid amide-based compounds, diazine- and triazine-based compounds, thiourea-based compounds, benzotriazole alkylguanidine compounds, quaternary ammonium salts as typified by benzalkonium chloride, antibiotics as typified by penicillin, and the general purpose biocide disclosed in *J. Antibact. Antifung. Agents,* Vol. 1, No. 5, pages 207 to 223, and these may be used individually, or two or more may be used conjointly.

Furthermore, the various disinfectants disclosed in JP-A-48-83820 can also be used.

Furthermore, the inclusion of various chelating agents is desirable.

The preferred chelating agents include aminopolycarboxylic acids such as ethylenediaminetetraacetic acid and diethylenetriaminepentaacetic acid, organophosphonic acids such as 1-hydroxyethylidene-1,1-diphosphonic acid and ethylenediamine-N,N,N',N'-tetramethylenephosphonic acid, and the hydrolyzates of maleic anhydride polymers disclosed in European Patent Application 345172A1.

Furthermore, the inclusion in the water washing water of the preservatives which can be included in the aforementioned fixers and bleach-fixers is desirable.

Processing solutions which stabilize the dye image are used for the stabilizers which are employed in the stabilization process. For example, liquids which contain organic acids and have a buffering ability of pH 3 to 6, and liquids which contain aldehydes (for example, formalin or glutaraldehyde) can be used. All of the compounds which can be added to the water washing water can also be included in the stabilizer, and ammonium compounds such as ammonium chloride and ammonium sulfate, compounds of metals such as Bi and Al, brightening agents, various dye stabilizers such as the N-methylol compounds disclosed in JP-A-2-153350 and JP-A-2-153348 and U.S. Pat. No. 4,859,574 and the methods of stabilization in which these dye stabilizers are used as disclosed therein, film hardening agents and the alkanolamine disclosed in U.S. Pat. No. 4,786,583, for example, can also be used, if desired.

Furthermore, a multistage countercurrent system is preferred for the water washing process or stabilizing process, and the use of from 2 to 4 stages is desirable. The replenishment rate is generally from 1 to 50 times, preferably from 2 to 30 times, and more preferably from 2 to 15 times, the carry-over from the previous bath per unit area.

The water which is used in these water washing processes or stabilization processes may be city water, but the use of water which has been deionized with an ion exchange resin so that the Ca and Mg concentrations each are not more than 5 mg/liter, and water which has been sterilized with halogens or by means of an ultraviolet biocidal lamp, is preferred.

Furthermore, city water can be used to replenish water lost by evaporation, but use of the deionized water and sterilized water preferably used in the above mentioned water washing process or stabilizing process is preferred.

In the present invention, not only the bleach and bleach-fixer but also the other processing solutions are preferably replenished with a suitable amount of water and replenisher, or with a process replenisher, in order to compensate for the concentration which arises due to evaporation.

Furthermore, by using a method in which the overflow from the water washing process or stabilizing process is introduced into the bath which has a fixing ability and which is an earlier process bath, it is possible to reduce the amount of waste liquid, and this is desirable.

Forced agitation is desirable in processing in accordance with the present invention for the effective realization of the effect of the present invention. Methods of forced agitation include the methods in which a jet of processing fluid is made to impinge on the emulsion surface of the photosensitive material as disclosed in JP-A-62-183460, the method in which the agitation effect is increased by means of a rotating device disclosed in JP-A-62-18346, the methods in which the agitation effect is increased by moving the photosensitive material while the emulsion surface is in contact with a wiper blade or a squeegee roller which has been placed in the bath to produce turbulence at the emulsion surface, and methods in which the circulating flow rate of the processing solution as a whole is increased can be used as methods of forced agitation.

The method of processing of the present invention is preferably carried out using an automatic processor. Methods of transportation in such automatic processors have been disclosed in JP-A-60-191257, JP-A-60-191258 and JP-A-60-191259. Furthermore, a short crossover time between processing tanks in the automatic processor is desirable for carrying out the rapid processing which is the object of the the present invention. Automatic processors which have a crossover time of not more than 10 seconds have been disclosed in JP-A-319038.

When processing is carried out continuously using an automatic processor with the method of processing of the present invention, the addition of replenishers in accordance with the amount of photosensitive material which has been processed is desirable for replenishing the components of the processing solutions which have been consumed by the processing of the sensitive material and to prevent the accumulation of undesirable components which have dissolved out from the photosensitive material in the processing solutions. Furthermore, two or more processing tanks can be used for each processing operation (step), and in this case a countercurrent system in which replenisher is introduced into the previous tank from the following tank is preferred. A cascade of from 2 to 4 stages is especially desirable for the water washing process and the stabilizing process.

The replenishment rate is preferably low, provided that there are no problems with changes in the compositions in the respective processing solutions affecting photographic performance or resulting in the contamination of other solutions.

The color developer replenishment rate is, in the case of a color materials for photography, generally from 100 ml to 1,500 ml, and preferably from 100 ml to 1,000 ml, per square meter of photosensitive material, and in the case of a color print material, it is generally from 20 ml to 500 ml, and preferably from 30 ml to 200 ml, per square meter of photosensitive material.

The bleach replenishment rate is, in the case of a color material for photography, generally from 10 ml to 500 ml, and preferably from 10 ml to 160 ml, per square meter of photosensitive material. In the case of a print material, it is generally from 20 ml to 300 ml, and preferably from 50 ml to 150 ml, per square meter of sensitive material.

The bleach-fixer replenishment rate is, in the case of a sensitive material for photography, generally from 100 ml to 3,000 ml, and preferably from 200 ml to 1,300 ml, per square meter of sensitive material, and in the case of a print material, it is generally from 20 ml to 300 ml, and preferably from 50 ml to 200 ml, per square meter of sensitive material. Replenishment of a bleach-fixer can be carried out using a single solution, or the bleach-fixer may be replenished separately in regard to the bleach composition and the fixer composition, and the overflow from a bleach bath and/or a fixer bath, mixed together, can be as used as a replenisher for a bleach-fixing bath.

The replenishment rate for a fixer is, in the case of a material for photography, generally from 300 ml to 3,000 ml, and preferably from 300 ml to 1,000 ml, per square meter of photosensitive material, and in the case of a print material, it is generally from 20 ml to 300 ml, and preferably from 50 ml to 200 ml, per square meter of photosensitive material.

The replenishment rate of the water washing water or stabilizer is generally from 1 to 50 times, preferably from 2 to 30 times, and more desirably from 2 to 15 times, the carry-over from the previous bath per unit area.

The use in combination of various methods of regeneration is desirable for further reducing the aforementioned replenishment rate for the purpose of environmental protection. Regeneration may be carried out while the processing solution is being circulated in the automatic processor, or processing solution may be removed temporarily from the processing tank and subjected to an appropriate regeneration treatment, after which it can be returned to the processing tank as a replenisher.

Regeneration of the developer can be carried out by removing the accumulated materials by means of, for example, an ion exchange treatment with an anion exchange resin or an electro-dialysis treatment, and/or by the addition of reagents known as regenerating agents. The extent of regeneration is preferably at least 50%, and more preferably at least 70%. Commercial anion exchange resins can be used, but the use of the highly selective ion exchange resins disclosed in JP-A-63-11005 is preferred.

The metal chelate compounds of the present invention in the bleach or bleach-fixer attain a reduced state as a result of the bleaching process. If the metal chelates accumulate in this reduced form, not only is the bleaching performance reduced but, depending on the case, the dye image may be formed with leuco dyes, and this results in a reduction of the image density. Consequently, the bleach and/or bleach-fixer is preferably subjected to continuous regeneration while processing is in progress. In practice, regeneration of the reduced form of the metal chelate compounds with oxygen by blowing air into the bleach (bleaching solution) and/or bleach-fixer (bleach-fixing solution) by means of an air pump is desirable. Alternatively, regeneration can be achieved by adding oxidizing agents such as hydrogen peroxide, persulfate or bromate.

Regeneration of fixer and bleach-fixer is carried out by the electrolytic reduction of the accumulated silver ions. On the other hand, the accumulated halogen ions can be removed using an anion exchange resin, and this is desirable for maintaining fixing performance.

Ion exchange or ultrafiltration are used to reduce the amount of water washing water used, and the use of ultrafiltration is especially desirable.

Photosensitive materials which are suitable for processing in accordance with the present invention should have, on a support, at least one blue-sensitive silver halide emulsion layer, at least one green-sensitive silver halide emulsion layer and at least one red-sensitive silver halide emulsion layer, but no particular limitation is required for the number or order of the silver halide emulsion layers and insensitive layers. In a multilayer silver halide color photographic material, the unit photosensitive layers are generally in the order, from the support side, of red-sensitive layer, green-sensitive layer, and blue-sensitive layer, but the above mentioned order may be reversed, according to the intended purpose, or a layer which has a different color sensitivity may be sandwiched between layers which have the same color sensitivity.

Insensitive layers such as intermediate layers may be placed between the above mentioned silver halide photosensitive layers and as uppermost and lowermost layers.

In the present invention, the dry film thickness of all the structural layers except the support of the color photosensitive material, the subbing layer on the support and the backing layers is preferably from 10.0 μm to 20.0 μm from the viewpoint of realizing the objects of the present invention. Particularly preferably, this dry film thickness is not more than 18.0 μm.

The film thickness is specified because of the color developing agent take-up by these layers of a color photosensitive material during and after development and because of the considerable effect due to the amount of residual color developing agent on bleach fogging and on the staining which occurs during image storage after processing. In particular, the occurrence of bleach fogging and staining is due to the fact that the increase in magenta coloration, which is thought to be linked to the green-sensitive color layer, is greater than the increase in the cyan and yellow colorations.

The film thickness of the multilayer color photosensitive material in the present invention is measured using the method indicated below.

The sensitive material which is to be measured is stored after preparation for 7 days under conditions of 25° C., 50% RH. First, the total thickness of the sensitive material is measured, and then the thickness is measured again after removing the coated layers from the support. The difference is taken to be the total film thickness of the coated layers except for the support of the aforementioned sensitive material. This thickness can be measured using, for example, a film thickness gauge of the contact type with a voltage conversion element (Anritus Electric Co. Ltd., K-402B Stand.). Moreover, the removal of the coated layer on the support can be achieved using an aqueous solution of sodium hypochlorite.

Next, a cross sectional photograph of the above mentioned sensitive material is taken using a scanning electron microscope (magnification preferably at least 3,000 times), the total thickness and the thickness of each layer on the support are measured, and the thickness of each layer can then be calculated as a proportion of the measured value of the total thickness obtained before-hand with the film thickness gauge (the absolute value of the thickness as measured).

The swelling factor [((Equilibrium swelled film thickness in water at 25° C.—Total dry film thickness at 25° C., 55% RH)/Total dry film thickness at 25° C., 55% RH)×100] of the sensitive material in the present invention is preferably from 50 to 200%, and more preferably from 70 to 150%. If the swelling factor is outside the range of the numerical values indicated above, the amount of residual color developing agent increases, and there is an adverse effect on image quality, photographic performance and desilvering properties, and on the physical properties of the film, such as film strength.

Moreover, the film swelling rate $T_{\frac{1}{2}}$ in a sensitive material in the present invention is defined as the time taken for the film thickness to reach half of the film thickness observed when 90% of the maximum swelled film thickness which is reached in a color developer (38° C., 3 minutes 15 seconds) is taken to be the saturation film thickness, and $T_{\frac{1}{2}}$ is preferably not more than 15 seconds, and more preferably not more than 9 seconds.

The silver halide contained in the photographic emulsion layers of a color photosensitive material with which the present invention is employed may have any silver halide composition. That is to say, it may be silver chloride, silver bromide, silver chlorobromide, silver iodobromide, silver iodochloride or silver iodochlorobromide.

Silver halide photographic emulsions which can be used in the present invention can be prepared, for example, using the methods disclosed in *Research Disclosure (RD)*, No. 17643 (December, 1978), pages 22 and 23, "I. Emulsion Preparation and Types", *Research Disclosure*, No. 18716 (November, 1979), page 648, P. Glafkides, *Chimie et Physique Photographique* (Paul Montel, 1967), G. F. Duffin, *Photographic Emulsion Chemistry* (Focal Press, 1966), V. L. Zelikman et al., *Making and Coating Photographic Emulsions* (Focal Press, 1964), U.S. Pat. Nos. 3,574,628 and 3,655,394, British Patent 1,413,748, Gutoff, *Photographic Science and Engineering*, Vol. 14, pages 248 to 257 (1970), U.S. Patents 4,434,226, 4,414,310, 4,433,048 and 4,439,520, and British Patent 2,112,157.

The crystal structure may be uniform, the interior and exterior parts of the grains may comprise different halogen compositions, or the grains may have a layer-like structure. Moreover, silver halides which have different compositions may be joined with an epitaxial junction, or they may be joined with compounds other than silver halides, such as silver thiocyanate or lead oxide, for example. Furthermore, mixtures of grains which have various crystalline forms may be used.

The silver halide emulsions used have generally been subjected to physical ripening, chemical ripening and spectral sensitization. Additives which are used in such processes have been disclosed in *Research Disclosure*, Nos. 17643, 18716 and 307105, and the locations of these disclosures are summarized in the following table.

Known photographically useful additives which can be used in the present invention have also been disclosed in the three *Research Disclosure* publications referred to above, and the locations of these disclosures are indicated in the table below.

| Additives | RD 17643 (December, 1978) | RD 18716 (November, 1979) | RD 307105 (November, 1989) |
|---|---|---|---|
| 1. Chemical Sensitizers | Page 23 | Page 648, right column | Page 866 |
| 2. Sensitivity Increasing Agents | — | Page 648, right column | — |
| 3. Spectural Sensitizers and Supersensitizers | Pages 23–24 | Page 648, right column to page 649, right column | Pages 866–868 |
| 4. Brightening Agents | Page 24 | Page 647, right column | Page 868 |
| 5. Antifoggants and Stabilizers | Pages 24–25 | Page 649, right column | Pages 868–870 |
| 6. Light Absorbers, Filter Dyes and Ultraviolet Absorbers | Pages 25–26 | Page 649, right column to page 650, left column | Page 873 |
| 7. Antistaining Agents | Page 25, right column | Page 650, left to right columns | Page 872 |
| 8. Dye Image Stabilizers | Page 25 | Page 650, left column | Page 872 |
| 9. Film Hardening Agents | Page 26 | Page 651, left column | Pages 874–875 |
| 10. Binders | Page 26 | Page 651, left column | Pages 873–874 |
| 11. Plasticizers and Lubricants | Page 27 | Page 650, right column | Page 876 |
| 12. Coating Promotors and Surfactants | Pages 26–27 | Page 650, right column | Pages 875–876 |
| 13. Antistatic Agents | Page 27 | Page 650, right column | Pages 876–877 |
| 14. Matting agents | — | — | Pages 878–879 |

Furthermore, it is desirable to add the compounds which can react with and fix formaldehyde disclosed in U.S. Pat. Nos. 4,411,987 and 4,435,503 to the photosensitive material for preventing deterioration of photographic performance due to formaldehyde gas.

Various color couplers can be used in the present invention, and representative examples have been disclosed in the patents cited in the aforementioned *Research Disclosure*, No. 17643, sections VII-C to G, and *Research Disclosure*. No. 307105, sections VII-C to G.

Those color couplers disclosed, for example, in U.S. Pat. Nos. 3,933,501, 4,022,620, 4,326,024, 4,401,752 and 4,248,961, JP-B-58-10739, British Patents 1,425,020 and 1,476,760, U.S. Pat. Nos. 3,973,968, 4,314,023 and 4,511,649, and European Patent Application 249,473A, are preferred as yellow couplers.

5-Pyrazolone-based compounds and pyrazoloazole-based compounds are preferred as magenta couplers, and those disclosed, for example, in U.S. Pat. Nos. 4,310,619 and 4,351,897, European Patent 73,636, U.S. Pat. Nos. 3,061,432 and 3,725,067, *Research Disclosure*, No. 24220 (June, 1984), JP-A-60-33552, *Research Disclosure*, No. 24230 (June, 1984), JP-A-60-43659, JP-A-61-72238, JP-A-60-35730, JP-A-55-118034, JP-A-60-

185951, U.S. Pat. Nos. 4,500,630, 4,540,654 and 4,556,630, and International Patent WO 88/04795 are especially desirable.

Phenol-based and naphthol-based couplers can be used as cyan couplers, and those disclosed, for example, in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent (Laid Open) 3,329,729, European Patent Applications 121,365A and 249,453A, U.S. Pat. Nos. 3,446,622, 4,333,999, 4,775,616, 4,451,559, 4,427,767, 4,690,889, 4,254,212 and 4,296,199, and JP-A-61-42658 are preferred.

Typical examples of polymerized dye forming couplers have been disclosed, for example, in U.S. Pat. Nos. 3,451,820, 4,080,211, 4,367,282, 4,409,320 and 4,576,910, British Patent 2,102,173 and European Patent Application 341,188A.

The couplers disclosed in U.S. Pat. No. 4,366,237, British Patent 2,125,570, European Patent 96,570 and West German Patent (Laid Open) 3,234,533 are preferred as couplers of which the colored dyes have a suitable degree of diffusibility.

The colored couplers for correcting the unwanted absorptions of colored dyes disclosed, for example, in section VII-G of *Research Disclosure*, No. 17643, section VII- G of *Research Disclosure*, No. 307105, U.S. Pat. No. 4,163,670, JP-B-57-39413, U.S. Pat. Nos. 4,004,929 and 4,138,258, and British Patent 1,146,368 are preferred. Furthermore, the use of the couplers which correct the unwanted absorption of colored dyes by means of fluorescent dyes which are released on coupling disclosed in U.S. Pat. No. 4,774,181, and the couplers which have, as releasing groups, dye precursor groups which can form dyes on reaction with the developing agent, disclosed in U.S. Pat. No. 4,777,120, is also desirable.

The use of couplers which release photographically useful residual groups on coupling is also desirable in the present invention. The DIR couplers which release development inhibitors disclosed in the patents cited in section VII-F of the aforementioned *Research Disclosure*, No. 17643, in JP-A-57-151944, JP-A-57-154234, JP-A-60-184248, JP-A-63-37346, JP-A-63-37350 and in U.S. Pat. Nos. 4,248,962 and 4,782,012 are preferred.

The couplers disclosed in British Patents 2,097,140 and 2,131,188, JP-A-59-157638 and JP-A-59-170840 are preferred as couplers which release nucleating agents or development accelerators in the form of the image during development.

Other compounds which can be used in the photosensitive materials in the present invention include the competitive couplers disclosed, for example, in U.S. Pat. No. 4,130,427, the multiequivalent couplers disclosed, for example, in U.S. Pat. Nos. 4,283,472, 4,338,393 and 4,310,618., the DIR redox compound releasing couplers, DIR coupler releasing couplers, DIR coupler releasing redox compounds or DIR redox compound releasing redox compounds disclosed, for example, in JP-A-60-185950 and JP-A-62-24252, the couplers which release dyes of which the color is restored after elimination disclosed in European Patents Applications 173,302A and 313,308A, the bleach accelerator releasing couplers disclosed, for example, in *Research Disclosure*, No. 11449, Research Disclosure, No. 24241, and JP-A-61-201247, the ligand releasing couplers disclosed, for example, in U.S. Pat. No. 4,555,477, the leuco dye releasing couplers disclosed in JP-A-63-75747, and the couplers which release fluorescent dyes disclosed in U.S. Pat. No. 4,774,181.

The couplers used in the present invention can be introduced into the photosensitive material using various known methods of dispersion, such as the oil-in-water dispersion method disclosed, for example, in U.S. Pat. No. 2,322,027, the latex dispersion method disclosed, for example, in U.S. Pat. No. 4,199,363, and the loadable latex dispersion method disclosed in U.S. Pat. No. 4,203,716.

Suitable supports which can be used in the present invention have been disclosed, for example, on page 28 of the aforementioned *Research Disclosure*, No. 17643 and from the right hand column of page 647 to the left hand column of page 648 of *Research Disclosure*, No. 18716.

The present invention can be applied to various types of color photosensitive material. Thus, the present invention can be applied typically to color negative films for general and cinematographic purposes, to color reversal films for slides and television purposes, to direct positive color papers, to color papers, to color positive films and to color reversal papers.

ILLUSTRATIVE EXAMPLES

The present invention is described in detail below by means of illustrative examples, but it should be understood that the present invention is not limited by these examples. All parts, percents, and ratios are by weight, unless otherwise indicated.

EXAMPLE 1

Sample 101, a multilayer color photosensitive material comprising layers having the compositions indicated below on a cellulose triacetate film support having an subbing layer, was prepared.

Composition of the Photosensitive Layer

The coated weights of silver halide and colloidal silver are shown in units of g/m$^2$ of silver, the coated weights of couplers, additives and gelatin are shown in units of g/m$^2$, and the coated weights of sensitizing dyes are shown as the number of mols per mol of silver halide in the same layer. The meaning of symbols for additives are shown below. When the additives have plural functions, the symbols are shown as the additives for the most typical function.

UV: Ultraviolet Absorbers
Solv: High Boiling Point Organic Solvents
ExF: Dyes
ExS: Sensitizing Dyes
ExC: Cyan Couplers
ExM: Magenta Couplers
ExY: Yellow Couplers
Cpd: Additives
W: Surfactants
H: Film Hardening Agents

| | |
|---|---|
| First Layer: Antihalation Layer | |
| Black Colloidal Silver | 0.2 (as silver) |
| Gelatin | 2.2 |
| UV-1 | 0.1 |
| UV-2 | 0.2 |
| Cpd-1 | 0.05 |
| Solv-1 | 0.01 |
| Solv-2 | 0.01 |
| Solv-3 | 0.08 |
| Second Layer: Intermediate Layer | |

-continued

| | |
|---|---|
| Fine Grain Silver Bromide (corresponding sphere diameter: 0.07 μm) | 0.15 (as silver) |
| Gelatin | 1.0 |
| Cpd-2 | 0.2 |
| Third Layer: | |
| First Red-Sensitive Emulsion Layer | |
| Silver Iodobromide Emulsion (10 mol % AgI, high internal AgI type, corresponding sphere diameter: 0.7 μm, variation coefficient of the corresponding sphere diameter: 14%, tetradecahedral grains) | 0.26 (as silver) |
| Silver Iodobromide Emulsion (14 mol % AgI, high internal AgI type, corresponding sphere diameter: 0.4 μm, variation coefficient of the corresponding sphere diameter: 22%, tetradecahedral grains) | 0.2 (as silver) |
| Gelatin | 1.0 |
| ExS-1 | $4.5 \times 10^{-4}$ mol |
| ExS-2 | $1.5 \times 10^{-4}$ mol |
| ExS-3 | $0.4 \times 10^{-4}$ mol |
| ExS-4 | $0.3 \times 10^{-4}$ mol |
| ExC-1 | 0.15 |
| ExC-7 | 0.15 |
| ExC-2 | 0.09 |
| ExC-3 | 0.023 |
| EXC-6 | 0.14 |
| Fourth Layer: | |
| Second Red-Sensitive Emulsion Layer | |
| Silver Iodobromide Emulsion (16 mol % AgI, high internal AgI type, corresponding sphere diameter: 1.0 μm, variation coefficient of the corresponding sphere diameter: 25%, tabular grains, diameter/thickness ratio: 4.0) | 0.55 (as silver) |
| Gelatin | 0.7 |
| ExS-1 | $3 \times 10^{-4}$ |
| ExS-2 | $1 \times 10^{-4}$ |
| ExS-3 | $0.3 \times 10^{-4}$ |
| ExS-4 | $0.3 \times 10^{-4}$ |
| ExC-1 | 0.05 |
| ExC-3 | 0.10 |
| ExC-4 | 0.08 |
| Fifth Layer: | |
| Third Red-Sensitive Emulsion Layer | |
| Silver Iodobromide Emulsion (10 mol % AgI, high internal AgI type, corresponding sphere diameter: 1.2 μm, variation coefficient of the corresponding sphere diameter 28%, tabular grains, diameter/thickness ratio: 6.0) | 0.9 (as silver) |
| Gelatin | 0.6 |
| ExS-1 | $2 \times 10^{-4}$ |
| ExS-2 | $0.6 \times 10^{-4}$ |
| ExS-3 | $0.2 \times 10^{-4}$ |
| ExC-4 | 0.07 |
| ExC-5 | 0.06 |
| Solv-1 | 0.12 |
| Solv-2 | 0.12 |
| Sixth Layer: Intermediate Layer | |
| Gelatin | 1.0 |
| Cpd-4 | 0.1 |
| Seventh Layer: | |
| First Green-Sensitive Emulsion Layer | |
| Silver Iodobromide Emulsion (10 mol % AgI, high internal AgI type, corresponding sphere diameter: 0.7 μm, variation coefficient of the corresponding sphere diameter: 14%, tetradecahedral grains) | 0.2 (as silver) |
| Silver Iodobromide Emulsion (14 mol % AgI, high internal AgI type, corresponding sphere diameter: 0.4 μm, variation coefficient of the corresponding sphere diameter: 22%, tetradecahedral grains) | 0.1 (as silver) |
| Gelatin | 1.2 |
| ExS-5 | $5 \times 10^{-4}$ |
| ExS-6 | $2 \times 10^{-4}$ |

-continued

| | |
|---|---|
| ExS-7 | $1 \times 10^{-4}$ |
| ExM-1 | 0.20 |
| ExM-6 | 0.25 |
| ExM-2 | 0.10 |
| ExM-5 | 0.03 |
| Solv-1 | 0.40 |
| Solv-2 | 0.03 |
| Eighth Layer: | |
| Second Green-Sensitive Emulsion Layer | |
| Silver Iodobromide Emulsion (10 mol % AgI, high internal AgI type, corresponding sphere diameter: 1.0 μm, variation coefficient of the corresponding sphere diameter: 25%, tabular grains, diameter/thickness ratio 3.0) | 0.4 (as silver) |
| Gelatin | 0.35 |
| ExS-5 | $3.5 \times 10^{-4}$ |
| ExS-6 | $1.4 \times 10^{-4}$ |
| ExS-7 | $0.7 \times 10^{-4}$ |
| ExM-1 | 0.09 |
| ExM-3 | 0.01 |
| Solv-1 | 0.15 |
| Solv-4 | 0.03 |
| Ninth Layer: Intermediate Layer | |
| Gelatin | 0.5 |
| Tenth Layer: | |
| Third Green-Sensitive Emulsion Layer | |
| Silver Iodobromide Emulsion (10 mol % AgI, high internal AgI type, corresponding sphere diameter: 1.2 μm, variation coefficient of the corresponding sphere diameter: 28%, tabular grains, diameter/thickness ratio: 6.0) | 1.0 (as silver) |
| Gelatin | 0.8 |
| ExS-5 | $2 \times 10^{-4}$ |
| ExS-6 | $0.8 \times 10^{-4}$ |
| ExS-7 | $0.8 \times 10^{-4}$ |
| ExM-3 | 0.01 |
| ExM-4 | 0.04 |
| ExC-4 | 0.005 |
| Solv-1 | 0.2 |
| Eleventh Layer: Yellow Filter Layer | |
| Cpd-3 | 0.05 |
| Gelatin | 0.5 |
| Solv-1 | 0.1 |
| Twelfth Layer: Intermediate Layer | |
| Gelatin | 0.5 |
| Cpd-2 | 0.1 |
| Thirteenth Layer: | |
| First Blue-Sensitive Emulsion Layer | |
| Silver Iodobromide Emulsion (10 mol % AgI, high internal AgI type, corresponding sphere diameter: 0.7 μm, variation coefficient of the corresponding sphere diameter: 14%, tetradecahedral grains) | 0.1 (as silver) |
| Silver Iodobromide Emulsion (4 mol % AgI, high internal AgI type, corresponding sphere diameter: 0.4 μm, variation coefficient of the corresponding sphere diameter: 22%, tetradecahedral grains) | 0.05 (as silver) |
| Gelatin | 1.0 |
| ExS-8 | $3 \times 10^{-4}$ |
| ExY-1 | 0.25 |
| ExY-3 | 0.32 |
| ExY-2 | 0.02 |
| Solv-1 | 0.20 |
| Fourteenth Layer: | |
| Second Blue-Sensitive Emulsion Layer | |
| Silver Iodobromide Emulsion (19 mol % AgI, high internal AgI type, corresponding sphere diameter: 1.0 μm, variation coefficient of the corresponding sphere diameter: 16%, tetradecahedral grains) | 0.19 (as silver) |
| Gelatin | 0.3 |
| ExS-8 | $2 \times 10^{-4}$ |
| ExY-1 | 0.22 |
| Solv-1 | 0.07 |

-continued

| | |
|---|---|
| Fifteenth Layer: Intermediate Layer | |
| Fine Grain Silver Iodobromide Emulsion (2 mol % AgI, uniform type, corresponding sphere diameter: 0.13 μm) | 0.2 (as silver) |
| Gelatin | 0.36 |
| Sixteenth Layer: Third Blue-Sensitive Emulsion Layer | |
| Silver Iodobromide Emulsion (14 mol % AgI, high internal AgI type, corresponding sphere diameter: 1.5 μm, variation coefficient of the corresponding sphere diameter: 28%, tabular grains, diameter/thickness ratio: 5.0) | 1.0 (as silver) |
| Gelatin | 0.5 |
| ExS-8 | $1.5 \times 10^{-4}$ |
| ExY-1 | 0.2 |

-continued

| | |
|---|---|
| Solv-1 | 0.07 |
| Seventeenth Layer: First Protective Layer | |
| Gelatin | 1.8 |
| UV-1 | 0.1 |
| UV-2 | 0.2 |
| Solv-1 | 0.01 |
| Solv-2 | 0.01 |
| Eighteenth Layer: Second Protective Layer | |
| Fine Grain Silver Bromide Emulsion (corresponding sphere diameter: 0.07 μm) | 0.18 (as silver) |
| Gelatin | 0.7 |
| Poly(methyl methacrylate) Grains (diameter: 1.5 μm) | 0.2 |
| W-1 | 0.02 |
| H-1 | 0.4 |
| Cpd-5 | 1.0 |

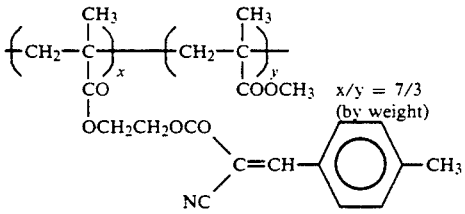

UV-1

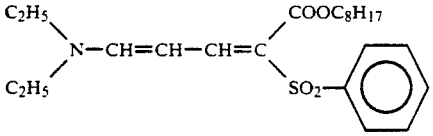

UV-2

ExM-3

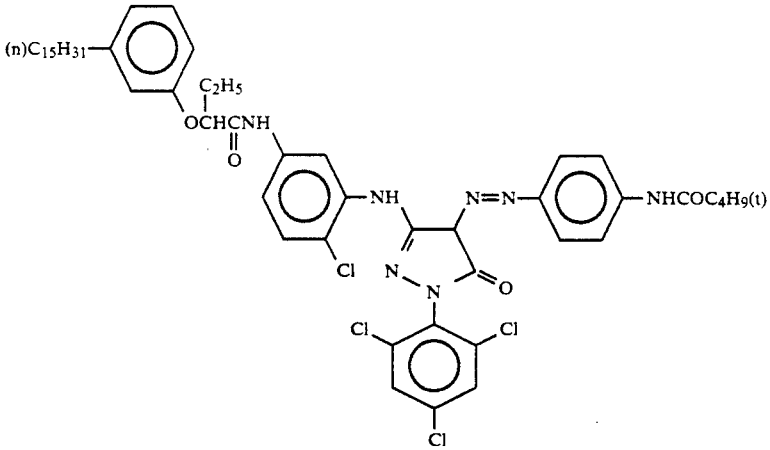

ExC-1

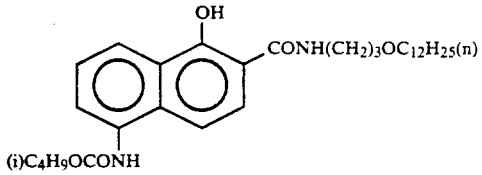

-continued
ExC-2
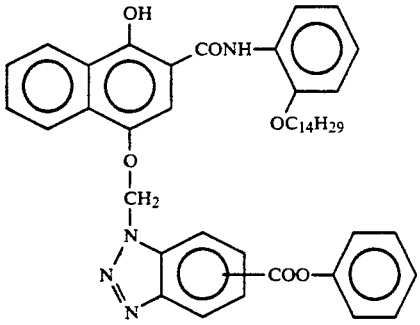
ExC-3
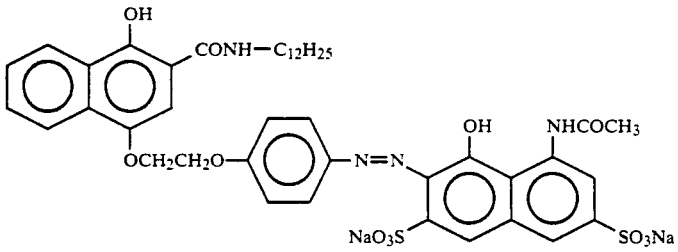
ExC-6
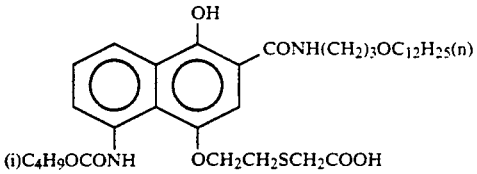
ExC-7
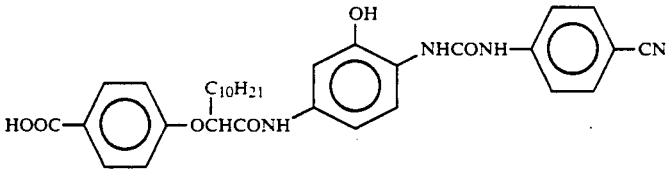
ExC-4
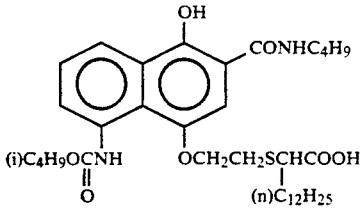
ExC-5
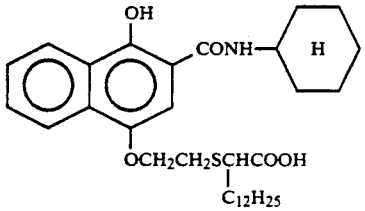

-continued
ExM-1
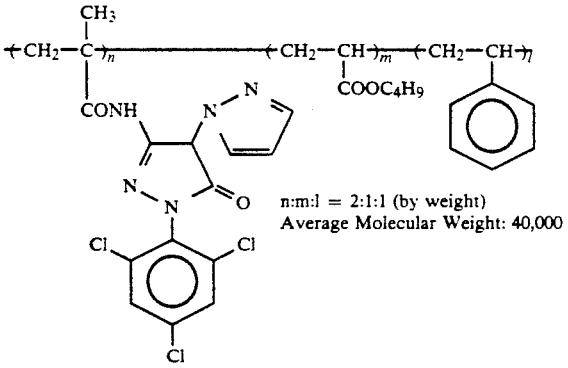
n:m:l = 2:1:1 (by weight)
Average Molecular Weight: 40,000
ExM-2
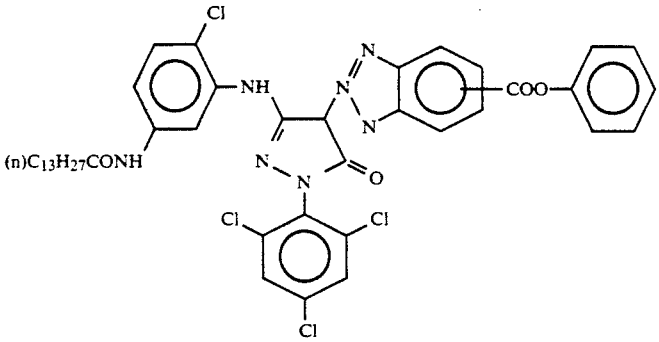
ExM-4
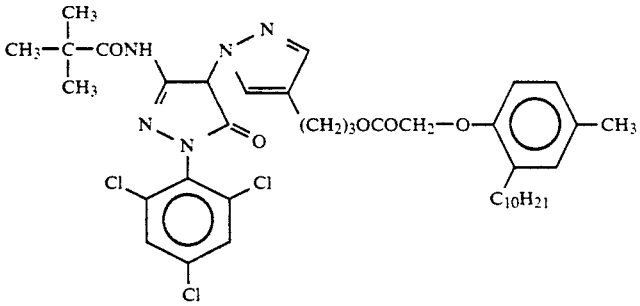
ExM-5
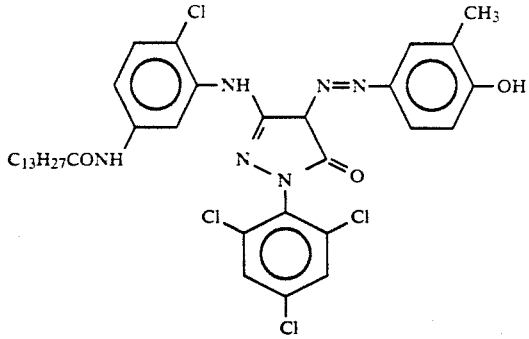
ExM-6
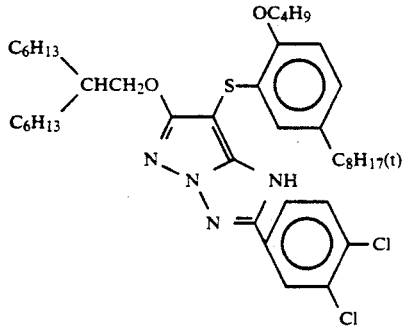

-continued
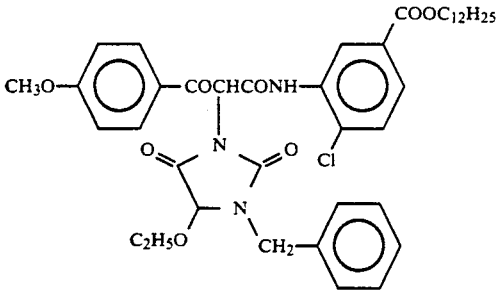
ExY-1
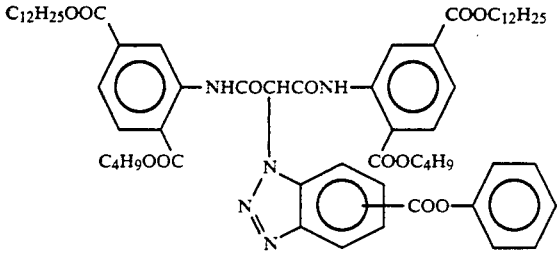
ExY-3
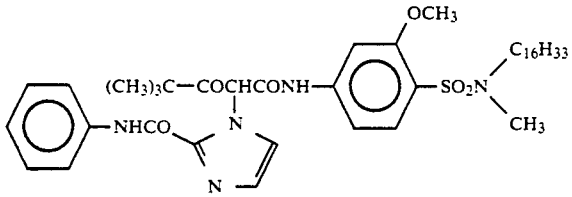
ExS-1
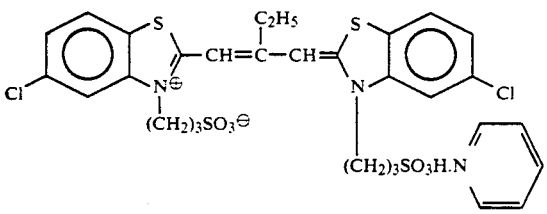
ExS-2
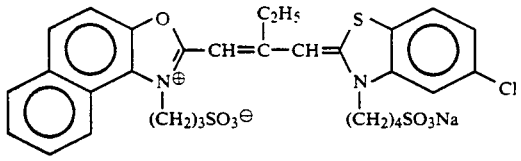
ExS-3
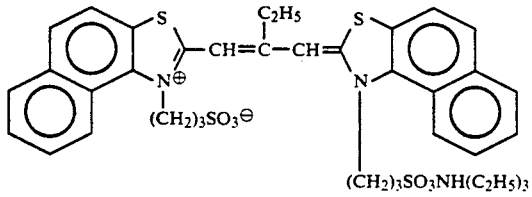
ExS-4
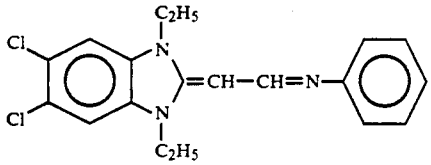

-continued
ExS-5
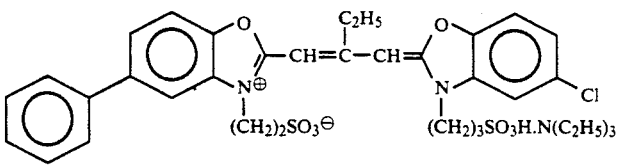
ExS-6
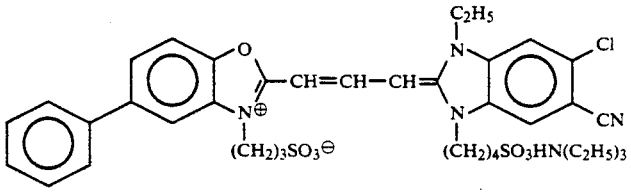
ExS-8
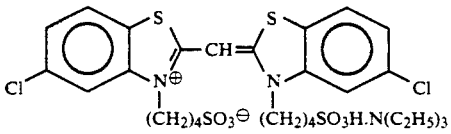
ExS-7
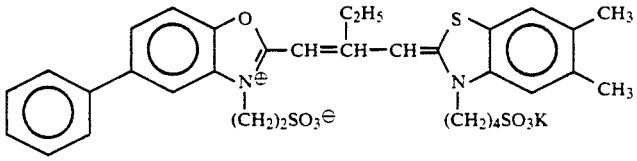
Solv-1
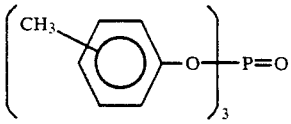
Solv-2
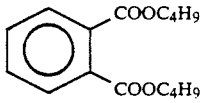
Solv-3
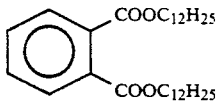
Solv-4
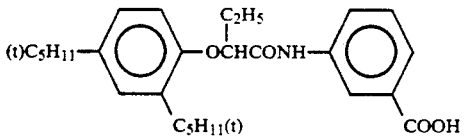
Cpd-1
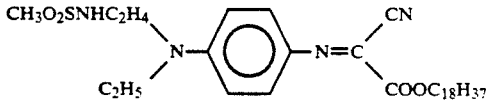
Cpd-2
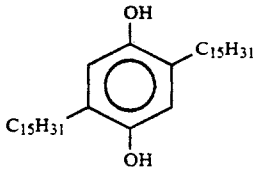

-continued

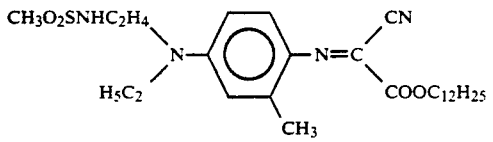

Cpd-3

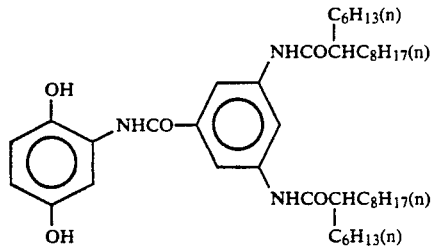

Cpd-4

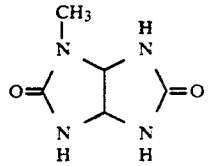

Cpd-5

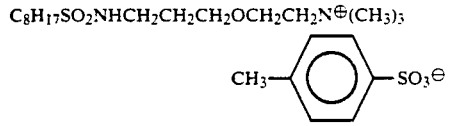

W-1

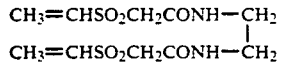

H-1

The sample prepared was cut to a width of 35 mm an finished and then subjected to wedge exposure with white light (light source color temperature: 4,800° K.), after which it was processed using an automatic processor for motion picture film with the processing operations (processing steps) indicated below. However, the samples for evaluation were processed after processing the (photosensitive material}sample which had been subjected to imagewise exposure until the total replenishment of the color developer had reached three times the volume of the developer (developing solution) in the development tank.

The processing was carried out while the aeration conditions of the bleaching solution were such that bubbles were being introduced at the rate of 200 ml per minute from pipe work which was provided with a plurality of fine holes having a diameter of 0.2 mm and which was located at the bottom of the bleach tank.

| | Processing Operations | | | |
|---|---|---|---|---|
| Process | Processing Time | Processing Temperature (°C.) | Replenishment Rate* (ml) | Tank Capacity (liter) |
| Color Development | 3 min | 37.8 | 23 | 10 |
| Bleaching | 50 sec | 38.0 | 5 | 5 |
| Fixing | 1 min 40 sec | 38.0 | 30 | 10 |
| Water Washing (1) | 30 sec | 38.0 | — | 5 |
| Water Washing (2) | 20 sec | 38.0 | 30 | 5 |
| Stabilizaiion | 20 sec | 38.0 | 20 | 5 |

-continued

| | Processing Operations | | | |
|---|---|---|---|---|
| Process | Processing Time | Processing Temperature (°C.) | Replenishment Rate* (ml) | Tank Capacity (liter) |
| Drying | 1 min | 55 | — | — |

*Replenishment rate per meter of 35 mm wide material. Water washing process was a countercurrent system of from (2) to (1).

Moreover, the carry-over of developer into the bleaching process and the carry-over of fixer (fixing solution) into the water washing process were 2.5 ml and 2.0 ml per meter length of photosensitive material of width 35 mm, respectively.

Furthermore, the crossover times were 5 seconds and this time is included in the processing time for the preceding process.

The compositions of the processing solutions are indicated below.

| Color Development Solution | Mother Liquor (Tank Soln.) | Replenisher |
|---|---|---|
| Diethylenetriaminepentaacetic Acid | 1.0 g | 1.1 g |
| 1-Hydroxyethylidene-1,1-diphosphonic Acid | 3.0 g | 3.2 g |
| Sodium Sulfite | 4.0 g | 4.9 g |
| Potassium Carbonate | 30.0 g | 30.0 g |
| Potassium Bromide | 1.4 g | — |
| Potassium Iodide | 1.5 mg | — |
| Hydroxylamine Sulfate | 2.4 g | 3.6 g |
| 4-(N-Ethyl-N-β-hydroxyethylamino)-2-methylaniline | 4.5 g | 6.4 g |

-continued

| | | |
|---|---|---|
| Sulfate | | |
| Water to make | 1.0 liter | 1.0 liter |
| pH | 10.05 | 10.10 |

| Bleaching Solution | Mother Liquor | Replenisher |
|---|---|---|
| Ferric Nitrate | 0.35 mol | 0.53 mol |
| Chelating Compound according to the Present Invention see Table 1) | 0.55 mol | 0.83 mol |
| Ammonium Bromide | 100 g | 150 g |
| Ammonium Nitrate | 20 g | 30 g |
| Glycolic Acid | 55 g | 83 g |
| Water to make | 1.0 liter | 1.0 liter |
| pH | 5.0 | 5.0 |

Here, a chelating compound signifies an organic acid which forms an organic acid ferric ammonium salt which is used as a bleaching agent.

| Fixing Solution (mother liquor equals replenisher) | |
|---|---|
| Ethylenediaminetetraacetic Acid Diammonium Salt | 1.7 g |
| Ammonium Sulfite | 14.0 g |
| Aqueous Ammonium Thiosulfate Solution (700 g/liter) | 260.0 ml |
| Water to make | 1.0 liter |
| pH | 7.0 |

Water Washing Water (mother liquor equals replenisher)

Town water was passed through a mixed bed column which had been packed with an H-type strongly acidic cation exchange resin ("Amberlite IR-120B", manufactured by the Rohm and Haas Co.) and an OH-type strongly basic anion exchange resin ("Amberlite IRA-400", manufactured by the same company) and treated so that the calcium and magnesium ion concentrations each were not more than 3 mg/liter, after which 20 mg/liter of sodium dichloroisocyanurate and 150 mg/liter of sodium sulfate were added.

The pH of this liquid was within the range of from 6.5 to 7.5.

| Stabilizing Solution (mother liquor equals replenisher) | |
|---|---|
| Formalin (37 wt % aq. soln. of formaldehyde) | 1.2 ml |
| Surfactant [$C_{10}H_{21}$—O—$(CH_2CH_2O)_{10}$—H] | 0.4 g |
| Ethylene Glycol | 1.0 g |
| Water to make | 1.0 liter |
| pH | 5.0–7.0 |

The amount of residual silver in the region of maximum color density of each photosensitive material which had been processed in the way described above was measured by fluorescence X-ray analysis. The results obtained are shown in Table 1.

Furthermore, the processed samples obtained were subjected to density measurements, and the measured value for $D_{min}$ for green light (G light) was read off in each case from the characteristic curve.

Next, the bleaching composition was changed to the processing solution formulation indicated below as a standard bleaching solution which gave no bleach fogging, and processing was carried out without modification except that the bleach processing time was set at 390 seconds, the bleach processing temperature was 38° C. and the replenishment rate for the bleaching solution was 25 ml per 1 meter length of photosensitive material of width 35 mm.

| Standard Bleaching Solution | Mother Liquor | Replenisher |
|---|---|---|
| Ethylenediaminetetraacetic Acid Ferric Sodium Salt Trihydrate | 100.0 g | 120.0 g |
| Ethylenediaminetetraacetic Acid Disodium Salt | 10.0 g | 11.0 g |
| Ammonium Bromide | 100 g | 120 g |
| Ammonium Nitrate | 30.0 g | 35.0 g |
| Aqueous Ammonia (27 wt %) | 6.5 ml | 4.0 ml |
| Water to make | 1.0 liter | 1.0 liter |
| pH | 6.0 | 5.7 |

The processed material obtained using the above mentioned standard bleaching solution was subjected to the density measurement described above, and the $D_{min}$ value was read off from the characteristic curves.

The $D_{min}$ value obtained in this way with the standard bleaching solution was 0.60, which was taken as the standard, and the difference, $\Delta D_{min}$, between this standard $D_{min}$ value and each of the other $D_{min}$ values was obtained.

The amount of bleach fogging was determined according to the following equation:

$$\text{Bleach Fogging } (\Delta D_{min}) = (D_{min} \text{ for each sample}) - (D_{min} \text{ in standard bleaching solution})$$

The results obtained are shown in Table 1.

Next, the increase in staining on storing the samples after processing was obtained, using these samples, from the change in density of the part in which no color had been formed, measured before and after storage under the conditions indicated below.

Conditions: 60° C., 70% RH, 4 weeks (dark, hot, and humid)

The increase in staining was determined according to the following equation:

$$\text{Increase in Staining } (\Delta D) = D_{min} \text{ after storage} - (D_{min} \text{ before storage})$$

The results obtained are also shown in Table 1.

TABLE 1

| Sample No. | Chelating Compound | Residual Ag (μg/cm²) | Bleach Fogging $\Delta D_{min}$ (G) | Increased Staining ΔD (G) | Remarks |
|---|---|---|---|---|---|
| 101 | Comparative Compound A | 15.0 | 0.00 | 0.36 | Comparison |
| 102 | Comparative Compound B | 4.2 | 0.27 | 0.17 | " |
| 103 | Comparative Compound C | 5.5 | 0.05 | 0.19 | " |
| 104 | Comparative Compound D | 63.0 | 0.00 | 0.08 | " |
| 105 | B-51 | 4.5 | 0.02 | 0.05 | Invention |
| 106 | B-52 | 4.6 | 0.01 | 0.04 | " |
| 107 | B-53 | 4.8 | 0.01 | 0.05 | " |
| 108 | B-55 | 4.4 | 0.02 | 0.04 | " |
| 109 | B-56 | 5.0 | 0.00 | 0.05 | " |
| 110 | B-59 | 4.0 | 0.03 | 0.03 | " |
| 111 | B-65 | 4.2 | 0.03 | 0.03 | " |
| 112 | B-57 | 4.9 | 0.01 | 0.05 | " |
| 113 | B-58 | 4.8 | 0.01 | 0.05 | " |
| 114 | B-1 | 5.3 | 0.00 | 0.10 | " |
| 115 | B-2 | 5.4 | 0.00 | 0.10 | " |

TABLE 1-continued

| Sample No. | Chelating Compound | Residual Ag ($\mu g/cm^2$) | Bleach Fogging $\Delta D_{min}$ (G) | Increased Staining $\Delta D$ (G) | Remarks |
|---|---|---|---|---|---|
| 116 | B-25 | 4.0 | 0.03 | 0.03 | " |

Comparative Compound A

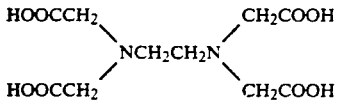

Comparative Compound B

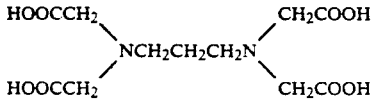

Comparative Compound C

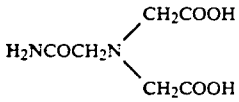

(Compound disclosed in JP-A-1-93740)

Comparative Compound D

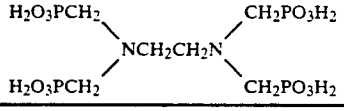

As is apparent from the results shown in Table 1, the compounds of the present invention reduced the amount of residual silver as compared with the comparative compounds, and they also had an excellent effect with respect to bleach fogging and the staining which arises on storing the colored images after processing.

EXAMPLE 2

Sample 105 of Example 1 of JP-A-2-89045 was processed in the way indicated below.

| Processing Operations | | | | |
|---|---|---|---|---|
| Process | Processing Time | Processing Temperature (°C.) | Replenishment Rate* (ml) | Tank Capacity (liter) |
| Color Development | 1 min 45 sec | 43 | 25 | 10 |
| Bleaching | 20 sec | 40 | 5 | 4 |
| Bleach-Fixing | 20 sec | 40 | — | 4 |
| Fixing | 20 sec | 40 | 16 | 4 |
| Water Washing (1) | 20 sec | 40 | — | 2 |
| Water Washing (2) | 10 sec | 40 | 30 | 2 |
| Stabilization | 10 sec | 40 | 20 | 2 |
| Drying | 1 min | 60 | — | — |

*Replenishment rate per meter of 35 mm wide material.

The water washing process was a countercurrent system of from (2) to (1), and the overflow from the bleaching bath was all introduced into the bleach-fixing bath.

Furthermore, the overflow from water washing (1) was all introduced into the fixing bath, and the overflow from the fixing bath was all introduced into the bleach-fixing bath.

Moreover, the carry-over of fixer into the water washing process in the processing operation outlined above was 2 ml per 1 meter length of photo-sensitive material of width 35 mm.

| | Mother Liquor | Replenisher |
|---|---|---|
| Color Development Solution | | |
| Diethylenetriaminepentaaceic Acid | 2.0 g | 2.0 g |
| 1-Hydroxyethylidene-1,1-diphosphonic Acid | 3.0 g | 3.2 g |
| Sodium Sulfite | 4.0 g | 5.8 g |
| Potassium Carbonate | 40.0 g | 40.0 g |
| Potassium Bromide | 1.3 g | — |
| Potassium Iodide | 1.5 mg | — |
| Hydroxylamine Sulfate | 2.4 g | 3.6 g |
| 2-Methyl-4-[N-ethyl-N-(β-hydroxyethyl)amino]aniline Sulfate | 13.5 g | 19.6 g |
| Water to make | 1.0 liter | 1.0 liter |
| pH | 10.20 | 10.35 |
| Bleaching Solution | | |
| Chelating Compound according to the Present Invention (see Table 2) | 0.4 mol | 0.55 mol |
| Ferric Nitrate | 0.35 mol | 0.49 mol |
| Ammonium Bromide | 100 g | 140 g |
| Ammonium Nitrate | 17.5 g | 25.0 g |
| Water to make | 1.0 liter | 1.0 liter |
| pH | 4.5 | 4.5 |
| Fixing Solution | | |
| Aqueous Ammonium Thiosulfate Solution (700 g/liter) | 280 ml | 840 ml |
| Ethylenediaminetetraacetic Acid | 12.6 g | 38 g |
| Ammonium Sulfite | 27.5 g | 82.5 g |
| Imidazole | 28 g | 84 g |
| Water to make | 1 liter | 1 liter |
| pH | 7.8 | 8.0 |

Bleach-Fixing Solution

Bleach/Fixer/Water Washing Water were mixed in the following proportions (by volume) 5/16/30.

Water Washing Water

Same as the water washing water used in Example 1.

| Stabilizinq Solution (mother liquor equals replenisher) | |
|---|---|
| Formalin (37 wt % aq. soln. of formaldehyde) | 2.0 ml |
| Polyoxyethylene-p-monononylphenyl Ether (average degree of polymerization: 10) | 0.3 g |
| Ethylenediaminetetraacetic Acid | 0.05 g |
| Water to make | 1.0 liter |
| pH | 5.0–8.0 |

The processed samples obtained were subjected to density measurements, and the $D_{min}$ values measured with green light were read off from the characteristic curves.

On the other hand, Sample 105 of Example 1 of JP-A-2-89045 was processed using the standard bleaching solution used in Example 1, and a similar or higher $D_{min}$ value was obtained. The bleach fogging, $\Delta D_{min}$, was calculated using the same procedure as in Example 1, taking the $D_{min}$ value for this standard bleaching solution as a standard. In this case, the $D_{min}$ value with the standard bleaching solution was 0.57. The results are shown in table 2.

Next, tests were carried out in connection with staining on storing the image after processing under the same conditions as in Example 1 using the processed samples above, and the evaluation of staining was carried out in the same way as in Example 1. These results are also shown in Table 2.

Moreover, samples which had been subjected to a uniform exposure so as to provide a gray density of 1.5 were processed in the same way as before, and the residual silver content of these samples was determined using the fluorescence X-ray method. These results are also shown in Table 2.

TABLE 2

| Sample No. | Chelating Compound | Residual Ag ($\mu g/cm^2$) | Bleach Fogging $\Delta D_{min}$ (G) | Increased Staining $\Delta D$ (G) | Remarks |
|---|---|---|---|---|---|
| 201 | Comparative Compound A | 21.0 | 0.05 | 0.38 | Comparison |
| 202 | Comparative Compound B | 3.5 | 0.43 | 0.26 | Comparison |
| 203 | Comparative Compound C | 6.0 | 0.10 | 0.20 | Comparison |
| 204 | Comparative Compound D | 76.1 | 0.00 | 0.07 | Comparison |
| 205 | B-51 | 3.5 | 0.04 | 0.04 | Invention |
| 206 | B-52 | 4.1 | 0.03 | 0.03 | " |
| 207 | B-53 | 4.3 | 0.03 | 0.04 | " |
| 208 | B-55 | 3.2 | 0.05 | 0.04 | " |
| 209 | B-56 | 4.5 | 0.03 | 0.04 | " |
| 210 | B-59 | 3.0 | 0.05 | 0.02 | " |
| 211 | B-65 | 3.2 | 0.05 | 0.02 | " |
| 212 | B-57 | 4.4 | 0.03 | 0.04 | " |
| 213 | B-58 | 4.3 | 0.04 | 0.04 | " |
| 214 | B-1 | 4.9 | 0.02 | 0.09 | " |
| 215 | B-2 | 5.0 | 0.02 | 0.10 | " |
| 216 | B-25 | 3.1 | 0.05 | 0.02 | " |

Comparative Compounds A, B, C and D were the same as in Example 1. It is clearly seen from the results in Table 2 that the compounds of the present invention reduced the amount of residual silver as compared with the comparative compounds and, at the same time, had an excellent effect on bleach fogging and staining on storing the colored image after processing.

EXAMPLE 3

A color paper sample obtained by replacing Compound III-23 by Compound III-10, in Sample 214 of Example 2 of European Patent Application (Laid Open) 355,660A2 was taken as Sample 301.

The processing solutions having the compositions indicated below were prepared.

| | |
|---|---|
| Color Development Solution | |
| Water | 600 ml |
| Ethylenediamine-N,N,N',N'-tetramethylenephosphonic Acid | 2.0 g |
| Potassium Bromide | 0.015 g |
| Potassium Chloride | 3.1 g |
| Triethanolamine | 10.0 g |
| Potassium Carbonate | 27 g |
| Brightening Agent (WHITEX 4B, manufactured by Sumitomo Chemical Co.) | 1.0 g |
| Diethylhydroxylamine-N-ethyl-N-(β-methanesulfonamidoethyl)-3-methyl-4-aminoaniline Sulfate | 5.0 g |
| Water to make | 1,000 ml |
| pH (25° C.) | 10.05 |
| Bleach-Fixing Solution | |
| Water | 400 ml |
| Amonium Thiosulfate (70 wt % aq. soln.) | 100 ml |

-continued

| | |
|---|---|
| Sodium Sulfite | 17 g |
| Ferric Chloride | 0.50 mol |
| Chelating Compound according to the Present Invention (See Table 3) | 0.55 mol |
| Amonium Bromide | 40 g |
| Water to make | 1,000 ml |
| pH (25° C.) | 6.0 |

Rinsing Solution

Ion exchanged water (calcium and magnesium both concentration: 3 ppm or less)

The above mentioned photosensitive material was processed in the way outlined below.

| Processing Operation | Temperature (°C.) | Time (second) |
|---|---|---|
| Color Development | 38 | 45 |
| Bleach-Fixing | 35 | 25 |
| Rinsing (1) | 35 | 20 |
| Rinsing (2) | 35 | 20 |
| Rinsing (3) | 35 | 20 |
| Drying | 80 | 60 |

Moreover, samples which had been subjected to a uniform exposure so as to provide a gray density of 1.5 were processed in the same way as before, and the residual silver content in the maximum density parts of the samples obtained was determined using the fluorescence X-ray method. The results are shown in Table 3.

TABLE 3

| Sample No. | Chelating Compound | Residual Ag ($\mu g/cm^2$) | Remarks |
|---|---|---|---|
| 301 | Comparative Compound A | 14.0 | Comparison |
| 302 | Comparative Compound C | 6.6 | " |
| 303 | B-51 | 2.2 | Invention |
| 304 | B-52 | 2.4 | " |
| 305 | B-53 | 2.6 | " |
| 306 | B-55 | 2.2 | " |
| 307 | B-56 | 2.8 | " |
| 308 | B-1 | 2.0 | " |
| 309 | B-7 | 2.2 | " |
| 310 | B-57 | 2.7 | " |
| 311 | B-58 | 2.6 | " |
| 312 | B-25 | 2.0 | " |

Comparative Compounds A and C were the same as in Example 1.

It is clearly seen from the results shown in Table 3 that when a compound of the present invention was used, the amount of residual silver was less than that when the comparative compounds were used.

EXAMPLE 4

A photosensitive material which was the same as that used in Example 1 was given a wedge exposure with white light (light source temperature: 4,800° K.) and processed in accordance with the processing operations outlined below.

| Processing Operations | | | | |
|---|---|---|---|---|
| Process | Processing Time | Processing Temperature (°C.) | Replenishment Rate* (ml) | Tank Capacity (liter) |
| Color Development | 1 min | 48 | 10 | 2 |
| Bleaching | 20 sec | 48 | 10 | 1 |
| Fixing | 40 sec | 48 | 30 | 1 |
| Water Washing | 20 sec | 40 | 30 | 1 |
| Drying | 40 sec | 60 | — | — |

*Replenishment rate per meter of 35 mm wide material.

| Color Development Solution | Mother Liquor | Replenisher |
|---|---|---|
| Diethylenetriaminepentaacetic Acid | 2.2 g | 2.2 g |
| 1-Hydroxyethylidene-1,1-diphosphonic Acid | 3.0 g | 3.2 g |
| Sodium Sulfite | 4.1 g | 4.9 g |
| Potassium Carbonate | 40 g | 40 g |
| Potassium Bromide | 1.4 g | 0.4 g |
| Potassium Iodide | 1.3 mg | — |
| 2-Methyl-4-[N-ethyl-N-(β-hydroxyethyl)amino]aniline Sulfate | 6.9 g | 9.2 g |
| Water to make | 1 liter | 1 liter |
| pH (adjusted with 50 wt % KOH) | 10.05 | 10.25 |

| Bleaching Solution | Mother Liquor | Replenisher |
|---|---|---|
| Ferric Chloride | 0.3 mol | 0.43 mol |
| Chelating Compound Shown in Table 4 | 0.33 mol | 0.47 mol |
| Ammonium Bromide | 80 g | 114 g |
| Ammonium Nitrate | 15 g | 21.4 g |
| Acetic Acid (90 wt %) | 42 g | 60 g |
| Water to make | 1 liter | 1 liter |
| pH | 4.3 | 3.8 |

| Fixing Solution (mother liquor equals replenisher) | |
|---|---|
| Aqueous Ammonium Thiosulfate Solution (70 wt %) | 280 ml |
| 1-Hydroxyethylidene-1,1-dipphosphonic Acid | 10 g |
| Ammonium Sulfite | 28 g |
| Water to make | 1 liter |
| pH | 7.8 |

Processing was carried out until the cumulative replenishment reached twice the mother liquor tank volume. An evaluation of processing was carried out at that time.

The evaluation of processing was carried out by measuring the residual silver content in the region of maximum color density in the same way as in Example 1.

The results obtained are shown in Table 4.

TABLE 4

| Sample No. | Chelating Compound | Residual Ag (μg/cm²) | Remarks |
|---|---|---|---|
| 401 | Comparative Compound A | 30.0 | Comparison |
| 402 | B-59 | 2.0 | Invention |
| 403 | B-60 | 2.2 | " |
| 404 | B-61 | 2.6 | " |
| 405 | B-64 | 4.9 | " |
| 406 | B-65 | 5.0 | " |
| 407 | B-51 | 2.2 | " |
| 408 | B-52 | 2.7 | " |
| 409 | B-53 | 3.0 | " |
| 410 | B-56 | 2.0 | " |

TABLE 4-continued

| Sample No. | Chelating Compound | Residual Ag (μg/cm²) | Remarks |
|---|---|---|---|
| | Comparative Compound A | | |

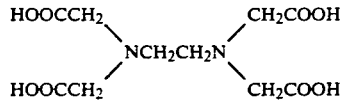

Standard electron migration rate constant $k_s=2.7\times10^{-4}$.

It is clearly seen from the results shown in Table 4 that the compounds of the present invention, which have a small standard electron migration rate constant, provide better desilvering properties than Comparative Compound A.

EXAMPLE 5

Sample 102, a multilayer color photosensitive material comprising layers having the compositions indicated below on a cellulose triacetate film support having a subbing layer, was prepared.

Composition of the Photosensitive Layer

The coated weights of silver halide and colloidal silver are shown in units of g/m² as silver, the coated weights of couplers, additives and gelatin are shown in units of g/m², and the coated weights of sensitizing dyes are shown as the number of mols per mol of silver halide in the same layer. The meaning of symbols for additives are shown below. When the additives have plural functions, the symbols are shown as the additives for the most typical function.

UV: Ultraviolet Absorbers
Solv: High Boiling Point Organic Solvents
ExF: Dyes
ExS: Sensitizing Dyes
ExC: Cyan Couplers
ExM: Magenta Couplers
ExY: Yellow Couplers
Cd: Additives
W: Surfactants
H: Film Hardening Agents

| | |
|---|---|
| First Layer: Antihalation Layer | |
| Black Colloidal Silver | 0.15 (as silver) |
| Gelatin | 2.33 |
| ExM-2 | 0.11 |
| UV-1 | $3.0\times10^{-2}$ |
| UV-2 | $6.0\times10^{-2}$ |
| UV-3 | $7.0\times10^{-2}$ |
| Solv-1 | 0.16 |
| Solv-2 | 0.10 |
| ExF-1 | $1.0\times10^{-2}$ |
| ExF-2 | $4.0\times10^{-2}$ |
| ExF-3 | $5.0\times10^{-3}$ |
| Cpd-6 | $1.0\times10^{-3}$ |
| Second Layer: | |
| Low Speed Red-Sensitive Emulsion Layer | |
| Silver Iodobromide Emulsion (4.0 mol % AgI, uniform AgI type, corresponding sphere diameter: 0.4 μm, variation coefficient of the corresponding sphere diameter: 30%, tabular grains, diameter/thickness ratio: 3.0) | 0.35 (as silver) |
| Silver Iodobromide Emulsion (6.0 mol % AgI, high internal AgI type having a core/shell ratio of 1/2, corresponding sphere diameter: 0.45 μm, | 0.18 (as silver) |

-continued

| | |
|---|---|
| variation coefficient of the corresponding sphere diameter: 23%, tabular grains, diameter/thickness ratio: 2.0) | |
| Gelatin | 0.77 |
| ExS-1 | $2.4 \times 10^{-4}$ |
| ExS-2 | $1.4 \times 10^{-4}$ |
| ExS-5 | $2.3 \times 10^{-4}$ |
| ExS-4 | $4.1 \times 10^{-6}$ |
| ExC-1 | 0.09 |
| ExC-2 | $4.0 \times 10^{-2}$ |
| ExC-3 | $8.0 \times 10^{-2}$ |
| EXC-5 | 0.08 |
| Third Layer: | |
| Medium Speed Red-Sensitive Emulsion Layer | |
| Silver Iodobromide Emulsion (6.0 mol % AgI, high internal AgI type having a core/shell ratio of 1/2, corresponding sphere diameter: 0.65 μm, variation coefficient of the corresponding sphere diameter: 23%, tabular grains, diameter/thickness ratio: 2.0) | 0.80 (as silver) |
| Gelatin | 1.46 |
| ExS-1 | $2.4 \times 10^{-4}$ |
| ExS-2 | $1.4 \times 10^{-4}$ |
| ExS-5 | $2.4 \times 10^{-4}$ |
| ExS-7 | $4.3 \times 10^{-6}$ |
| ExC-1 | 0.19 |
| ExC-2 | $2.0 \times 10^{-2}$ |
| ExC-3 | 0.10 |
| ExC-5 | 0.19 |
| ExC-6 | $2.0 \times 10^{-2}$ |
| ExM-3 | $2.0 \times 10^{-2}$ |
| UV-2 | $5.7 \times 10^{-2}$ |
| UV-3 | $5.7 \times 10^{-2}$ |
| Fourth Layer: | |
| High Speed Red-Sensitive Emulsion Layer | |
| Silver Iodobromide Emulsion (9.3 mol % AgI, multiple structure grains having a silver amount ratio of 3/4/2, AgI content ratio: 24 mol %/0 mol %/6 mol % (from the internal portion), corresponding sphere diameter: 0.75 μm, variation coefficient of the corresponding sphere diameter 23%, tabular grains, diameter/thickness ratio: 2.5) | 1.49 (as silver) |
| Gelatin | 1.38 |
| ExS-1 | $2.0 \times 10^{-4}$ |
| ExS-2 | $1.1 \times 10^{-4}$ |
| ExS-5 | $1.9 \times 10^{-4}$ |
| ExS-7 | $1.4 \times 10^{-5}$ |
| ExC-1 | $8.0 \times 10^{-2}$ |
| ExC-4 | $9.0 \times 10^{-2}$ |
| ExC-6 | $2.0 \times 10^{-2}$ |
| Solv-1 | 0.20 |
| Solv-2 | 0.53 |
| Fifth Layer: Intermediate Layer | |
| Gelatin | 0.62 |
| Cpd-1 | 0.13 |
| Polyethylacrylate Latex | $8.0 \times 10^{-2}$ |
| Solv-1 | $8.0 \times 10^{-2}$ |
| Sixth Layer: | |
| Low Speed Green-Sensitive Emulsion Layer | |
| Silver Iodobromide Emulsion (4.0 mol % AgI, uniform AgI type, corresponding sphere diameter: 0.33 μm, variation coefficient of the corresponding sphere diameter: 37%, tabular grains, diameter/thickness ratio: 2.0) | 0.19 (as silver) |
| Gelatin | 0.44 |
| ExS-3 | $1.5 \times 10^{-4}$ |
| ExS-4 | $4.4 \times 10^{-4}$ |
| ExS-5 | $9.2 \times 10^{-5}$ |
| ExM-1 | 0.17 |
| ExM-3 | $3.0 \times 10^{-2}$ |
| Solv-1 | 0.13 |
| Solv-4 | $1.0 \times 10^{-2}$ |
| Seventh Layer: | |
| Medium Speed Green-Sensitive Emulsion Layer | |
| Silver Iodobromide Emulsion (4.0 mol % AgI, uniform AgI type, corresponding sphere diameter: 0.55 μm, variation coefficient of the corresponding sphere diameter: 15%, tabular grains, diameter/thickness ratio: 4.0) | 0.24 (as silver) |
| Gelatin | 0.54 |
| ExS-3 | $2.1 \times 10^{-4}$ |
| ExS-4 | $6.3 \times 10^{-4}$ |
| ExS-5 | $1.3 \times 10^{-4}$ |
| ExM-1 | 0.15 |
| ExM-3 | $4.0 \times 10^{-2}$ |
| ExY-1 | $3.0 \times 10^{-2}$ |
| Solv-1 | 0.13 |
| Solv-4 | $1.0 \times 10^{-2}$ |
| Eighth Layer: | |
| High Speed Green-Sensitive Emulsion Layer | |
| Silver Iodobromide Emulsion (8.8 mol % AgI, multiple structure grains having a silver amount ratio of 3/4/2, AgI content ratio: 24 mol %/0 mol %/3 mol % (from the internal portion), corresponding sphere diameter: 0.75 μm, variation coefficient of the corresponding sphere diameter: 23%, tabular grains, diameter/thickness ratio: 1.6) | 0.49 (as silver) |
| Gelatin | 0.61 |
| ExS-4 | $4.3 \times 10^{-4}$ |
| ExS-5 | $8.6 \times 10^{-5}$ |
| ExS-8 | $2.8 \times 10^{-5}$ |
| ExM-1 | $8.0 \times 10^{-2}$ |
| ExM-2 | $3.0 \times 10^{-2}$ |
| ExY-1 | $3.0 \times 10^{-2}$ |
| ExC-1 | $1.0 \times 10^{-2}$ |
| ExC-4 | $1.0 \times 10^{-2}$ |
| Solv-1 | 0.23 |
| Solv-2 | $5.0 \times 10^{-2}$ |
| Solv-4 | $1.0 \times 10^{-2}$ |
| Cpd-8 | $1.0 \times 10^{-2}$ |
| Ninth Layer: Intermediate Layer | |
| Gelatin | 0.56 |
| Cpd-1 | $4.0 \times 10^{-2}$ |
| Polyethylacrylate Latex | $5.0 \times 10^{-2}$ |
| Solv-1 | $3.0 \times 10^{-2}$ |
| UV-4 | $3.0 \times 10^{-2}$ |
| UV-5 | $4.0 \times 10^{-2}$ |
| Tenth Layer: Donor Layer Having an Interlayer Effect against Red-Sensitive Layer | |
| Silver Iodobromide Emulsion (8.0 mol % AgI, high internal AgI type having a core/shell ratio of 1/2, corresponding sphere diameter: 0.65 μm, variation coefficient of the corresponding sphere diameter: 25%, tabular grains, diameter/thickness ratio: 2.0) | 0.67 (as silver) |
| Silver Iodobromide Emulsion (4.0 mol % AgI, uniform AgI type, corresponding sphere diameter: 0.4 μm, variation coefficient of the corresponding sphere diameter: 30%, tabular grains, diameter/thickness ratio: 3) | 0.20 (as silver) |
| Gelatin | 0.87 |
| ExS-3 | $6.7 \times 10^{-4}$ |
| ExM-4 | 0.16 |
| Solv-1 | 0.30 |
| Solv-6 | $3.0 \times 10^{-2}$ |
| Eleventh Layer: Yellow Filter Layer | |
| Yellow Colloidal Silver | $9.0 \times 10^{-2}$ (as silver) |
| Gelatin | 0.84 |
| Cpd-2 | 0.13 |
| Solv-1 | 0.13 |
| Cpd-1 | $8.0 \times 10^{-2}$ |
| Cpd-6 | $2.0 \times 10^{-3}$ |
| H-1 | 0.25 |
| Twelfth Layer: | |
| Low Speed Blue-Sensitive Emulsion Layer | |
| Silver Iodobromide Emulsion (4.5 mol % AgI, uniform AgI type, corresponding sphere diameter: 0.7 μm, variation coefficient of the corresponding sphere diameter: 15%, tabular grains, | 0.50 (as silver) |

-continued

| | |
|---|---|
| diameter/thickness ratio: 7.0) | |
| Silver Iodobromide Emulsion (3.0 mol % AgI, uniform AgI type, corresponding sphere diameter: 0.3 μm, variation coefficient of the corresponding sphere diameter: 30%, tabular grains, diameter/thickness ratio: 7.0) | 0.30 (as silver) |
| Gelatin | 2.18 |
| ExS-6 | $9.0 \times 10^{-4}$ |
| ExC-1 | 0.14 |
| ExY-2 | 0.17 |
| ExY-3 | 1.09 |
| Solv-1 | 0.54 |
| Thirteenth Layer: Intermediate Layer | |
| Gelatin | 0.40 |
| ExY-4 | 0.19 |
| Solv-1 | 0.19 |
| Fourteenth Layer: High Speed Blue-Sensitive Emulsion Layer | |
| Silver Iodobromide Emulsion (10.0 mol % AgI, high internal AgI type, corresponding sphere diameter: 1.0 μm, variation coefficient of the corresponding sphere diameter: 25%, multiple twinned tabular grains, diameter/thickness ratio: 2.0) | 0.40 (as silver) |
| Gelatin | 0.49 |
| ExS-6 | $2.6 \times 10^{-4}$ |
| ExY-2 | $1.0 \times 10^{-2}$ |
| ExY-3 | 0.20 |
| ExC-1 | $1.0 \times 10^{-2}$ |
| Solv-1 | $9.0 \times 10^{-2}$ |
| Fifteenth Layer: First Protective Layer | |
| Fine Grain Silver Iodobromide Emulsion (2.0 mol % AgI, uniform AgI type, corresponding shere diameter: 0.07 μm) | 0.12 (as silver) |
| Gelatin | 0.63 |
| UV-4 | 0.11 |
| UV-5 | 0.18 |
| Solv-5 | $2.0 \times 10^{-2}$ |
| Cpd-5 | 0.10 |
| Polyethylacrylate Latex | $9.0 \times 10^{-2}$ |
| Sixteenth Layer: Second Protective Layer | |
| Fine Grain Silver Iodobromide Emulsion (0.2 mol % AgI, uniform AgI type, corresponding sphere diameter: 0.07 μm) | 0.36 (as silver) |
| Gelatin | 0.85 |
| B-1 (diameter: 1.5 μm) | $8.0 \times 10^{-2}$ |
| B-2 (diameter: 1.5 μm) | $8.0 \times 10^{-2}$ |
| B-3 | $2.0 \times 10^{-2}$ |
| W-4 | $2.0 \times 10^{-2}$ |
| H-1 | 0.18 |

Into the thus obtained samples, 1,2-benzisothiazoline-3-one (amount: about 200 ppm based on gelatin), n-butyl-p-hydroxybenzoate (amount: about 1,000 ppm based on gelatin) and 2-phenoxyethanol (amount: 10,000 ppm based on gelatin) were further added. Furthermore, Additives B-4, B-5, F-1, F-2, F-3, F-4, F-5, F-6, F-7, F-8, F-9, F-10, F-11 and F-12, an iron salt, a lead salt, an aurum salt, a platinum salt, an iridium salt, and a rhodium salt were further added to the sample obtained according to the above.

Further, Surfactants W-1, W-2 and W-3 were added to each layer as a coating aid or emulsion dispersant.

UV-1

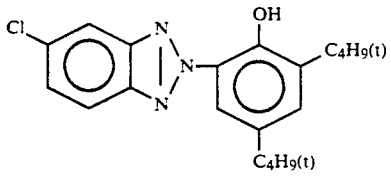

UV-2

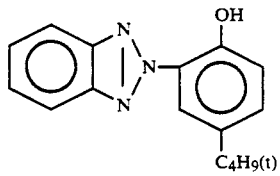

UV-3

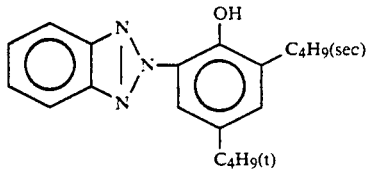

UV-4

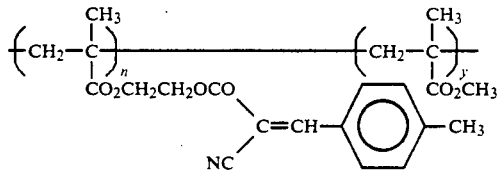

x:y = 70:30 (wt %)

UV-5

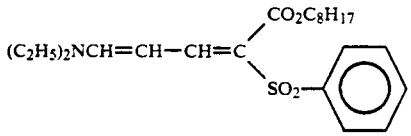

Tricresyl Phosphate — Solv-1

Dibutyl Phthalate — Solv-2

Solv-4

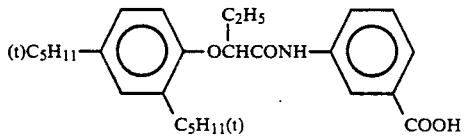

Trihexyl Phosphate — Solv-5

Solv-6

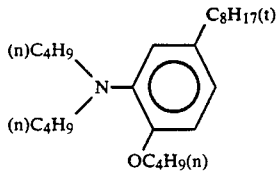

-continued
ExF-1
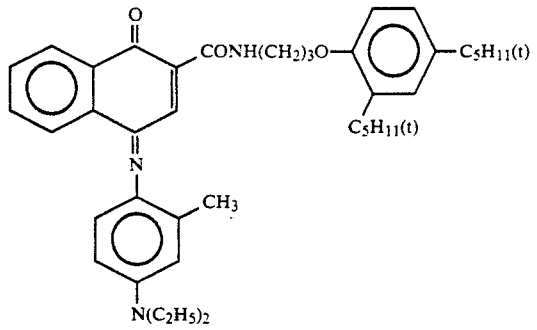
ExF-2
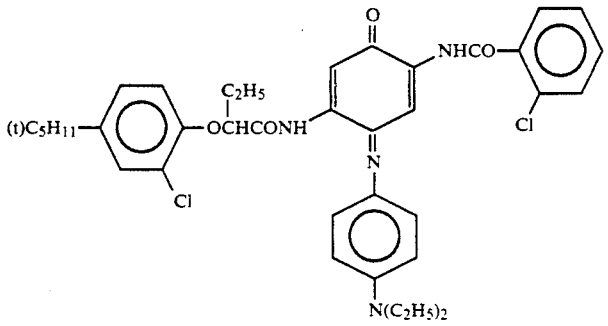
ExF-3
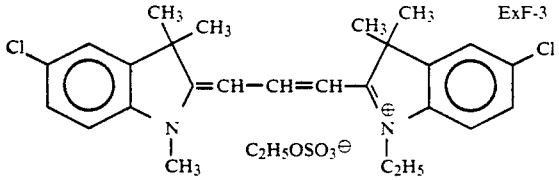
ExC-1
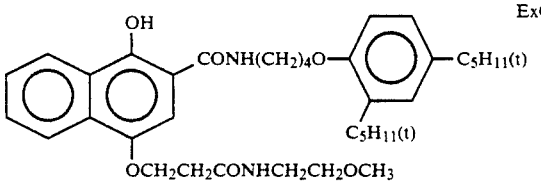
ExC-2
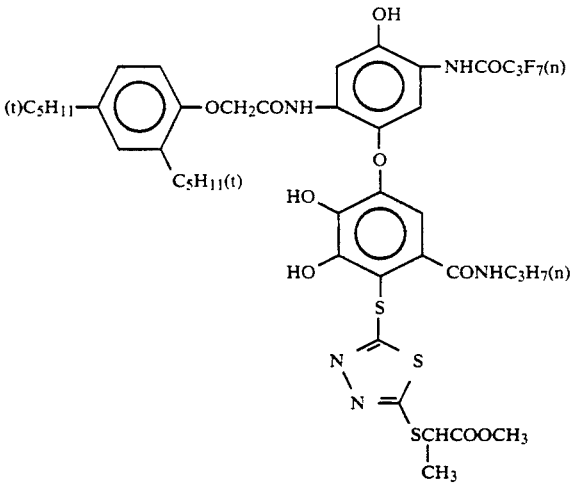
ExC-3
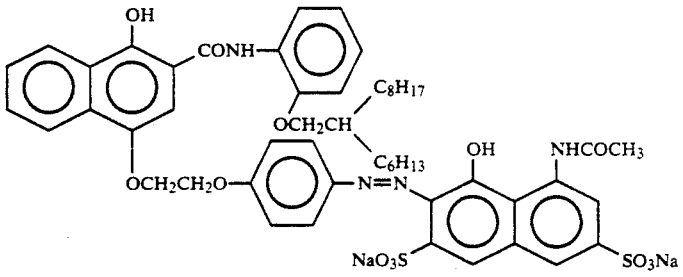

-continued
ExC-4
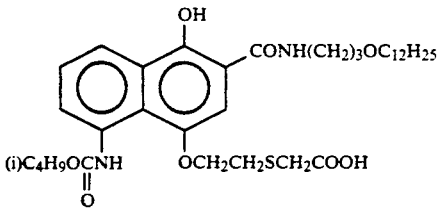
ExC-5
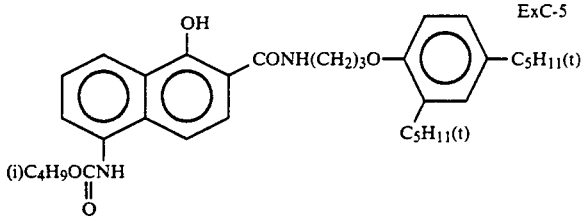
ExC-6
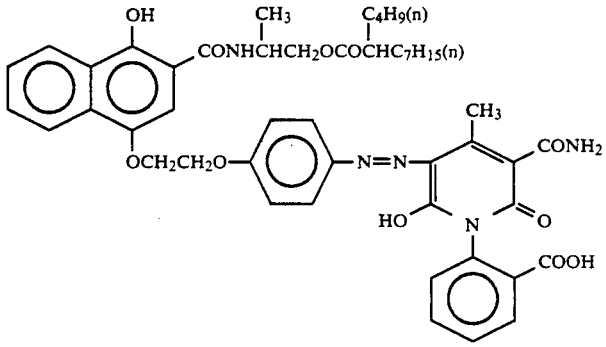
ExM-1
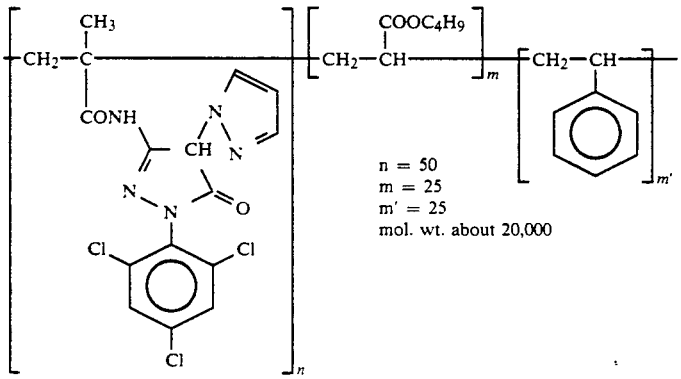
ExM-2
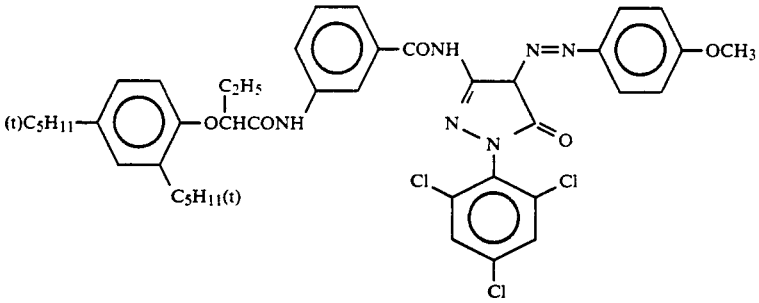
ExM-3
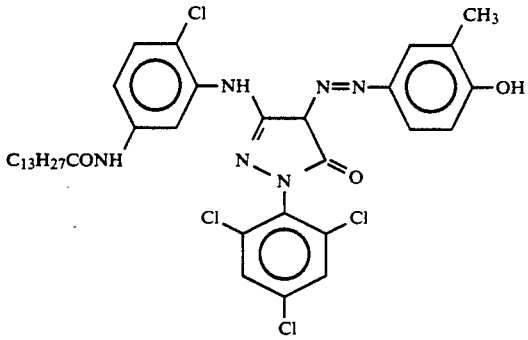

-continued
ExM-4
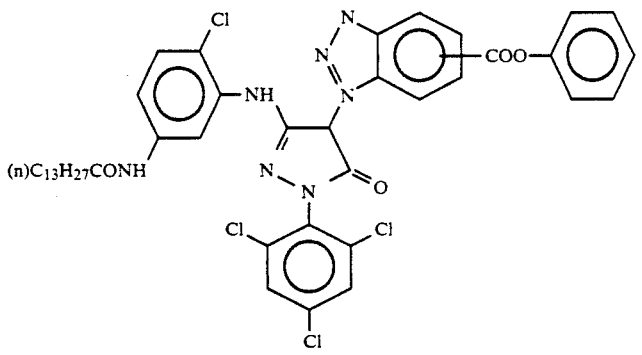
ExY-1
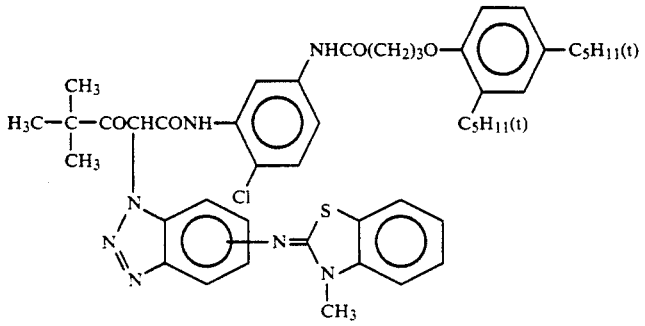
ExY-2
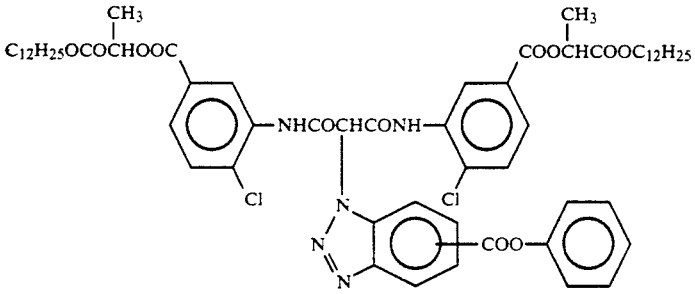
ExY-3
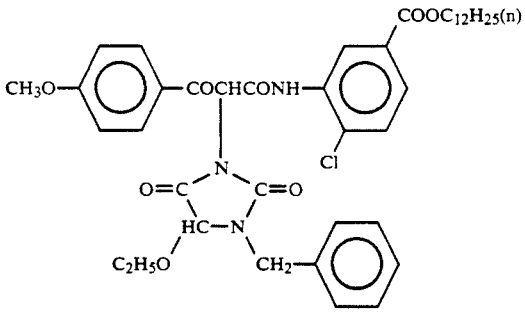
ExY-4
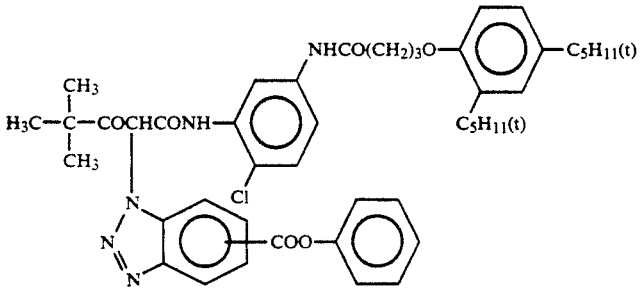

-continued
Cpd-1
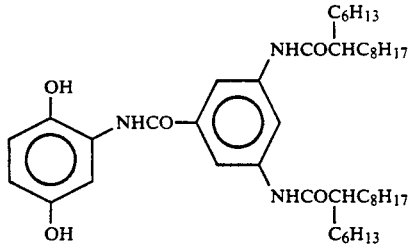
Cpd-2
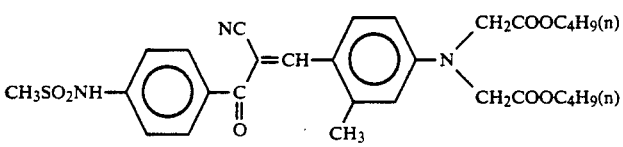
Cpd-5
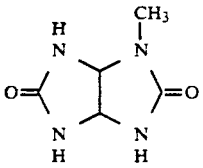
Cpd-6
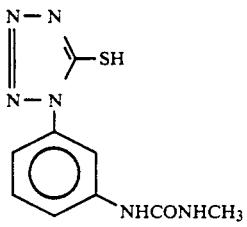
Cpd-8
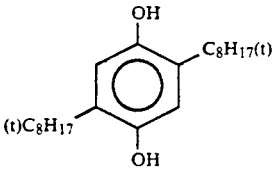
H-1
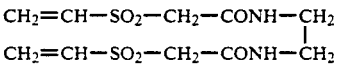
W-1
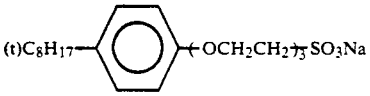
W-2
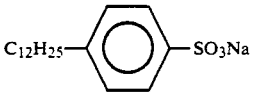
W-3
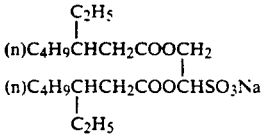
W-4
$C_8F_{17}SO_2N(C_3H_7)CH_2COOK$
ExS-1
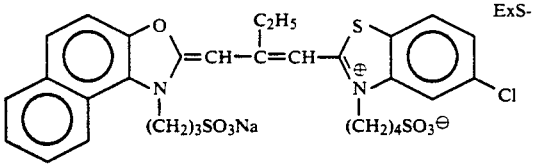
ExS-2
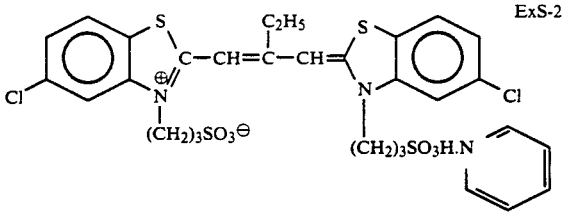
ExS-3
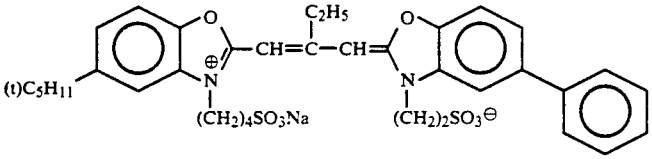
ExS-4
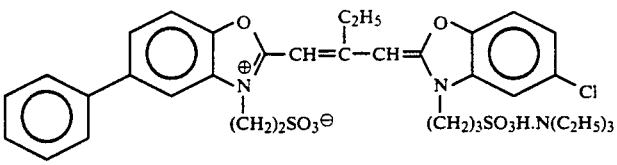

-continued
ExS-5
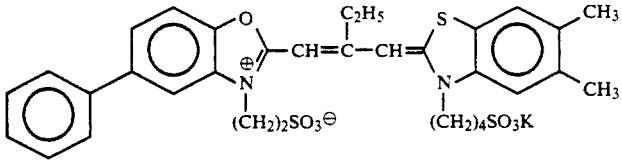
ExS-6
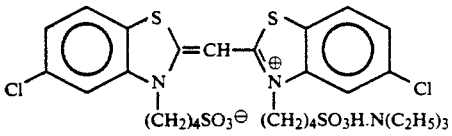
ExS-7
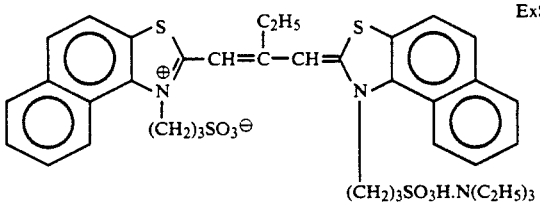
ExS-8
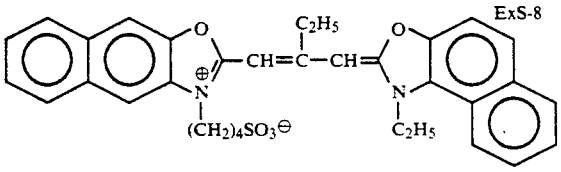
F-1
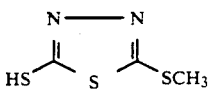
F-2
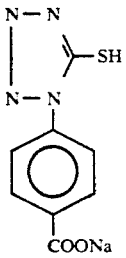
F-3
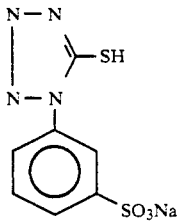
F-4
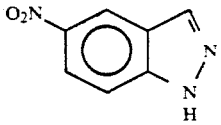
F-5
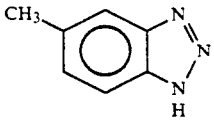
F-6
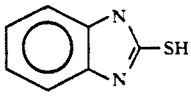
F-7
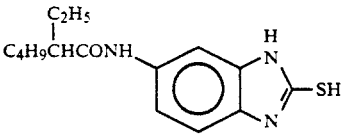
F-8
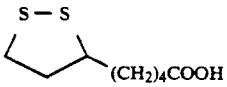
F-9
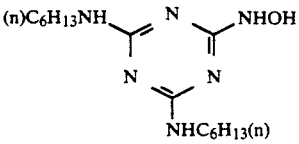
F-10
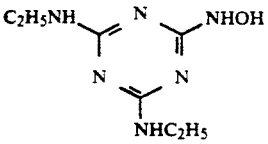
F-11
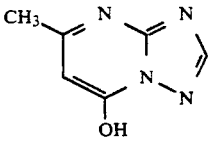
F-12
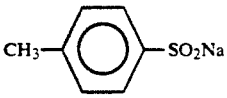
B-1
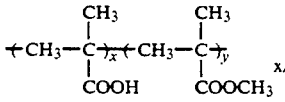
x/y = 10/90 (by weight)

-continued

B-2

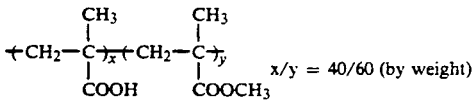

x/y = 40/60 (by weight)

B-3

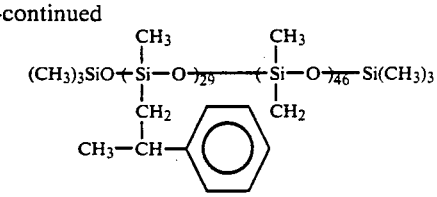

B-4

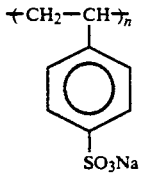

B-5

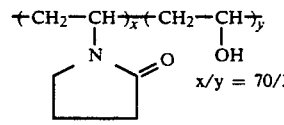

x/y = 70/30 (by weight)

The sample prepared was cut to a width of 35 mm and finished and then subjected to wedge exposure with white light (light source color temperature: 4,800° K.), after which it was processed using an automatic processor for motion picture film with the processing operations indicated below. However, the samples for evaluation were processed after processing the (photosensitive material) sample which had been subjected to imagewise exposure until the total replenishment of the color developer had reached three times the volume of the developer (development solution) in the development tank.

The aeration conditions of the bleaching solution were such that bubbles were being introduced at the rate of 200 ml per minute from pipe work which was provided with a plurality of fine holes having a diameter of 0.2 mm and which was located at the bottom of the bleach tank.

| | Processing Operations | | | |
|---|---|---|---|---|
| Process | Processing Time | Processing Temperature (°C.) | Replenishment Rate* (ml) | Tank Capacity (liter) |
| Color Development | 3 min 15 sec | 37.8 | 23 | 10 |
| Bleaching | 25 sec | 38.0 | 5 | 5 |
| Fixing | 1 min 40 sec | 38.0 | 30 | 10 |
| Water Washing (1) | 30 sec | 38.0 | | 5 |
| Water Washing (2) | 20 sec | 38.0 | 30 | 5 |
| Stabilization | 20 sec | 38.0 | 20 | 5 |
| Drying | 1 min | 55 | — | — |

*Replenishment rate per meter of 35 mm wide material. Water washing process was a countercurrent system of from (2) to (1).

Moreover, the carry-over of developer into the bleaching process and the carry-over of fixer into the water washing process were 2.0 ml per meter length of photosensitive material of width 35 mm, respectively.

Furthermore, the crossover times were 5 seconds, and this time is included in the processing time for the preceding process.

The compositions of the processing solutions are indicated below.

| | Mother Liquor | Replenisher |
|---|---|---|
| Color Development Solution | | |
| Diethylenetriaminepentaacetic Acid | 1.0 g | 1.1 g |
| 1-Hydroxyethylidene-1,1- | 3.0 g | 3.2 g |

-continued

| | Mother Liquor | Replenisher |
|---|---|---|
| diphosphonic Acid | | |
| Sodium Sulfite | 4.0 g | 4.9 g |
| Potassium Carbonate | 30.0 mg | 30.0 g |
| Potassium Bromide | 1.4 g | — |
| Potassium Iodide | 1.5 mg | — |
| Hydroxylamine Sulfate | 2.4 g | 3.6 g |
| 4-(N-Ethyl-N-β-hydroxyethylamino)-2-methylaniline Sulfate | 4.5 g | 6.4 g |
| Water to make | 1.0 liter | 1.0 liter |
| pH | 10.05 | 10.10 |
| Bleaching Solution | | |
| Ferric Nitrate | 0.20 mol | 0.30 mol |
| Chelating Compound according to the Present Invention (see Table 5) | 0.31 mol | 0.47 mol |
| Ammonium Bromide | 100 g | 150 g |
| Ammonium Nitrate | 20 g | 30 g |
| Acetic Acid | 0.72 mol | 1.09 mol |
| Water to make | 1.0 liter | 1.0 liter |
| pH | 4.0 | 3.8 |

Here, a chelating compound signifies a compound which forms a metal salt with a ferric chelating compound which is used as a bleaching agent.

| Fixing Solution (mother liquor (tank solution) equals replenisher) | |
|---|---|
| Ethylenediaminetetraacetic Acid Diammonium Salt | 1.7 g |
| Ammonium Sulfite | 14.0 g |
| Aqueous Ammonium Thiosulfate Solution (700 g/liter) | 260.0 ml |
| Water to make | 1.0 liter |
| pH | 7.0 |

Water Washing Water (Mother Liquor Equals Replenisher)

Town water was passed through a mixed bed column which had been packed with an H-type strongly acidic cation exchange resin ("Amberlite IR-120B", manufactured by the Rohm and Haas Co.) and an OH-type strongly basic anion exchange resin ("Amberlite IRA-400", manufactured by the same company) and treated so that the calcium and magnesium ion concentrations were not more than 3 mg/liter, after which 20 mg/liter of sodium dichloroisocyanurate and 150 mg/liter of sodium sulfate were added.

The pH of this liquid was within the range of from 6.5 to 7.5.

| Stabilizing Solution (mother liquor equals replenisher) | |
|---|---|
| Formalin (37 wt % aq. soln. of formaldehyde) | 1.2 mg |
| Surfactant [$C_{10}H_{21}$—O—$(CH_2CH_2O)_{10}$—H] | 0.4 g |
| Ethylene Glycol | 1.0 g |
| Water to make | 1.0 liter |
| pH | 5.0–7.0 |

The amount of residual silver in the region of maximum color density of each photosensitive material which had been processed in the way described above was measured by fluorescence X-ray analysis. The results obtained are shown in Table 5.

Furthermore, the processed samples so obtained were subjected to density measurements, and the value measured by red light (R light) for color density $D_R$ at the maximum color density portion was read off in each case from the characteristic curve.

Next, the bleaching composition was changed to the processing solution formulation indicated below as a standard bleaching solution which gave no failure of color restoration, and processing was carried out without modification except that the bleach processing time was set at 600 seconds, the bleach processing temperature was 38° C. and the replenishment rate for the bleach processing solution was 25 ml per 1 meter length of photosensitive material of width 35 mm.

| Standard Bleaching Solution | Mother Liquor | Replenisher |
|---|---|---|
| Ethylenediaminetetraacetic Acid Ferric Sodium Salt Trihydrate | 100.0 g | 120.0 g |
| Ethylenediaminetetraacetic Acid Disodium Salt | 10.0 g | 11.0 g |
| Ammonium Bromide | 140 g | 140 g |
| Ammonium Nitrate | 30.0 g | 35.0 g |
| Aqueous Ammonia (27 wt %) | 6.5 ml | 4.0 ml |
| Water to make | 1.0 liter | 1.0 liter |
| pH | 6.0 | 5.7 |

The processed material sample obtained using the above mentioned standard bleaching solution was subjected to the density measurement described above, and the $D_R$ value was read off from the characteristic curves.

The $D_R$ value obtained in this way with the standard bleaching solution was 2.1, which was taken as the standard, and the difference, $\Delta D_R$, between this standard $D_R$ value and each of the other $D_R$ values was obtained.

The amount of failure of color restoration was determined according to the following equation:

Failure of Color Restoration ($\Delta D_R$) =

($D_R$ in standard bleaching solution) − ($D_R$ for each sample)

The results obtained are shown in Table 5.

Next, the change in gradation on storing the samples after processing was obtained, using these samples, from the change in gradation measured before and after storage under the conditions indicated below.

The gradation ($\gamma_G$) means the difference between the color density ($D_{G1}$)measured by green light (G light) at the point giving 1/10 of exposure amounts where the maximum color density measured by G light is obtained from the characteristic curve, and the color density ($D_{G2}$)measured at the point giving 1/1,000 of exposure amounts where the maximum color density is obtained.

The gradation ($\gamma_G$) and change of gradation ($\Delta\gamma_G$) were determined according to the following equation:

Gradation ($\gamma_G$)$=D_{G1}-D_{G2}$

Storage Conditions (dark, hot, and humid):60° C., 70% RH, 4 weeks

Change of Gradation ($\Delta\gamma_G$)=($\gamma_G$ after storage)−($\gamma_G$ before storage)

The results obtained are shown in Table 5.

TABLE 5

| Compound | Residual Silver Amount ($\mu g/cm^2$) | Failure of Color Restoration ($\Delta D_R$) | Change of Gradation ($\Delta\gamma_G$) | Remarks |
|---|---|---|---|---|
| Comparative Compound A | 60.5 | 0.10 | 0.15 | Comparison |
| Comparative Compound B | 13.8 | 0.27 | 0.30 | " |
| Comparative Compound E | 30.0 | 0.41 | 0.15 | " |
| B-25 | 13.0 | 0.11 | 0.02 | Invention |
| B-51 | 9.9 | 0.05 | 0.04 | " |
| B-64 | 11.8 | 0.10 | 0.03 | " |

Comparative Compound E

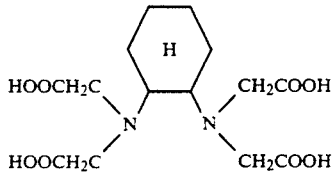

As is apparent from the results of Table 5, the samples of the present invention are superior to the comparative samples with respect to the residual silver amount, failure of color restoration ($\Delta D_R$) and change of gradation ($\Delta\gamma_G$) in color image after processing and storage.

EXAMPLE 6

Sample 102 of Example 5 was processed in the same way as in Example 5 except that the bleach processing time was varied as shown in Table 6.

The processed samples were measured in the same way as in Example 5 with respect to the failure of color restoration ($\Delta D_R$).

The samples were processed with the bleaching solution mother liquor containing an acetic acid in an amount of 0.72 mol. The results are shown in Table 6.

TABLE 6

| | Failure of Color Restoration ($\Delta D_R$) | | | | |
|---|---|---|---|---|---|
| | Bleach Processing Time (sec) | | | | |
| Compound | 20 | 30 | 50 | 100 | Remarks |
| Comparative Compound B* | 0.30 | 0.25 | 0.10 | 0.03 | Comparison |
| B-51 | 0.06 | 0.04 | 0.02 | 0.00 | Invention |

*Comparative Compound B is the same as in Example 1.

As is apparent from the results of Table 6, the sample of the present invention is superior to the comparative sample with respect to the failure of color restoration in the rapid bleach processing.

EXAMPLE 7

Sample 103, a multilayer color photosensitive material comprising layers having the compositions indicated below on a cellulose triacetate film support having a subbing layer, was prepared.

Composition of the Photosensitive Layer

The coated weights of silver halide and colloidal silver are shown in units of $g/m^2$ as silver, the coated weights of couplers, additives and gelatin are shown in units of $g/m^2$, and the coated weights of sensitizing dyes are shown as the number of mols per mol of silver halide in the same layer. The meaning of symbols for additives are shown below. When the additives have plural functions, the symbols are shown as the additives for the most typical function.

UV: Ultraviolet Absorbers
Solv: High Boiling Point Organic Solvents
ExF: Dyes
ExS: Sensitizing Dyes
ExC: Cyan Couplers
ExM: Magenta Couplers
ExY: Yellow Couplers
Cpd: Additives
W: Surfactants
H: Film Hardening Agents

| | |
|---|---|
| First Layer: Antihalation Layer | |
| Black Colloidal Silver | 0.20 (as silver) |
| Gelatin | 2.20 |
| UV-1 | 0.11 |
| UV-2 | 0.20 |
| Cpd-1 | $4.0 \times 10^{-2}$ |
| Cpd-2 | $1.9 \times 10^{-2}$ |
| Solv-1 | 0.30 |
| Solv-2 | $1.2 \times 10^{-2}$ |
| Second Layer: Intermediate Layer | |
| Fine Grain Silver Iodobromide Emulsion (1.0 mol % AgI, corresponding sphere diameter: 0.07 μm | 0.15 (as silver) |
| Gelatin | 1.00 |
| ExC-4 | $6.0 \times 10^{-2}$ |
| Cpd-3 | $2.0 \times 10^{-2}$ |
| Third Layer: First Red-Sensitive Emulsion Layer | |
| Silver Iodobromide Emulsion (5.0 mol % AgI, high surface AgI type, corresponding sphere diameter: 0.9 μm, variation coefficient of the corresponding sphere diameter: 21%, tabular grains, diameter/thickness ratio: 7.5) | 0.42 (as silver) |
| Silver Iodobromide Emulsion (4.0 mol % AgI, high internal AgI type, corresponding sphere diameter: 0.4 μm, variation coefficient of the corresponding sphere diameter: 18%, tetradecahedral grains) | 0.40 (as silver) |
| Gelatin | 1.90 |
| ExS-1 | $4.5 \times 10^{-4}$ |
| ExS-2 | 1.5 × 10-4 |
| ExS-3 | $4.0 \times 10^{-5}$ |
| ExC-1 | 0.65 |
| ExC-3 | $1.0 \times 10^{-2}$ |
| EXC-4 | $2.3 \times 10^{-2}$ |
| Solv-1 | 0.32 |
| Gelatin | 1.20 |
| ExS-1 | $2.0 \times 10^{-4}$ |
| ExS-2 | $6.0 \times 10^{-5}$ |
| ExS-3 | $2.0 \times 10^{-5}$ |
| ExC-2 | $8.5 \times 10^{-2}$ |
| ExC-5 | $7.3 \times 10^{-2}$ |
| ExC-6 | $1.0 \times 10^{-2}$ |
| Solv-1 | 0.12 |
| Solv-2 | 0.12 |
| Sixth Layer: Intermediate Layer | |

-continued

| | |
|---|---|
| Gelatin | 1.00 |
| Cpd-4 | $8.0 \times 10^{-2}$ |
| Solv-1 | $8.0 \times 10^{-2}$ |
| Seventh Layer: First Green-Sensitive Emulsion Layer | |
| Silver Iodobromide Emulsion (5.0 mol % AgI, high surface AgI type, corresponding sphere diameter: 0.9 μm, variation coefficient of the corresponding sphere diameter: 21%, tabular grains, diameter/thickness ratio: 7.0) | 0.28 (as silver) |
| Silver Iodobromide Emulsion (4.0 mol % AgI, high internal AgI type, corresponding sphere diameter: 0.4 μm, variation coefficient of the corresponding sphere diameter: 18%, tetradecahedral grains) | 0.16 (as silver) |
| Fourth Layer: Second Red-Sensitive Emulsion Layer | |
| Silver Iodobromide Emulsion (8.5 mol % AgI, high internal AgI type, corresponding sphere diameter: 1.0 μm, variation coefficient of the corresponding sphere diameter: 25%, tabular grains, diameter/thickness ratio: 3.0) | 0.85 (as silver) |
| Gelatin | 0.91 |
| ExS-1 | $3.0 \times 10^{-4}$ |
| ExS-2 | $1.0 \times 10^{-4}$ |
| ExS-3 | $3.0 \times 10^{-5}$ |
| ExC-1 | 0.13 |
| ExC-2 | $6.2 \times 10^{-2}$ |
| ExC-4 | $4.0 \times 10^{-2}$ |
| ExC-6 | $3.0 \times 10^{-2}$ |
| Solv-1 | 0.10 |
| Fifth Layer: Third Red-Sensitive Emulsion Layer | |
| Silver Iodobromide Emulsion (11.3 mol % AgI, high internal AgI type, corresponding sphere diameter: 1.4 μm, variation coefficient of the corresponding sphere diameter: 28%, tabular grains, diameter/thickness ratio: 6.0) | 1.50 (as silver) |
| Gelatin | 1.20 |
| ExS-4 | $5.0 \times 10^{-4}$ |
| ExS-5 | $2.0 \times 10^{-4}$ |
| ExS-6 | $1.0 \times 10^{-4}$ |
| ExM-1 | 0.50 |
| ExM-2 | 0.10 |
| ExM-5 | $3.5 \times 10^{-2}$ |
| Solv-1 | 0.20 |
| Solv-3 | $3.0 \times 10^{-2}$ |
| Eighth Layer: Second Green-Sensitive Emulsion Layer | |
| Silver Iodobromide Emulsion (8.5 mol % AgI, high internal AgI type, corresponding sphere diameter: 1.0 μm, variation coefficient of the corresponding sphere diameter: 25%, tabular grains, diameter/thickness ratio: 3.0) | 0.57 (as silver) |
| Gelatin | 0.45 |
| ExS-4 | $3.5 \times 10^{-4}$ |
| ExS-5 | $1.4 \times 10^{-4}$ |
| ExS-6 | $7.0 \times 10^{-5}$ |
| ExM-1 | 0.12 |
| ExM-2 | $7.1 \times 10^{-3}$ |
| ExM-3 | $3.5 \times 10^{-2}$ |
| Solv-1 | 0.15 |
| Solv-3 | $1.0 \times 10^{-2}$ |
| Ninth Layer: Intermediate Layer | |
| Gelatin | 0.50 |
| Solv-1 | $2.0 \times 10^{-2}$ |
| Tenth Layer: Third Green-Sensitive Emulsion Layer | |
| Silver Iodobromide Emulsion (11.3 mol % AgI, high internal AgI type, corresponding sphere diameter: 1.4 μm, variation coefficient of the corresponding sphere diameter: 28%, tabular grains, diameter/thickness ratio: 6.0) | 1.30 (as silver) |
| Gelatin | 1.20 |
| ExS-4 | $2.0 \times 10^{-4}$ |
| ExS-5 | $8.0 \times 10^{-5}$ |
| ExS-6 | $8.0 \times 10^{-5}$ |
| ExM-4 | $5.8 \times 10^{-2}$ |
| ExM-6 | $5.0 \times 10^{-3}$ |
| ExC-2 | $4.5 \times 10^{-3}$ |

-continued

| | |
|---|---|
| Cpd-5 | $1.0 \times 10^{-2}$ |
| Solv-3 | 0.25 |
| Eleventh Layer: Yellow Filter Layer | |
| Gelatin | 0.50 |
| Cpd-6 | $5.2 \times 10^{-2}$ |
| Solv-1 | 0.12 |
| Twelfth Layer: Intermediate Layer | |
| Gelatin | 0.45 |
| Cpd-3 | 0.10 |
| Thirteenth Layer: First Blue-Sensitive Layer | |
| Silver Iodobromide Emulsion (2 mol % AgI, uniform AgI type, corresponding sphere diameter: 0.55 μm, variation coefficient of the corresponding sphere diameter: 25%, tabular grains, diameter/thickness ratio: 7.0) | 0.20 (as silver) |
| Gelatin | 1.00 |
| ExS-7 | $3.0 \times 10^{-4}$ |
| ExY-1 | 0.60 |
| ExY-2 | $2.3 \times 10^{-2}$ |
| Solv-1 | 0.15 |
| Fourteenth Layer: Second Blue-Sensitive Emulsion Layer | |
| Silver Iodobromide Emulsion (19.0 mol % AgI, high internal AgI type, corresponding sphere diameter: 1.0 μm, variation coefficient of the corresponding sphere diameter: 16%, octahedral grains) | 0.19 (as silver) |
| Gelatin | 0.35 |
| ExS-7 | $2.0 \times 10^{-4}$ |
| ExY-1 | 0.22 |
| Solv-1 | $7.0 \times 10^{-2}$ |
| Fifteenth Layer: Intermediate Layer | |
| Fine Grain Silver Iodobromide Emulsion (2 mol % AgI, uniform AgI type, corresponding sphere diameter: 0.13 μm) | 0.20 (as silver) |
| Gelatin | 0.36 |
| Sixteenth Layer: Third Blue-Sensitive Emulsion Layer | |
| Silver Iodobromide Emulsion (14.0 mol % AgI, high internal AgI type, corresponding sphere diameter: 1.7 μm, variation coefficient of the corresponding sphere diameter: 28%, tabular grains, diameter/thickness ratio: 5.0) | 1.55 (as silver) |
| Gelatin | 1.00 |
| ExS-8 | $1.5 \times 10^{-4}$ |
| ExY-1 | 0.21 |
| Solv-1 | $7.0 \times 10^{-2}$ |
| Seventeenth Layer: First Protective Layer | |
| Gelatin | 1.80 |
| UV-1 | 0.13 |
| UV-2 | 0.21 |
| Solv-1 | $1.0 \times 10^{-2}$ |
| Solv-2 | $1.0 \times 10^{-2}$ |
| Eighteenth Layer: Second Protective Layer | |
| Fine Grain Silver Iodobromide Emulsion (corresponding sphere diameter: 0.07 μm) | 0.36 (as silver) |
| Gelatin | 0.70 |
| B-1 (diameter: 1.5 μm) | $2.0 \times 10^{-2}$ |
| B-2 (diameter: 1.5 μm) | 0.15 |
| B-3 | $3.0 \times 10^{-2}$ |
| W-1 | $2.0 \times 10^{-2}$ |
| H-1 | 0.35 |
| Cpd-7 | 1.00 |

Into the thus obtained samples, 1,2-benzisothiazoline-3-one (amount: about 200 ppm based on gelatin), n-butyl-p-hydroxybenzoate (amount: about 1,000 ppm based on gelatin) and 2-phenoxyethanol (amount: 10,000 ppm based on gelatin) were further added. Furthermore, Additives B-4, B-5, W-2, W-3, F-1, F-2, F-3, F-4, F-5, F-6, F-7, F-8, F-9, F-10, F-11, F-12, and F-13, an iron salt, a lead salt, an aurum salt, a platinum salt, an iridium salt, and a rhodium salt were further added to the sample obtained according to the above.

UV-1

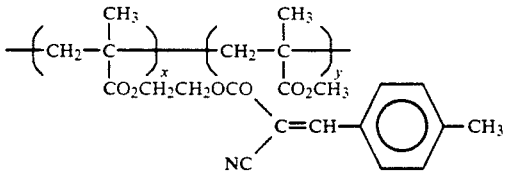

x/y/ = 7/3 (by weight)

UV-2

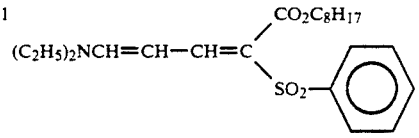

ExC-1

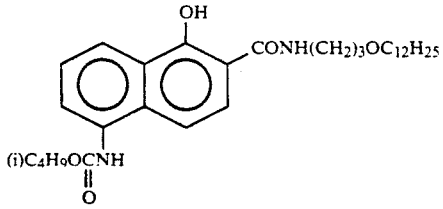

ExC-2

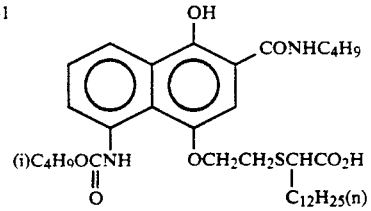

ExC-3

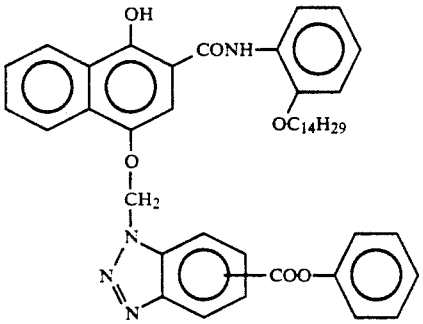

-continued
ExC-4
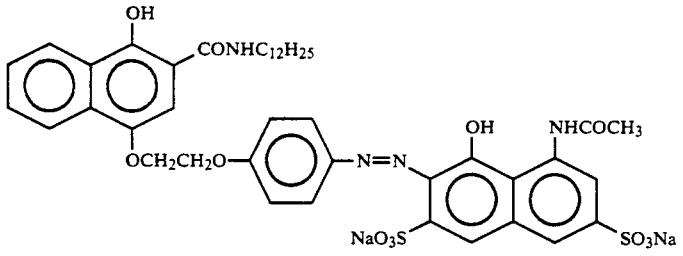
ExC-5
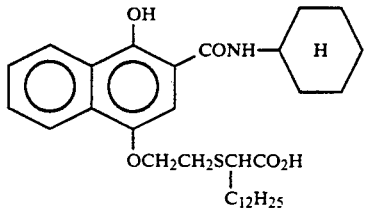
ExC-6
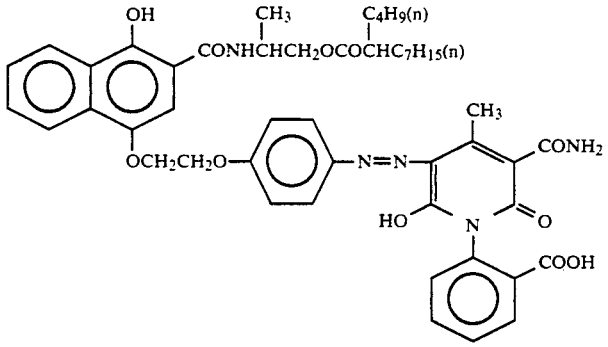
ExM-1
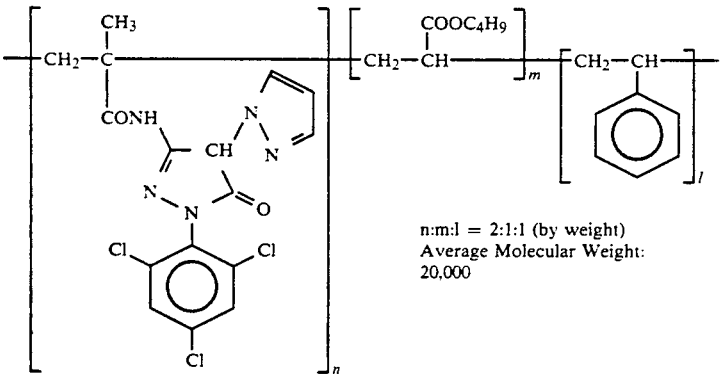
ExM-2
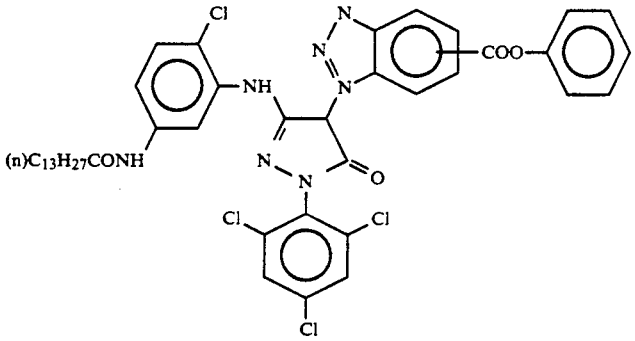

-continued
ExM-3
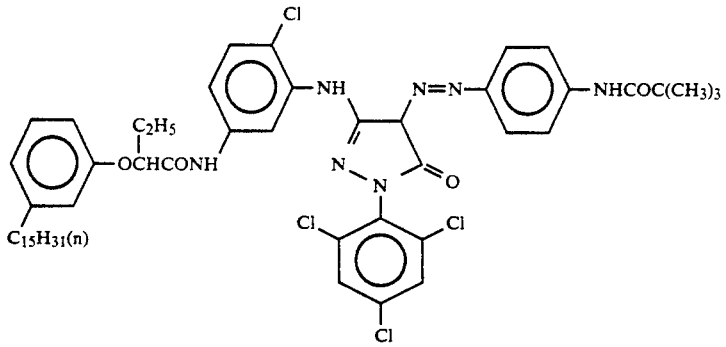
ExM-4
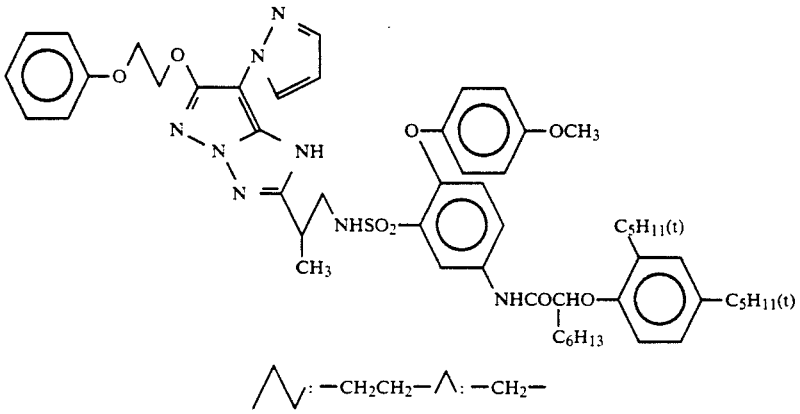
ExM-5
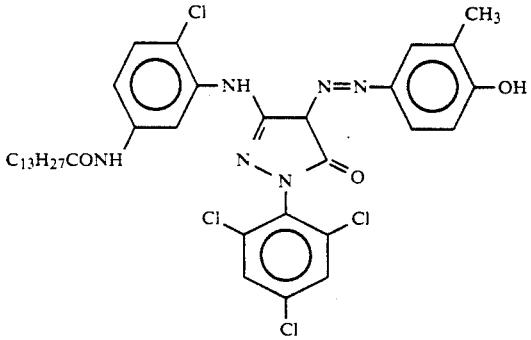
ExM-6
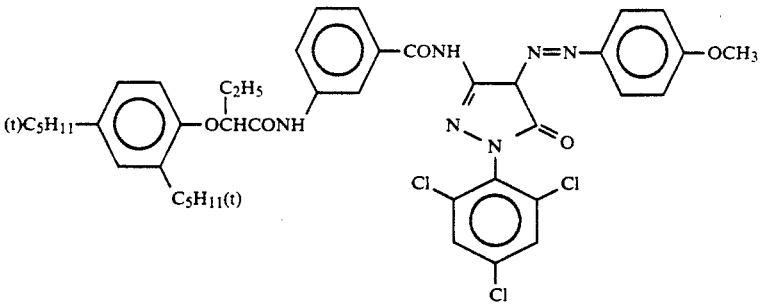
ExY-1
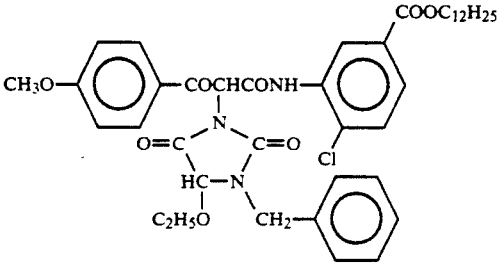

-continued
ExY-2
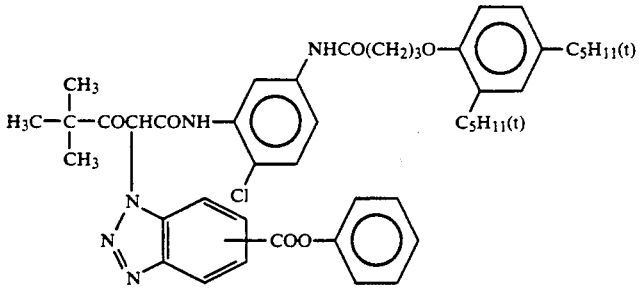
Cpd-1
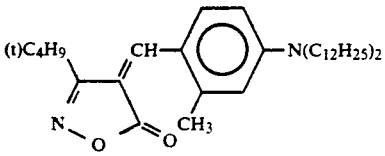
Cpd-2
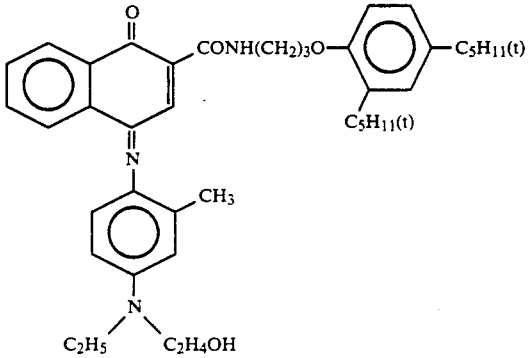
Cpd-3
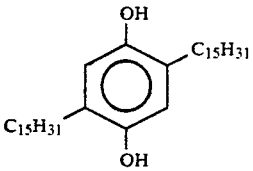
Cpd-4
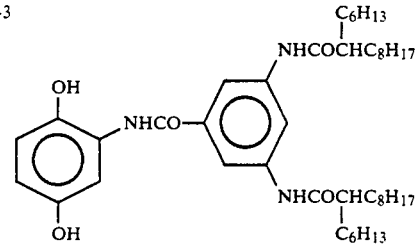
Cpd-5
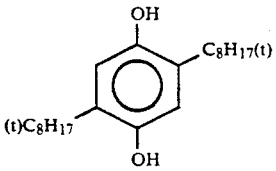
Cpd-6
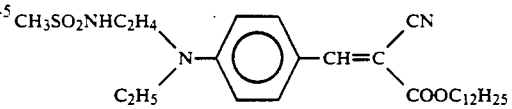
Cpd-7
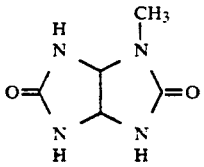
Solv-1
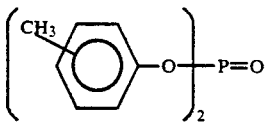
Solv-2
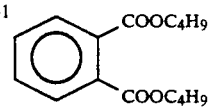
Solv-3
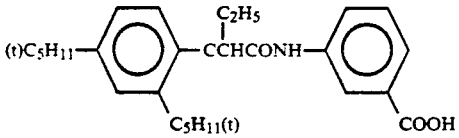
ExS-1
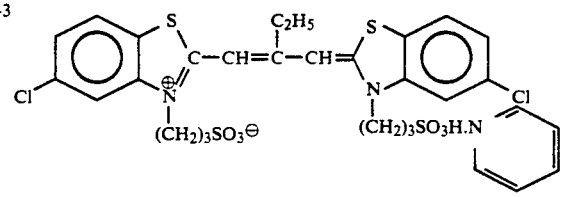

-continued
ExS-2
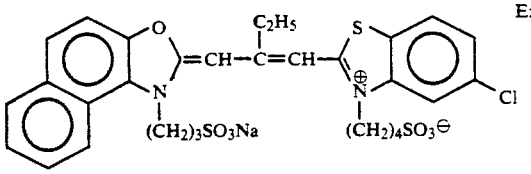
ExS-3
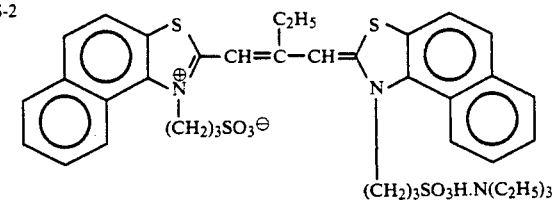
ExS-4
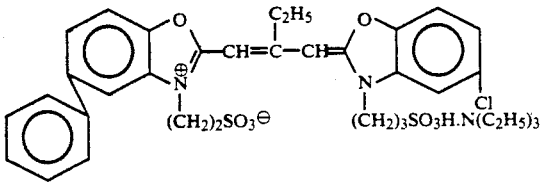
ExS-5
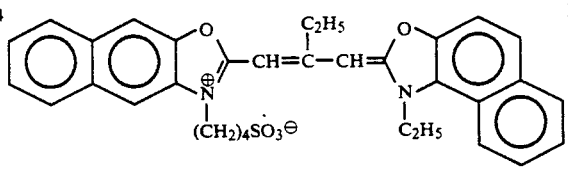
ExS-6
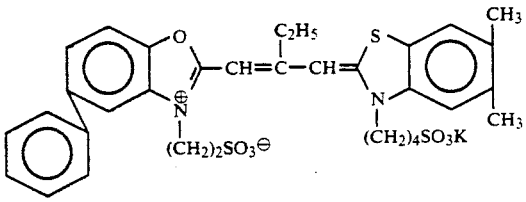
ExS-7
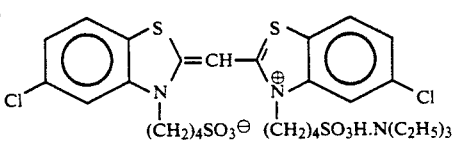
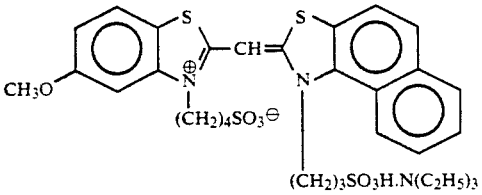
ExS-8
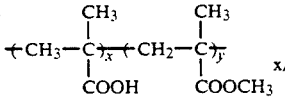
x/y = 10/90 (by weight)
B-1
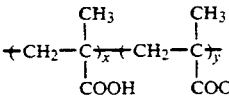
x/y = 40/60 (by weight)
B-2
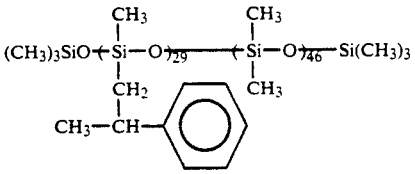
B-3
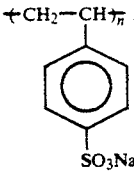
Average Molecular Weight: tens of thousands to millions
B-4
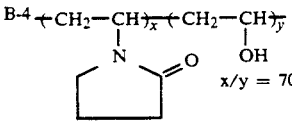
x/y = 70/30 (by weight)
B-5
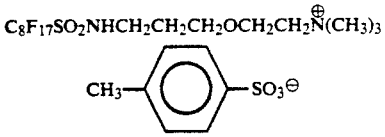
W-1
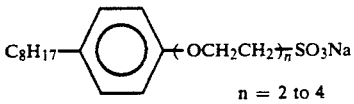
n = 2 to 4
W-2
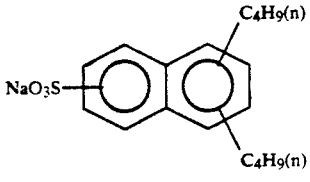
W-3
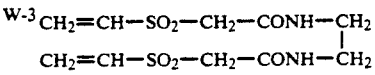
H-1

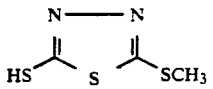

-continued

F-1

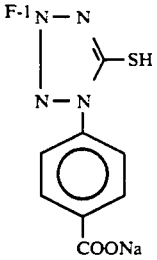

F-2

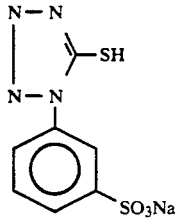

F-3

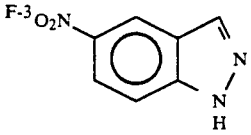

F-4

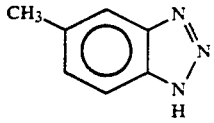

F-5

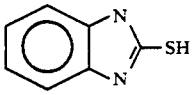

F-6

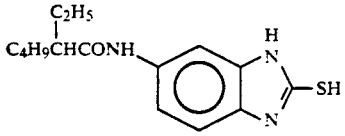

F-7

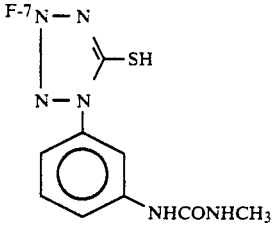

F-8

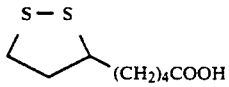

F-9

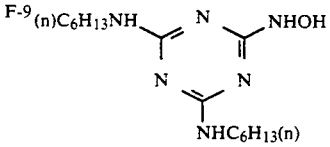

F-10

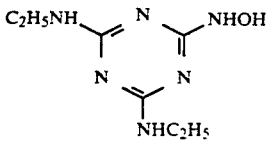

F-11

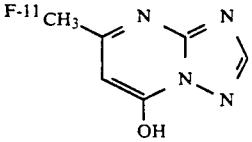

F-12

F-13

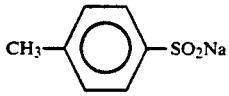

The thus obtained samples were finished, exposed and processed in the same way as in Example 5. The process operations also were the same as in Example 5. The bleaching solution composition was the same as in Example 5 except for the bleaching solution. But the bleach processing time was 40 seconds.

The bleaching solution composition which was used in Example 7 is shown below.

| Bleaching Solution | Mother Liquor | Replenisher |
|---|---|---|
| Ferric Nitrate | 0.20 mol | 0.30 mol |
| Chelating Compound | 0.31 mol | 0.47 mol |

-continued

| Bleaching Solution | Mother Liquor | Replenisher |
|---|---|---|
| B-51 | | |
| Ammonium Bromide | 100 g | 150 g |
| Ammonium Nitrate | 20 g | 30 g |
| Organic Acid | 0.10 mol/ 0.30 mol | 0.14 mol/ 0.42 mol |
| Water to make | 1.0 liter | 1.0 liter |
| pH | 4.2 | 4.6 |

In each photosensitive material which had been processed in the way described above, the change of gradation ($\Delta\gamma_G$) was measured by the same way as in Example 5. The results are shown in Table 7.

TABLE 7

| Organic Acid Compound | Concentration (mol/l) | Change of Gradation ($\Delta\gamma_G$) (Chelating Compound B-51) | Remarks |
|---|---|---|---|
| None | 0 | 0.13 | Comparison |
| Acetic Acid | 0.1 | 0.05 | Invention |
| | 0.3 | 0.03 | |
| Glycolic Acid | 0.1 | 0.03 | Invention |
| | 0.3 | 0.02 | |
| Lactic Acid | 0.1 | 0.06 | Invention |
| | 0.3 | 0.06 | |
| n-Butyric Acid | 0.1 | 0.06 | Invention |
| | 0.3 | 0.05 | |
| Malonic Acid | 0.1 | 0.07 | Invention |
| | 0.3 | 0.07 | |
| Malic Acid | 0.1 | 0.10 | Invention |
| | 0.3 | 0.09 | |
| Citric Acid | 0.1 | 0.10 | Invention |
| | 0.3 | 0.08 | |
| Aspartic Acid | 0.1 | 0.10 | Invention |
| | 0.3 | 0.09 | |
| Phthalic Acid | 0.1 | 0.10 | Invention |
| | 0.3 | 0.09 | |

As is apparent from the results of Table 7, the samples of the present invention are superior to the comparative sample with respect to the change of gradation in color image after processing and storage.

EXAMPLE 8

Sample 101 of the example of JP-B-2-44345 was finished, exposed and processed in the same way as in Example 5.

The same processing operation as in Example 5 was used except that in the processing operation the bleaching time was 30 seconds, and further the replenishment rate of the bleaching solution was changed in order to change the ratio (C/R) of the carry-over amount (C) of color development solution into the bleaching process to the replenishment ratio (R) of the bleaching solution as shown in Table 7. The processing solution composition other than the bleaching solution was the same as in Example 5.

The bleaching solution composition which was used in Example 8 is shown below.

| Bleaching Solution | Mother Liquor | Replenisher |
|---|---|---|
| Ferric Nitrate | 0.20 mol | 0.30 mol |
| Chelating Compound (see Table 8) | 0.31 mol | 0.47 mol |
| Ammonium Bromide | 100 g | 150 g |
| Ammonium Nitrate | 20 g | 30 g |
| Glycolic Acid | 0.5 mol | 0.75 mol |
| Water to make | 1.0 liter | 1.0 liter |
| pH | 3.5 | 3.3 |

In each photosensitive material which had been processed in the way described above, the residual silver amount was measured by the same way as in Example 5.

The results are shown in Table 8.

TABLE 8

| Compound | Residual Silver Amount ($\mu g/cm^2$) C/R 0.1 | 0.2 | 0.4 | 0.6 | Remarks |
|---|---|---|---|---|---|
| Comparative Compound A | 46.0 | 46.8 | 49.8 | 53.5 | Comparison |
| Comparative Compound B | 9.7 | 9.9 | 11.3 | 14.2 | Comparison |
| Comparative Compound E | 25.8 | 26.1 | 27.4 | 31.7 | Comparison |
| Compound B-25 | 9.8 | 9.8 | 10.2 | 11.1 | Invention |
| Compound B-51 | 8.2 | 8.1 | 8.5 | 8.7 | Invention |
| Compound B-64 | 9.1 | 9.3 | 9.7 | 10.0 | Invention |

As is apparent from the results of Table 8, the samples of the present invention were superior to the comparative samples with respect to the desilvering property even if the replenishment rate of the bleaching solution is reduced.

Therefore, it is clearly seen that the bleach fogging, post-processing stain and rapid desilvering property can be improved by using a composition which has a bleaching ability containing a bleaching agent of the present invention.

Further, it is clearly seen that the failure of color restoration, the change of gradation after processing and the rapid desilvering property can be improved by processing the photosensitive material with the composition containing an organic acid.

While the invention has been described in detail and with reference to specific embodiments thereof, it will be apparent to one skilled in the art that various changes and modifications can be made therein without departing from the spirit and scope thereof.

What is claimed is:

1. A method for processing exposed silver halide color photographic materials after color development with a composition having a bleaching ability which is used for processing silver halide color photographic materials, and containing a metal chelate compound formed from the salt of a metal selected from the group consisting of Fe(III), Mn(III), Co(III), Rh(II), Rh(III), Au(II), Au(III) and Ce(IV), and at least one of a compound represented by formula (I) and a compound represented by formula (II):

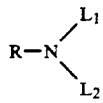

(I)

wherein $L_1$ and $L_2$ each represents

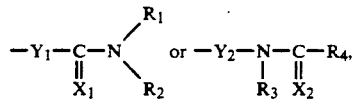

$X_1$ and $X_2$ each represents an oxygen atom or a sulfur atom, R, $R_1$, $R_2$ and $R_3$ each represents a hydrogen atom or an aryl or alkyl group which may be substituted; $R_4$ represents an aryl or alkyl group which may be substituted,

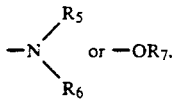

$R_5$ and $R_6$ each has the same meaning as $R_1$, $R_7$ represents an aryl or alkyl group which may be substituted; $Y_1$ and $Y_2$ each represents an arylene or alkylene group which may be substituted, R, $L_1$ and $L_2$ may be joined together to form rings;

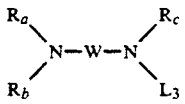

(II)

wherein $L_3$ represents

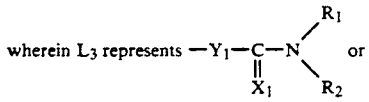

or

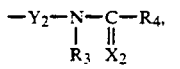

where $X_1$, $X_2$, $Y_1$, $Y_2$, $R_1$, $R_2$, $R_3$ and $R_4$ have the same meaning as in formula (I), $R_a$, $R_b$ and $R_c$ each represents a hydrogen atom or an aryl or alkyl group which may be substituted, $R_a$, $R_b$, $R_c$ and $L_3$ may be joined together to form rings, and W represents a divalent linking group.

2. A method as in claim 1, wherein the composition having a bleaching ability further contains an organic acid which has a pKa of from 1.5 to 6.5 and which is present in an amount of at least 0.05 mol per liter of processing solution.

3. A method as in claim 1, wherein the compound represented by formula (I) or (II) is represented by formula (III) or (IV):

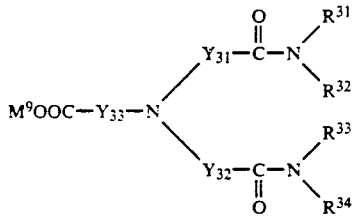

(III)

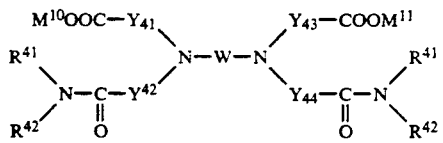

(IV)

wherein $Y_{31}$, $Y_{32}$ and $Y_{33}$, and $Y_{41}$, $Y_{42}$, $Y_{43}$ and $Y_{44}$ each represents an alkylene group or an arylene group; $M^9$, $M^{10}$ and $M^{11}$ each represents a hydrogen atom or a cation; $R_{31}$, $R_{32}$, $R_{33}$, $R_{34}$, $R_{41}$ and $R_{42}$ have the same meaning as $R_1$ and $R_2$ in formula (I) or (II); and W has the same meaning as W in formula (II).

4. A method as in claim 1, wherein R is an aryl or alkyl group which has —OH, —$COOM^1$, —$PO_3M^2M^3$ or —$SO_3M^4$ as a substituent group, where $M^1$, $M^2$, $M^3$ and $M^4$ each represents a hydrogen atom or a cation; and at least one of $R_a$, $R_b$ and $R_c$ is an alkyl or aryl group which has —OH, —$COOM^1$, —$PO_3M^2M^3$ or —$SO_3M^4$ as a substituent group, where $M^1$, $M^2$, $M^3$ and $M^4$ each represents a hydrogen atom or a cation.

5. A method as in claim 1, wherein the metal chelate compound is present in an amount of from 0.05 to 1 mol per liter of processing solution.

6. A method as in claim 1, wherein the composition having a bleaching ability further contains an organic acid.

7. A method as in claim 6, wherein the organic acid has a pKa of from 1.5 to 6.5.

8. A method as in claim 6, wherein the organic acid is present in an amount of at least 0.05 mol per liter of processing solution.

9. A method as in claim 1, wherein the metal chelate compound is formed with an Fe(III) salt and a compound represented by formula (I) or (II).

10. A method as in claim 1, wherein $R_1$, $R_2$ and $R_3$ represent hydrogen atoms, alkyl groups which may be substituted and which have from 1 to 4 carbon atoms, and phenyl groups which may be substituted.

11. A method as in claim 1, where $Y_1$ and $Y_2$ represent methylene groups or ethylene groups.

12. A method as in claim 1, wherein a substituent for the alkyl groups and aryl groups represented by R, $R_a$, $R_b$, $R_c$, $R_1$, $R_2$, $R_3$, $R_4$, $R_5$, $R_6$ and $R_7$ is selected from the group consisting of alkyl groups, aralkyl groups, alkenyl groups, alkynyl groups, alkoxy groups, aryl groups, substituted amino groups, acylamino groups, sulfonylamino groups, ureido groups, urethane groups, aryloxy groups, sulfamoyl groups, carbamoyl groups, alkylthio groups, arylthio groups, sulfonyl groups, sulfinyl groups, hydroxy groups, halogen atoms, cyano groups, sulfo groups, carboxyl groups, phosphono groups, aryloxycarbonyl groups, acyl groups, alkoxycarbonyl groups, acyloxy groups, carboxamido groups, sulfonamido groups, and nitro groups.

13. A method as in claim 1, wherein a substituent for the alkyl groups and aryl groups represented by R is selected from the group consisting of alkyl groups, hydroxy groups, sulfo groups, carboxyl groups and phosphono groups; a substituent for the alkyl groups and aryl groups represented by $R_a$, $R_b$ and $R_c$ is selected from the group consisting of acylamino groups, carbamoyl groups, alkyl groups, hydroxy groups, sulfo groups, carboxyl groups and phosphono groups; a substituent for the alkyl groups and aryl groups represented by $R_1$, $R_2$, $R_3$, $R_4$, $R_5$, $R_6$ and $R_7$ is selected from the group consisting of alkyl groups, aryl groups, hydroxy groups, sulfo groups, carboxyl groups, phosphono groups, amino groups, alkylthio groups and arylthio groups; and a substituent for the alkyl groups and aryl groups represented by $Y_1$ and $Y_2$ is an alkyl group.

14. A method as in claim 1, wherein W represents an organic divalent linking group selected from the group consisting of alkylene groups which have from 2 to 8 carbon atoms, arylene groups which have from 6 to 10 carbon atoms, a cyclohexane group, 5- to 7-membered divalent hetero rings, —$(W^1—O)_m—W^2$—, —$(W^1—S)_m—W^2$—, where $W^1$ and $W^2$ represent alkylene or arylene groups and m represents an integer of from 1 to 3, and

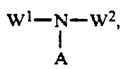

where A represents a hydrogen atom, a hydrocarbon group, —$L_A$—$COOM^5$, —$L_A$—$PO_3M^6M^7$, —$L_A$—OH or $—L_A—SO_3—M^8$, where $L_A$ represents an alkylene group which has from 1 to 8 carbon atoms or an arylene group which has from 6 to 10 carbon atoms, $M^5$ to $M^8$ represent hydrogen atoms or cations and combinations of these groups.

15. A method as in claim 1, wherein W is an alkylene group or a cyclohexane group.

16. A method as in claim 3, wherein the chelate compound is formed with an Fe(III) salt and a compound represented by formula (IV).

17. A method as in claim 1, wherein said method comprises processing said materials with a composition which has a bleaching ability, which is used for processing silver halide color photographic materials, and which contains a metal chelate compound formed from a salt of Fe(III) and a compound represented by formula (IV):

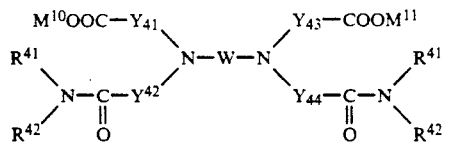

(IV)

wherein $Y_{41}$, $Y_{42}$, $Y_{43}$ and $Y_{44}$ each represents a methylene group or an ethylene group; $M^{10}$ and $M^{11}$ each represents a hydrogen atom or a cation; $R^{41}$ and $R^{42}$ each represents a hydrogen atom, an alkyl group having from 1 to 4 carbon atoms, or a phenyl group; W represents an alkylene group having from 2 to 8 carbon atoms or a cyclohexylene group; and the alkyl group and the phenyl group of $R^{41}$ and $R^{42}$ may be substituted by an alkyl group, an aryl group, a hydroxy group, a sulfo group, a carboxyl group, a phosphono group, an amino group, an alkylthio group or an arylthio group, and the alkylene group of W may be substituted by an alkyl group, a hydroxy group, a sulfo group, a carboxyl group or a phosphono group.

* * * * *